US007926583B2

(12) United States Patent
Newnam

(10) Patent No.: US 7,926,583 B2
(45) Date of Patent: Apr. 19, 2011

(54) ZERO TURNING RADIUS EARTHWORKING IMPLEMENT

(76) Inventor: Patrick Newnam, Wood Co., OH (US)

( * ) Notice: Subject to any disclaimer, the term of this patent is extended or adjusted under 35 U.S.C. 154(b) by 0 days.

(21) Appl. No.: 10/844,942

(22) Filed: May 13, 2004

(65) Prior Publication Data

US 2005/0263302 A1 Dec. 1, 2005

Related U.S. Application Data

(60) Continuation-in-part of application No. 10/102,069, filed on Mar. 20, 2002, now abandoned, and a division of application No. 10/798,114, filed on Mar. 11, 2004, now abandoned.

(51) Int. Cl.
*A01B 35/20* (2006.01)

(52) U.S. Cl. ..... 172/684.5; 172/817; 172/447

(58) Field of Classification Search ..... 37/231, 37/234, 235, 236, 266, 268, 264; 172/684.5, 172/817, 810, 781, 795, 446, 447; 482/126, 482/121

See application file for complete search history.

(56) References Cited

U.S. PATENT DOCUMENTS

| | | | | |
|---|---|---|---|---|
| 43,149 | A * | 6/1864 | Wood | 482/129 |
| 134,527 | A | 1/1873 | Eastman | |
| 1,717,861 | A | 6/1929 | Washburn | |
| 1,729,399 | A | 9/1929 | Noe | |
| 1,749,544 | A | 3/1930 | Pagano | |
| 2,590,951 | A | 4/1952 | Farison | |
| 3,645,020 | A * | 2/1972 | Beslin et al. | 37/91 |
| 3,873,088 | A | 3/1975 | Panepinto | |
| 4,124,080 | A * | 11/1978 | McCanse | 172/445.2 |
| 5,033,740 | A | 7/1991 | Schwartz et al. | |
| 5,076,370 | A * | 12/1991 | Stubben et al. | 172/781 |
| 5,209,307 | A * | 5/1993 | Hotte | 172/445.2 |
| 5,377,984 | A | 1/1995 | Ciccia | |
| 5,533,283 | A * | 7/1996 | Roth | 37/142.5 |
| 5,533,952 | A | 7/1996 | Schaber | |
| 5,603,172 | A * | 2/1997 | Maher | 37/233 |
| 5,782,016 | A * | 7/1998 | Feller et al. | 37/384 |

(Continued)

FOREIGN PATENT DOCUMENTS

GB 2339153 1/2000

OTHER PUBLICATIONS www.nefitco.com (bars and cable attachments).

*Primary Examiner* — Thomas B Will
*Assistant Examiner* — Jamie L McGowan

(57) ABSTRACT

A tool carrier assembly of an earthworking implement is comprised of two components that contact a surface being worked; an earthworking tool and a depth guide. The tool carrier assembly is pivotably connected to a support structure. The support structure is removably attached to a lift arm assembly of a motive source. As the front wheels of the motive source are raised off the ground by downward force applied to the lift arm assembly, the depth guide assumes the function of bearing the load of the implement and a portion of the motive source. The vehicle steered and powered by the rear wheels may then move in any direction and the tool carrier assembly will articulate on a controllably variable vertical axis. As the earthworking tool moves material on the surface, the tool carrier pivots about a controllably variable horizontal axis to maintain contact with the surface as the tool carrier assembly pivots in response to uneven terrain.

20 Claims, 21 Drawing Sheets

U.S. PATENT DOCUMENTS

| | | | | |
|---|---|---|---|---|
| 5,921,902 | A | 7/1999 | Carpenter | |
| 6,109,363 | A * | 8/2000 | High | 172/820 |
| 6,240,662 | B1 * | 6/2001 | Borowiak | 37/404 |
| 6,431,288 | B1 * | 8/2002 | Hoffart | 172/439 |
| 6,450,929 | B1 * | 9/2002 | Markham | 482/121 |
| 6,692,415 | B1 * | 2/2004 | Winston | 482/126 |
| 6,851,486 | B2 * | 2/2005 | Marshall | 172/792 |
| 6,923,750 | B1 * | 8/2005 | Hinds | 482/126 |
| 2003/0016982 | A1 | 6/2003 | Nicolay et al. | |
| 2003/0136568 | A1 * | 7/2003 | McReynolds et al. | 172/817 |
| 2003/0139264 | A1 | 7/2003 | Kuo | |

* cited by examiner 252
258
256
254
260
232
230
240
244
246
248
253
101

92B
39A
274
264
266
262
100
270
272
268

ZERO TURNING RADIUS EARTHWORKING IMPLEMENT

CROSS-REFERENCES TO RELATED APPLICATIONS

This application is a continuation in part of patent application Ser. No. 10/102,069, titled Zero Turning Radius Earthworking Scraper, filed Mar. 20, 2002, now abandoned, and is a sibling of the divisional application Ser. No. 10/798,114, entitled Method of Earthworking, previously filed on Mar. 11, 2004 now abandoned.

BACKGROUND

1. Field of Invention

This invention relates to earthworking scrapers, specifically those that pivot around a vertical axis.

2. Description of Prior Art

Earthworking scrapers are well known in the art. They are designed to be pushed, pulled,
or both pushed and pulled. The implements are either self propelled or propelled by a separate, detachable motive source. There are many various arrangements for the adjustment of the blade position. The prior art is replete with ways to control the depth of the grading tool, including depth guides such as skids, wheels, rollers and the like.

Many grading implements are designed to be connected to utility vehicles by means of a three point hitch. This allows for the disengagement of the tool with the surface of earth, or other material being graded, by raising the implement. This lifting of the grader is necessary to position the implement to grade in a different direction. The disengagement of the grader is time consuming and inefficient.

The three point hitch does not allow the application of any additional downward pressure on the grading tool, in some cases allowing the tool to ride up over a high spot on the surface being graded, and often requiring repeated attempts to shave the material being graded down to the required elevation. U.S. Pat. No. 2,749,631 to Thompson (1956) discloses a three point hitch scraper blade that rotates around a vertical axis. This type of implement, having limited means of depth control, tends to cut too deeply in areas of loosened soil. Constant depth adjustment of such implements, is required to achieve the desired result. The three point hitch is commonly used as a rear hitch on a tractor. The monitoring of the grader attached with a three point hitch mechanism causes the operator of the tractor to twist around to look to the implement and causes operator discomfort and fatigue.

A depth control device, which requires less operator attention to achieve the desired cut and fill results, is commonly used in the art. U.S. Pat. No. 3,234,669 to Kachnik (1966) shows a wheel as an effective depth control device. Wheels or rollers are frequently employed for this purpose. The caster wheel is well known and used in the art as a means of depth control for a scraper blade. This rotateable wheel attachment may also serve as an effective ground support member. The castering motion of the wheel does not change the orientation of the scraper blade resulting in a limited effectiveness of the scraper in sharp turning maneuvers.

Earthworking scrapers, designed to be towed behind a vehicle, are present in the prior art. U.S. Pat. No. 6,112,828 to Leal (2000) shows an implement that has pivotably attached wheels, whose adjustment provides a controllable means of raising or lowering the blade. The simple pivoting on a pin hitch arrangement, commonly used to connect the implement to the tow vehicle, does not allow the implement to be lifted off the ground. Repositioning the implement requires more space to maneuver, and this type of grading implement is more difficult to use in confined spaces, or areas where there are obstacles to maneuver around.

Bi-directional surface leveling implements are more efficient due to their ability to grade in one direction, stop, and reverse direction without repositioning the implement or disengaging the tool from the surface being graded. U.S. Pat. No. 6,168,348 B1 shows a type of implement, when attached to a skidsteer utility vehicle, that has a wider range of possible movement than most grading implements. However, it is still frequently necessary to reposition the implement when grading in confined spaces or when working around obstacles. In the process of turning the skidsteer vehicle the surface being worked is often disturbed and requires additional leveling.

A well developed area of the art employs a blade that pivots around a vertical axis. This gives the implement added capability to move the materials being worked lateral to the direction of the draft more effectively. These implements, however, do not provide an effective means for moving the implement as a whole in a lateral direction.

Multiple blades for moving earth laterally to the direction of the draft of the implement exist in the prior art U.S. Pat. No. 6,283,225 B1 to Hermonson (2001) shows an implement attached to a skidsteer utility vehicle capable of such action. To reposition such an implement of this type the turning action of the skidsteer disturbs the surface being worked and necessitates another pass with the implement to grade the surface again. An implement of this type does not have the ability to adjust the height of the blades effectively. The earthworking scrapers available today suffer from a number of disadvantages:

(a) Grading implements currently available require a disengagement from the surface being worked to reposition the implement for a change of direction.
(b) The skidsteer utility vehicles commonly used for a motive source cause a disturbance of the surface being worked as a result of their mode of turning in a short radius.
(c) Most graders have no ability to move soil in one direction, stop and without disengaging from the surface being worked, move the soil in any other desired direction.
(d) Poor visibility of the scraper blade is a common problem.
(e) Many of the graders in use today have a limited range of depth control adjustment.
(f) An inability to apply downward pressure while turning sharply is a disadvantage of the currently available implements.
(g) A limited adaptability to different soil conditions necessitates waiting for the ideal conditions before attempting to perform the earthworking task.
(h) Most of the currently available graders have objects extending beyond the lateral edges of the scraper that can damage trees, houses, and other valuable objects at the work site as the grader is being used.
(i) A grader that is connected to a motive source that has the ability to rotate a lift arm assembly around a vertical axis is unavailable in the market place today.
(j) A hydraulic excavator is not well suited to grading.
(k) A pivotable grader of the existing art has no easily interchangeable pivotable component.
(l) An interchangeable pivotable component is unavailable in the marketplace.

SUMMARY

In accordance with the present invention an earthworking scraper comprises a controllable scraper blade supported by a depth guide, or roller, functioning as a unit that is pivotable around a vertical axis, while powered by a highly maneuverable motive source.

OBJECTS AND ADVANTAGES

Accordingly, in addition to the objects and advantages set forth above in my patent application, further objects and advantages of the present invention are:

(a) to provide an earthworking scraper that can create a smooth level surface on any material being worked in situ and easily and quickly perform a turning maneuver without disengaging from the surface being worked;

(b) to provide a grader that is removably attached to a skidsteer type of utility vehicle and allows the motive source to turn in a tight turning radius with the front wheels of the skidsteer elevated off the ground without disturbing the surface being worked;

(c) to provide a grader that is removably attached to a hydraulic excavator and allows the motive source to move the lift arm assembly and tool carrier assembly about the surface being shaped without disturbing the surface being worked by turning the motive source;

(d) to provide a grader that can grade in any direction, stop and urge the lift arm assembly to move in a cyclonic or anti-cyclonic motion and cause the grader to move soil with a slewing motion and then quickly move in any other desired direction pushing the soil wherever it needs to go;

(e) to provide a grader that is in plain view of the operator of the motive source and a scraper blade or earthworking tool whose edges are easily seen while engaged in grading so that the implement can grade very close to sidewalks, houses, and other such fixed obstacles at the work site;

(f) to provide for a grader whose cutting edge height can be easily controlled to achieve complex grading maneuvers on a variety of terrain;

(g) to provide for a grader capable of putting downward pressure on the ground support wheels, rollers, skid plate, soil texturing device, cultivation tool, or other such depth control mechanism, to enable the cutting edge to carve the high areas without riding up over the top of the high spots and still be able to turn while performing the task;

(h) to provide for a grader that can easily and quickly change the ground support rollers, or other such depth control components, to adapt to different soil conditions at the work site resulting in a wider window of opportunity for work;

(i) to provide for a grader with sides that are smooth to allow the operator to maneuver close to delicate objects without damaging them.

(j) to provide for the transfer of hydraulic fluid to a grader that can be rotated around a vertical axis, or an axis perpendicular to the surface being shaped, in either direction and for as many revolutions as necessary with no twisting of the hydraulic lines. (c) to provide a grader that can grade in any direction, stop and turn the skidsteer in a cyclonic or anti-cyclonic motion and cause the grader to move soil in a lateral direction and then quickly move in any other desired direction pushing the soil wherever it needs to go.

Further objects and advantages are to provide a grader that is easily attached to a construction site machine that is used for the purpose of moving construction materials or soil in situ, that takes advantage of the highly maneuverable nature of the skidsteer, or other motive source having a lift arm assembly, and performs simple or complex grading tasks quickly and easily while affording the operator a highly controllable earthworking tool. An advantage of being able to attach the earthworking implement to a motive source having a surface engaging propulsion mechanism using tires or tracks that are activated by the selectively controlled bilateral steering mechanism to urge the motive source to move in any desired direction on the surface being shaped. The advantage of being able to use a motive source that has a lift arm assembly including a boom and a jib has the added advantage of being pivotable about an axis that is perpendicular to the surface plane of the surface engaged portion of the tracks. The two part lift arm assembly may be selectively moved in a cyclonic or anticyclonic motion independent of the movement of the motive source as it is urged to move about the surface in situ by the tracks of the motive source. The skidsteer motive source has a lift arm assembly having a boom but no jib. The skidsteer moves the implement in a cyclonic or anticyclonic motion by the bilateral action of the wheels or tracks. Still further objects and advantages will become apparent from a consideration of the following description and drawings.

DRAWING FIGURES

In the drawings, closely related figures have the same number but different alphabetic suffixes.

REFERENCE NUMERALS IN DRAWINGS

Figure 1:
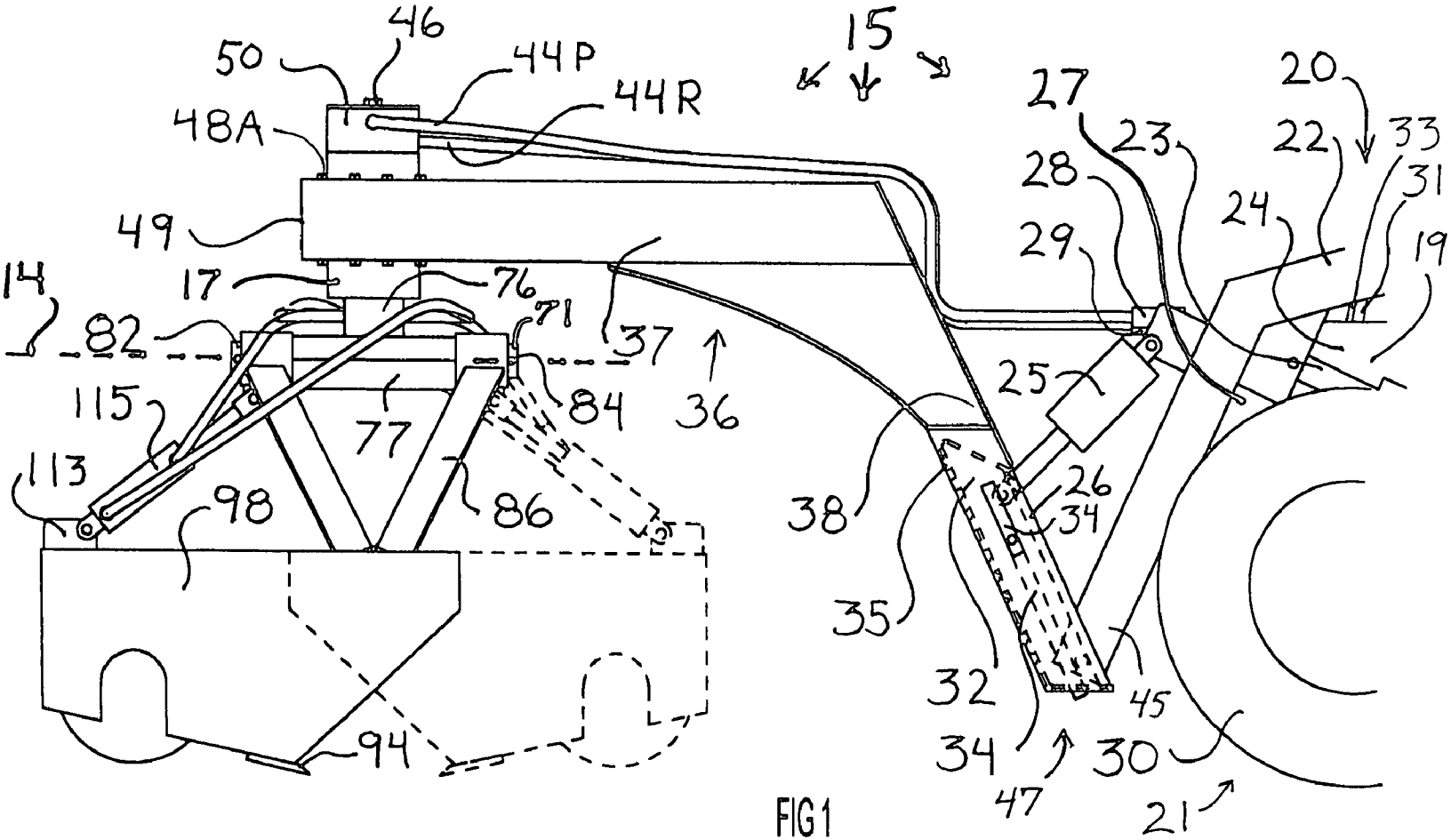
FIG. 1 shows an elevation view of the motive source attached to the grader with a hydraulically controlled grader box.

12 grader
13 controllably variable vertical axis
14 controllably variable horizontal axis
15 earthworking implement
16 multiple axis rigid structural assembly
17 multiple axis rotation assembly
18E first predetermined position
18D second predetermined position
19 left side
20 motive source
21 surface contact propulsion assembly
22 lift arm assembly
23 lift arm ram
24 chassis
25 tilt ram
26 tilt mechanism
27 forward end
28 hydraulic fluid pressure connection
29 hydraulic fluid return connection
30 front wheels of motive source
31 left side propulsion control
32 connection foot
33 right side propulsion control
34 locking mechanism
35 attachment shoe
36 support structure
37 main body
38 proximal end
39 hydraulic motor
40 housing
41 solenoid activated hydraulic valve assembly
42 control wire harness
43 P motor hose
43 R motor hose
44 P pressure hydraulic hose
44 R return hydraulic hose
45 outwardly disposed end
46 bolt
47 tilting axis
48 A bolt
48 B nut
49 distal end
50 hydraulic swivel sleeve
51 rotary hydraulic coupling
52 passage O-ring
52 A annular channel O-ring
53 oil seal
54 P hydraulic fluid passage
54 R hydraulic fluid passage
55 P fluid port
55 R fluid port
56 cap
57 P annular channel
57 R annular channel
58 shim
59 M mating surface
59 F mating surface
60 upper bearing assembly
61 first load bearing surface
62 lower bearing assembly
63 second load bearing surface
64 grease seal
65 P tool carrier hose
65 R tool carrier hose
66 P service fluid port
66 R service fluid port
67 clamp seat
68 retaining clamp
69 first opposed load bearing surface
70 key
71 second opposed load bearing surface
72 primary gear
74 drive gear
76 shaft
77 tee bar
78 power shaft
79 key-way
80 dry shaft
82 rocking pin
84 retainer bolt
85 F mid point sleeve
85 R mid point sleeve
86 adjustable frame
87 F front strut
87 R rear strut
88 wing tip pin
90 wing tip sleeve
91 wing tip carrier bushing
92 tool carrier assembly
92A tool carrier assembly
92B tool carrier assembly
92C tool carrier assembly
94 cutting edge
94B cutting edge
95 depth guide
96 scraper blade
96A scraper blade
96B scraper blade
98 end plate
98A end plate
99 eyebrow stop
100 roller
101 material contact surface
102 roller bearing carrier assembly
103 hub
104 axle
104A axle
105 sliding collar
106 mid-plate
107 set screw
107A set screw
108 axle roller bearing assembly
109 locking tang
110 hub nut
111 dust cover
112 clevis pin
113 tab
114 ram base
115 ram
116 ram rod
117 ram pivot pin
118 retaining clip
119 interior structure
120 cross member
121 long cross member
122 back plate
122A back plate

123 depth guide axis retainer assembly
124 mounting plate
126 dry shaft cap
128 rack gear
130 slide channel
132 equalizer frame
134 equalizer pin
136 single roller tool carrier assembly
138 half size mounting plate
140 pulley
142 pulley bearing
144 washer
145 axle bolt
146 inner mount
148 locking arm
150 hook
152 lever
154 lever pin
156 snap ring
158 block
160 block pin
162 journal structure
164 means of selectively relieving hydraulic fluid pressure in desired fluid channels
165 hydraulic excavator
166 two part lift arm assembly
167 jib
168 boom
180 turret
182 slewing mechanism
184 under carriage
188 track assembly
190 A means of selectively directing the flow of pressurized hydraulic fluid through various channels
192 A means of selectively directing the flow of electrical energy through various circuits
194 boom ram
196 jib ram
198 tool ram
200 tool ram connector assembly
202 jib pin
202A second jib pin
204 first brace of members
205 second brace of members
206 tool ram connector assembly pin
208 attitude control pin
208A second attitude control pin
209 attitude control pin hole
209A second attitude control pin hole
210P journal structure mounting plate
210S journal structure mounting plate
212 mast
213 mast gland half round annular groove
214 universal quick change adapter
215P mast gland
215S mast gland
216 jib pin hole
216A second jib pin hole
217P gudgeon
217S gudgeon
217A gudgeon
218S mast stern plate
218B mast bow plate
219P mast port plate
219S mast starboard plate
220S gib
220P gib
220A gib
221 prolate end of locking pin
222 locking pin
223 locking pin clip
224 mast clevis
225 pin head
226 mast ram
227 locking pin clip hole
228 arch support
229 locking pin shaft
230 keel
231 locking pin hole
232 port side plate
233 starboard side plate
234 bow scraper blade
236 bow plate
238 earthworking tool
240 stern plate
242 cultivator tool
244 dog ram pivot means
246 dog pivot means
248 dog tail
252 rotateable axle
253 convoluted receptacle
254 roller scraper
256 dog
258 keel roller
260 dog ram
262 body
264 top
266A side shield
266B side shield
268 rotating tool holder
270 rotary cultivation tool
272 boss
274 means for imparting rotational energy
276 thrust cap
278 thrust cap concentric exterior surface
280 thrust cap concentric interior surface
282 thrust cap interior outboard surface
284 thrust cap exterior outboard surface
286 thrust cap inboard surface
288 inwardly disposed concentric gib surface
290 inboard gib surface
292 first interior inboard gib surface
294 first outwardly disposed concentric gib surface
296 second interior inboard gib surface
298 second outwardly disposed gib surface
300 third interior inboard gib surface
302 outboard gib surface
304 gib bolt
306 gib bolt hole
308 threaded gib bolt hole
310 third outwardly disposed concentric gib surface
312 thrust washer
314 canard
316 head board
318 fluke
320 fluke wing
322 tee bar gland

FIGS. 1,2,3,4,5,6,9

Description of the Preferred Embodiment

FIG. 1 shows a side elevation view of an earthworking implement 15 comprised of a grader 12 attached to a motive source 20 of the type known as a skidsteer loader. An engine is mounted within a chassis 24. A motive source of this type further includes a source of electrical generation and an operator's compartment. A front wheel 30, or a surface contact propulsion assembly 21, is connected to the left front section of the chassis, and another front wheel, or surface contact propulsion assembly, is connected to the right front section of the chassis. The aft section of the chassis is connected to a left side wheel or surface contact propulsion assembly and a right side wheel or surface contact propulsion assembly. The motive source further includes a means of bilateral propulsion control including a variable speed and direction control for the left side front and rear wheels or surface contact propulsion assembly, and a variable speed and direction control for the right side front and rear wheels or surface contact propulsion assembly. A hydraulic power source is included on the motive source. Also included are an auxiliary hydraulic control and a hydraulic lifting mechanism. The motive source is shown with the grader attached to it. A support frame or support structure 36 extends outwardly and journals a vertical shaft 76. The shaft is integrally connected to a tee-bar 77. The tee-bar is attached to an adjustable frame 86, which is in turn connected to a tool carrier assembly 92. A multiple axis rotation assembly 17 is the pivotable connection between the support structure and the tool carrier assembly. The adjustable frame may be considered to be a component of the tool carrier assembly. A multiple axis rigid structural component 16 is a component of the multiple axis rotation assembly and may include an assembly of the vertical shaft, and the tee bar.

A lift arm assembly 22 on the motive source has a lift arm on both sides of the skidsteer. The skidsteer is well known in the art to have a lift arm assembly that has a limited range of motion. The two lift arms extend outward from a forward end 27 of the skidsteer, and a cross brace joins the two lift arms together near the forward end of the lift arms. A hydraulic fluid pressure connection 28 and a hydraulic fluid return connection 29 are located on one of the lift arms. The lift arms are pivotally connected to the aft section of the skidsteer chassis. A lift arm ram 23 is pivotally connected to each lift arm.

A tilt mechanism 26 extends outwardly from an outwardly disposed end 45 of the lift arm assembly. The tilt mechanism is pivotally connected to the lift arm assembly at a tilting axis 47. The tilting axis is perpendicular to a vertical centerline plane or a variable vertical plane that bisects the lift arm assembly laterally from the front or fore or outwardly disposed end of the lift arm assembly to the aft or back end of the lift arm assembly. Since the lift arm assembly described in the above paragraph has lift arms on each side of the chassis that are joined by the cross brace, the arms are disposed on different planes. The components of the lift arm assembly are on planes that are in a somewhat parallel relation to the variable vertical plane. A tilt ram 25 is also adjustably linked to the lift arm assembly by one or more hydraulically controlled mechanisms. The vertical centerline plane that bisects the lift arm assembly also bisects the motive source laterally along a centerline that extends from the front of the motive source to the back of the motive source. The aft of the lift arm assembly is pivotally attached to the motive source. A connection foot 32 is integrally constructed as part of the tilt mechanism. Attached to the connection foot is one or more elements of a locking mechanism 34. The locking mechanism locks the grader to the motive source.

In FIG. 1 an attachment shoe 35 shown is integrally attached to a proximal end 38 of a main body 37 of the support structure. The locking mechanism locks the connection foot into a nested position with the attachment shoe as a means of attaching the support structure to the motive source in preparation for use of the implement.

Figure 2:
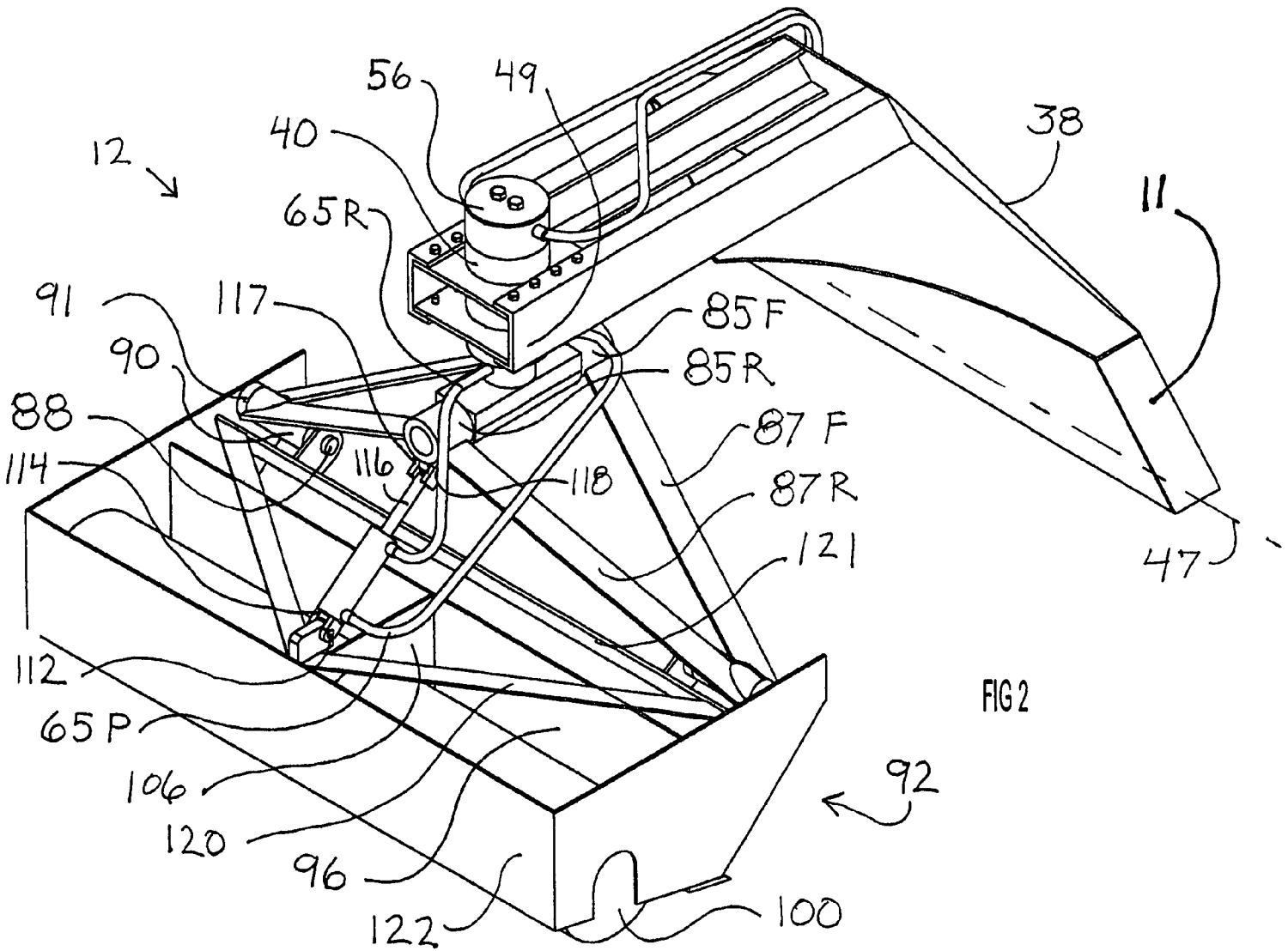
FIG. 2 shows a perspective view of the grader with a hydraulically controlled grader box.

In FIGS. 1 and 2 main body 37 is an overarching beam that extends outwardly from the motive source. The beam comprises two lengths of rigid material lying parallel to one another in a somewhat horizontal orientation and rigid plates that integrally connect the beam to the connection foot. The lengths of rigid material have three flat sides joined together at the edges at perpendicular angles to one another. The middle side has a greater width than the other two sides an is in a somewhat vertical orientation. The shorter sides have a somewhat horizontal orientation and extend toward the horizontal sides on the matching beam. The two lengths of rigid material are joined together by a plate of rigid material that is integrally attached to a distal end 49 of the main body of the support structure. A second rigid plate is integrally attached to the bottom edge of the beam and extends downward to the outer corner of the connection foot. A third rigid plate that mirrors the second rigid plate is integrally attached to the opposite side of the beam as the second rigid plate and is integrally attached to the opposite corner of the connection foot. The two matching lengths of rigid material which form the beam have holes in the four short sides that extend toward the middle of the beam. The holes are located at precise intervals that match holes on a flange that is integrally connected to a housing 40. The housing is rigidly attached a predetermined distance from distal end 49 of the main body of the support structure.

The flanges are integrally attached to the outer circumference of the housing on two parallel planes that are perpendicular to the sides of the cylinder that forms the housing. In FIG. 1 a bolt 48A and a nut 48B are securing the housing to the support structure.

Figure 3:
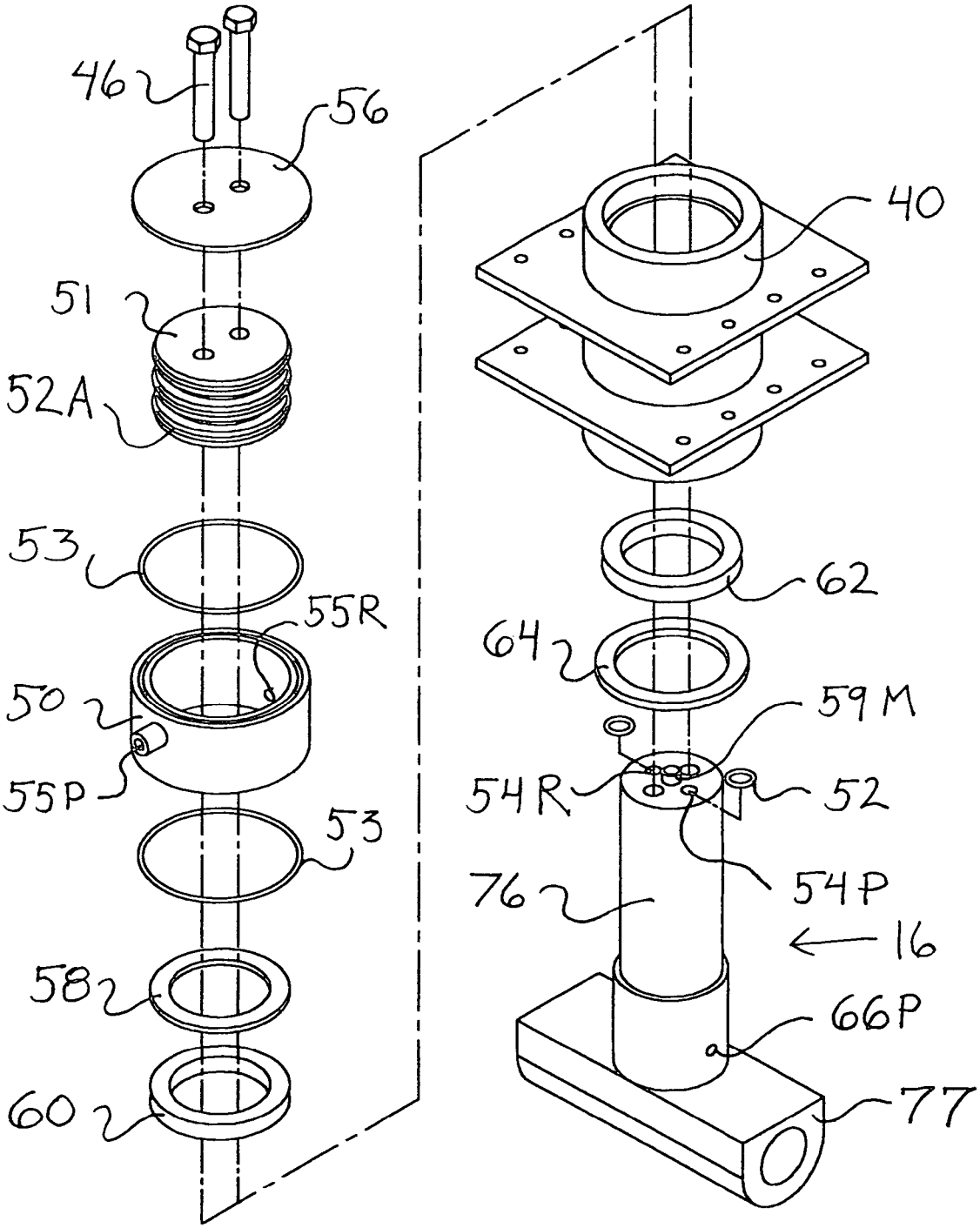
FIG. 3 shows an exploded perspective view of pivoting components.

In FIG. 3 housing 40 is a hollow cylinder of rigid material that has a thickness that allows for the shaping of the interior wall of the housing. The middle section of the housing is thicker than the top section or the bottom section. The middle section has a smaller inside diameter than the upper or lower sections of the housing. The larger diameter of the upper and lower sections of the housing matches the outer contact surfaces on, and retains, an upper bearing assembly 60 and a lower bearing assembly 62. The two sets of tapered roller bearings operating in opposition to one another journal the somewhat vertical shaft 76 within the housing. The somewhat vertical shaft is aligned on a somewhat vertical first axis. The housing is a means to retain the somewhat vertical first axis in a fixed position relative to the support structure. Each one of the upper and lower inner circumferential surfaces of the housing, that retain the tapered roller bearing assemblies in the housing and bear the load of the forces translated from the shaft through the tapered roller bearing assembly components, are a first opposed load bearing surface 69.

In FIG. 3 the shaft has outer surfaces that are shaped to match the inner diameter of the bearing surfaces. The upper portion of the shaft, which is journalled by the tapered roller bearings, has a smaller diameter than the lower portion of the shaft. The outer circumferential surface of the shaft that is in contact with the inside diameter of the roller bearing assemblies is a first load bearing surface 61. The first load bearing surface and the first opposed load bearing surface are held in a concentric relation to one another by the tapered roller bearing assemblies. Upper bearing assembly 60 and lower bearing assembly 62 of FIG. 3 show this concentric relation of the first load bearing surface and the first opposed load bearing surface.

Figure 5:
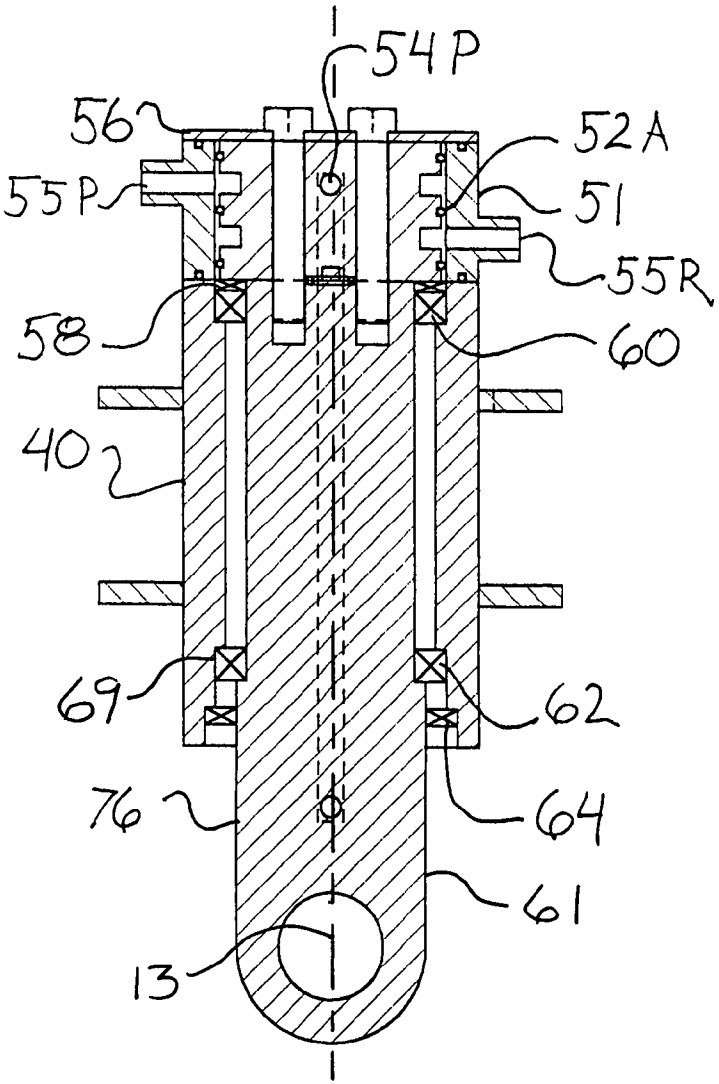
FIG. 5 is view in detail of the portion indicated by the section lines 5-5 in FIG. 4.
Figure 4:
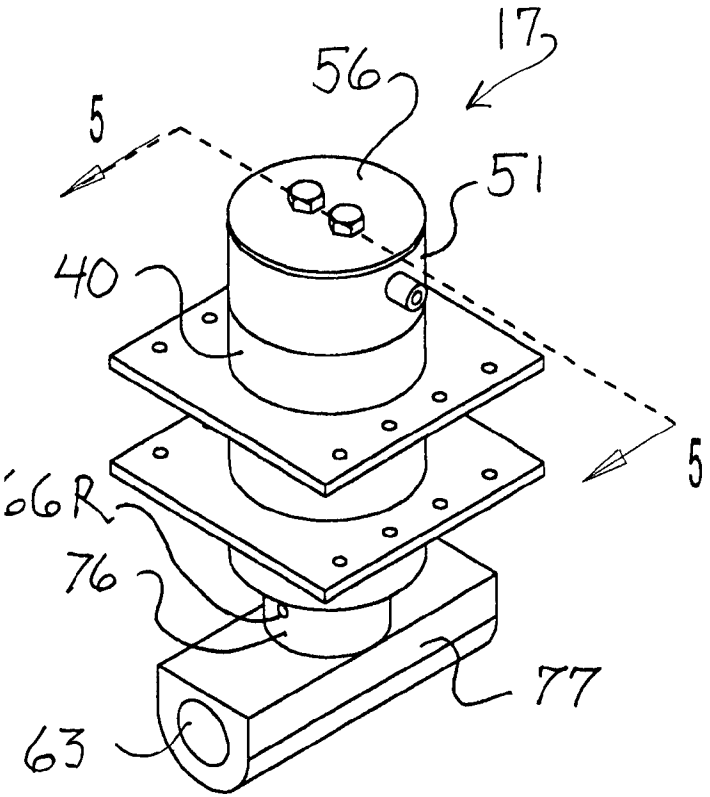
FIG. 4 is a perspective view of the assembled components of FIG. 3

A grease seal 64 is retained in the housing at a point at some distance below lower bearing assembly 62. Upper bearing assembly 60 is in contact with a shim or spacer 58. These shims contact the outer circumference of the lower end of a rotary hydraulic coupling 51. A bolt 46 attaches coupling 51 to shaft 76 through a vertical hole drilled through the interior of the rotary coupling and into the shaft. Bolt 46 attaches the rotary coupling to the shaft through a second hole drilled vertically through the rotary coupling and into the shaft. The bolt holes are centered on a vertical plane that bisects shaft 76, and is shown in FIG. 4 as section line 5. FIG. 5 shows the plane as the diagonal lines that are the intersection of the section plane with the components of the housing and the shaft and other associated parts. The variable vertical plane intersects the section plane at a perpendicular angle at the center of shaft 76 and is shown in FIG. 5 as the controllably variable vertical axis 13. The holes in the shaft are threaded to retain the bolts. The bottom surface of coupling 51 has a mating surface 59M, which interfaces with a mating surface 59F on the top of shaft 76.

Figure 6A:
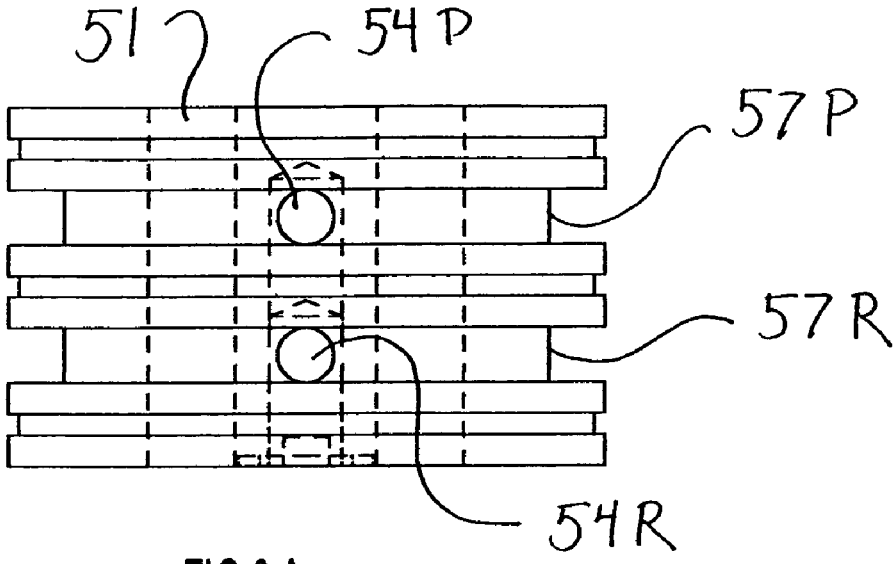
FIGS. 6A and 6B is a detail of a component of FIGS. 3 and 5.
Figure 6B:
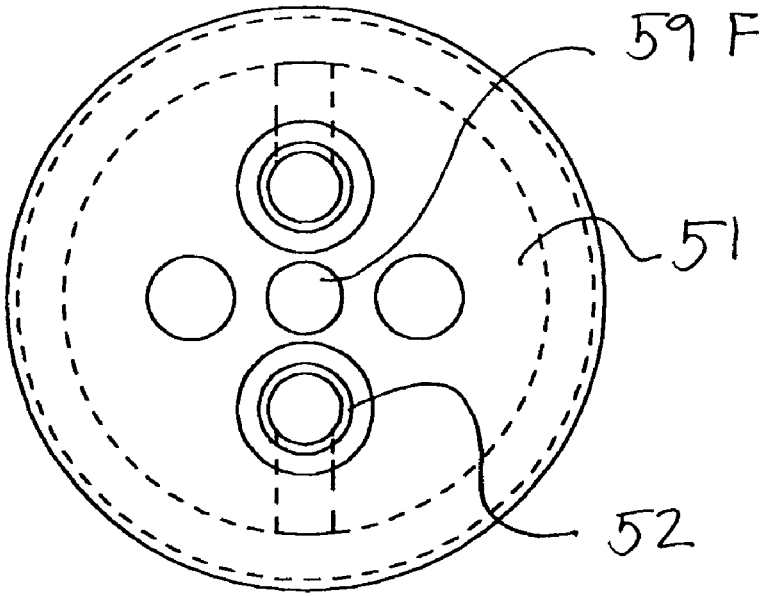

In FIGS. 6A and 6B coupling 51 has an annular channel 57P cut into the outer cylindrical surface along a horizontal plane. An annular channel 57R is cut into the outer surface of the coupling along a second plane that is parallel to but below the first plane of channel 57P. The two channels are separated by a portion of the surface of the coupling. A hydraulic fluid passage 54P extends inward horizontally from the inner vertical surface of annular channel 57P and then downward through the interior of hydraulic coupling 51. A hydraulic fluid passage 54R extends inward horizontally from the inner vertical surface of annular channel 57R and then downward through the interior of coupling 51. In FIGS. 3 and 5 these fluid passages continue downward through the interior of shaft 76 and are centered on the variable vertical plane that bisects shaft 76. This variable vertical plane is perpendicular to the vertical section plane that the bolt holes of shaft 76 are centered on. In FIG. 5 an O-ring 52 seals the junction of the vertical hydraulic passages in coupling 51 and shaft 76. The O-rings are seated in grooves machined into coupling 51. The annular channels are separated from one another by an O-ring 52A. The annular channels are defined at their outer edges by a hydraulic swivel sleeve 50.

In FIG. 3 swivel sleeve 50 is a cylinder that surrounds the rotary hydraulic coupling 51. The sleeve 50 has two separate holes with female threads which are located accordingly to lead to each of the two channels 57. An Oil seal 53 is retained in the spaces between sleeve 50 and housing 40 at the lower end of swivel sleeve 50 and at the upper end of sleeve 50 by a cap 56. The cap is secured to coupling 51 by bolts 46. An upper fluid port 55P is joined to the hydraulic fluid pressure connection at the motive source by a hydraulic hose 44P. A lower fluid port 55R is joined to the hydraulic fluid return connection 29 at the motive source by a hydraulic hose 44R.

In FIG. 3 a service fluid port 66P is connected to channel 54P on shaft 76. A service port 66R is connected to channel 54R on the opposite side of shaft 76. The service fluid ports exit the shaft an equal distance below the lower opening of housing 40.

In FIGS. 2 and 3 tee bar 77 is integrally attached at its midpoint to the bottom of the shaft 76. The tee bar is perpendicular to the shaft and has a hollow cylindrical core that defines a controllably variable horizontal axis 14 or a somewhat horizontal first horizontal axis. The core of the tee bar is a second load bearing surface 63 to journal a rocking pin 82. The outer circumferential surface of the rocking pin is a second opposed load bearing surface 71. The pin 82 is also journalled at both ends of the tee bar by adjustable frame 86, a part of the tool carrier assembly. The rocking pin is retained in position on the tool carrier assembly by a retainer bolt 84, one at each end of the rocking pin 82.

In FIG. 2 the adjustable frame 86 is a structure resembling a pair of wings in flight, on the downward beat. Frame 86 comprises a forward midpoint sleeve 85F having an inside diameter identical to the inside diameter of tee bar 77, and a rearward midpoint sleeve 85R having an identical inside diameter also. The sleeves 85F and 85R are separated by the length of the tee bar and positioned to be in line with one another. A strut 87F is integrally connected to the forward midpoint sleeve 85F and extends outward and downward and is integrally joined to a wing tip sleeve 90 at the end of the strut 87F. A second strut 87R is also integrally connected to the wing tip sleeve 90 and extends back to midpoint sleeve 85 R. The second pair of struts are attached to their respective midpoint sleeves 85F and 85R and are joined at their outward tips to the second wing tip sleeve. The two wing tip sleeves are separated by a predetermined distance and are in alignment on a somewhat horizontal, third horizontal axis. The wing-like frame is formed by four struts which form the sides of two isosceles triangles which share a common base. This common base is formed by the tee bar and midpoint sleeves 85F and 85R as they journal rocking pin 82. The rocking pin is aligned on the somewhat horizontal first horizontal axis which is perpendicular to and non co-planer in relation with the somewhat horizontal third horizontal axis on which the wing tip sleeves pivot.

The two wing tip sleeves each journal a wing tip pin 88 which is horizontally retained and is also journalled by a wing tip carrier bushing 91. The bushing is integrally attached to the tool carrier assembly, and to a long cross member 121. The adjustable frame is connected to tool carrier assembly 92 at a third connection point disposed rearwardly at a predetermined distance below rearward midpoint sleeve 85R, and equidistant from either wing tip. This third connection point is pivotally linked by a ram pivot pin 117 to the outer end of a ram rod 116.

In FIG. 2 a ram 115 is a hydraulic cylinder assembly which is well known in the art. The ram has two ports for hydraulic fluid. A tool carrier hose 65P attaches to one of the fluid ports on the ram. A tool carrier hose 65R attaches to the second fluid port on the ram. The tool carrier hoses attach to the service fluid ports on shaft 76. A ram base 114 is at the opposite end of the ram from the ram rod. A clevis pin 112 pivotally connects the ram base to the tool carrier assembly.

In FIG. 2 the tool carrier assembly is the ground contact component of the grader comprising; a cutting edge 94 or an earthworking tool 238, a scraper blade 96, a mid-plate 106, a roller 100 on one side of the mid-plate, roller 100 on the other side of the mid-plate, an end plate 98 at each end of the scraper blade, a cross member 120 on one side of the mid-plate, another cross-member on the other side of the mid-plate, long cross-member 121 between the two end plates, an axle 104 on the axis of each of the rollers and a roller bearing carrier assembly 102 attached to the ends of the axles. The adjustable frame and all of the connections of the adjustable frame to the tool carrier assembly may be included as components of the tool carrier assembly.

In FIG. 2 cutting edge 94 is an elongated hardened steel bar, with its leading edge tapered to a somewhat sharpened edge that is disposed at a downward angle. The cutting edge is level with the bottom of the rollers. The cutting edge is oriented perpendicular to the draft of the tool carrier assembly. The cutting edge is integrally attached to the lower edge of the scraper blade. The cutting edge lies on a plane that bisects the somewhat vertical plane of the scraper blade. The cutting edge extends forward of the axis that is formed by the intersection of the plane of the cutting edge and the plane of the scraper blade. The cutting edge axis is parallel to the axis of the rollers that function as a material contact surface 101, or a ground contact surface.

In FIG. 2 scraper blade 96 is elongated and is approximately the same length as the cutting edge. The blade is attached to the'upper surface of the cutting edge, rearward of the tapered leading edge of the cutting edge. The scraper blade extends vertically and is integrally attached at its midpoint to the rearwardly depending mid-plate.

The mid-plate in FIG. 2 lies within a vertical plane that is perpendicular to the scraper blade. It extends rearward and bisects the part of the tool carrier assembly that is aft of the scraper blade. A tab 113 is the pivot able connection point to ram base 114. It is an upwardly extending appendage integrally attached to the upper edge of mid-plate 106, near the aft edge of the mid-plate. The tab lies in the same vertical plane as the mid-plate. Clevis pin 112 passes through a hole in the tab to pivotally connect the ram base to the tab. A retaining clip 118 on each end of the clevis pin retains the pin in place.

In FIG. 2, two end plates are parallel with the mid-plate and are integrally attached to opposite ends of the cutting edge and the scraper blade. The point at which the end plates attach to the cutting edge is level with the bottom of the rollers. The bottom margin of the end plates rises as it continues rearward to join the back plate. There is an arch shaped cutout to allow access to the end of roller bearing carrier assembly 102. Integrally attached to a point near the forward edge of the end plates at the inward surface of the end plates are the sleeves which journal the outward ends of wing tip pins. The inboard end of the wing tip pins are journalled by sleeves on the long cross member. These pins pivotally connect the tool carrier assembly to the adjustable frame. These connection points are forward of the scraper blade.

A back plate 122 lies within a vertical plane that is parallel with the vertical plane of the scraper blade and is integrally attached to the rearmost edges of the mid-plate and the two end plates.

Figure 9:
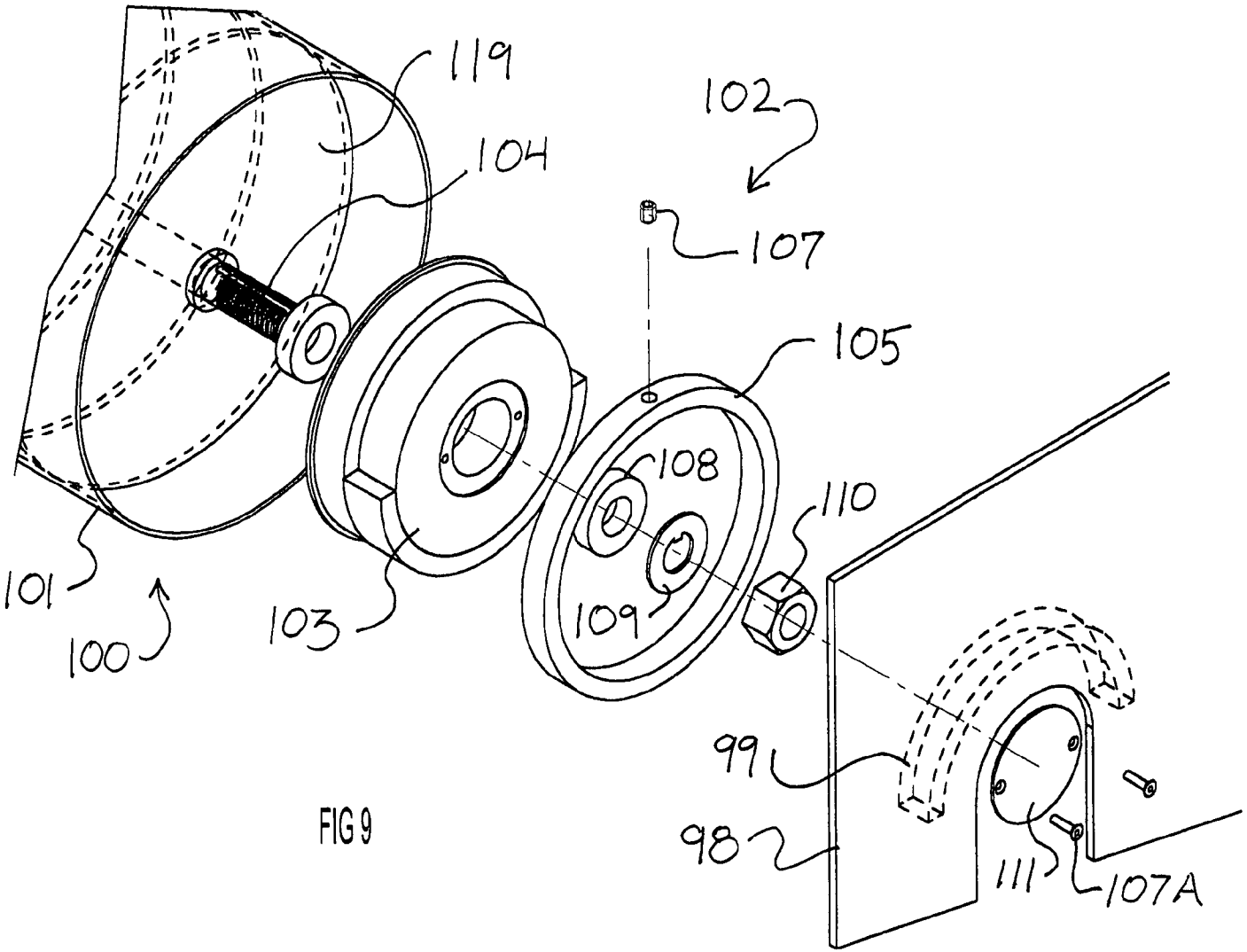
FIG. 9 is an exploded view in detail of a component of FIGS. 1 and 2.

In FIG. 9 an eyebrow stop 99 is integrally attached to both sides of the mid-plate aft of the scraper blade. The eyebrow is essentially a half circle shape affixed with the open end in the downward position. The eyebrow stop is a segment of a circular steel plate having a thickness providing sufficient mass to withstand the forces required to operate the invention. The eyebrow stop has a convex surface defined by an arc whose radius is centered on the somewhat horizontal, second horizontal axis about which the rollers rotate. The eyebrow stop has a concave surface defined by a shorter radius that has it's center at the same point on the horizontal axis. Eyebrow stops 99 are attached to the inboard surfaces of the endplates equidistant from the same horizontal axis. A roller bearing carrier assembly 102 nests with the concave surface of the eyebrow stop.

In FIG. 9 roller bearing carrier assembly 102 comprises; an pair of axle roller bearing assemblies 108 housed within a machined steel hub 103, a sliding collar 105, a set screw 107, a locking tang 109, a hub nut 110, a dust cover 111, and a set screw 107A. Sliding collar 105 is a cylindrical shaped component of the roller bearing carrier assembly and has an inside diameter that is approximately the same as the arc of the convex surface of the eyebrow stop. A hole is threaded from the outside of the surface of the cylinder of the sliding collar through the thickness of the collar. The inner diameter of the collar also matches the outside diameter of a surface of hub 103. The inside diameter of the surface of the bearing race of the axle roller bearing assemblies match a surface on the axle.

The above described integrally attached end plates, mid-plate, and eyebrow stops, together with the carrier bearing assemblies, provide a means for retaining the axis about which the rollers rotate and the scraper blade in a somewhat fixed position in relation to one another.

Figure 13:
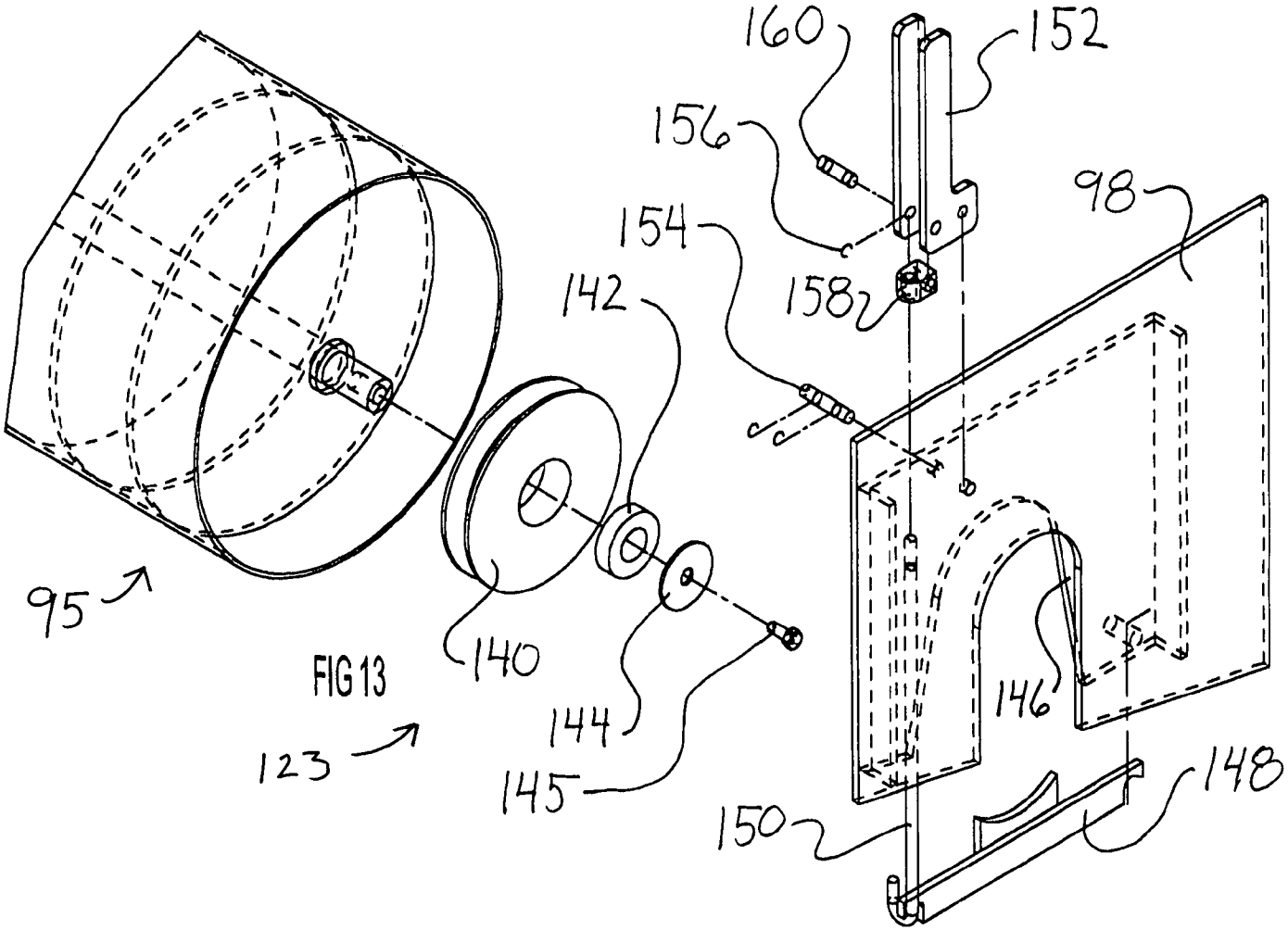
FIG. 13 is an exploded view in detail of a component of FIGS. 1 and 2.

In FIGS. 13 and 9 roller 100 comprises; axle 104 that is integrally attached to the center of an interior structure 119. The interior structure or disk lies within the interior of and perpendicular to the cylinder of the material contact surface 101. The material contact surface of the roller is circumferential. A multiplicity of disks are integrally attached to the inside of the ground contact surface that forms the outer surface of the cylindrical rollers. Axle 104 extends some predetermined distance beyond the ends of the cylinder that forms the ground contact surface. The axle is threaded on both ends and has a key way machined from the end toward the center of the axle a predetermined distance.

FIGS. 1,2,3,4,5,6,9

Operation of the Preferred Embodiment

The grader is shown if FIG. 1 attached to a skidsteer loader. The skidsteer is the preferred motive source because of its high degree of mobility. The operator has a high degree of control over the speed and direction of the skidsteer due to the bilateral nature of the power controls. The bilateral power controls provide a means of moving in multiple directions. A variable speed direction control activates the left side set of wheels, causing them to move in unison in either a clockwise or counter clockwise rotation. A variable speed direction control activates the right side set of wheels causing them to move in unison in the same manner. The hydraulic power source provides fluid power as a means of propulsion for the four wheels while the skidsteer is at work on a surface. Fluid power is also provided as a means to operate the lift arms, conveying upward or downward force through the lift arm assembly of the skidsteer. Hydraulic power is also provided as a means to power auxiliary hydraulic implements that may be attached to the skidsteer.

Lift arm assembly 22 can be elevated or lowered to any desired height within the range of motion of rams 23 that are pivotally connected to the lift arms. The lift arms of the skidsteer shown if FIG. 1 have a somewhat parallel range of motion in relation to one another. The nature of the pivotable connections of the bilateral lift arm arrangement only allows for a planar range of motion of the lift arms. In the lowest position of the lift arms, side shifting of the lift arms is restricted by contact with skidsteer chassis 24. The tilt mechanism is pivotally connected to the forward outwardly disposed end of lift arm assembly 22. Tilt ram 25 is pivotally attached and is a means to allow the support structure to pivot controllably about the axis that is perpendicular to the variable vertical plane. Hydraulic fluid pressure connection 28, and hydraulic fluid return connection 29 are affixed to the lift arm assembly for use in powering auxiliary attachments that may be connected to the skidsteer. The lift arms are capable of such downward force as to lift the front of the chassis in an upward direction. This upward tilting attitude of the chassis of the skidsteer causes the two front wheels to be lifted off the ground and the two rear wheels to remain on the ground. With the front wheels off the ground, the implement of FIG. 1, attached to the lift arm assembly would contact the ground and bear part of the weight of the skidsteer.

Connection foot 32 is shaped to allow the attachment of a number of implements to the skidsteer or other motive source. The locking mechanism is manually or hydraulically activated or deactivated to slide or move controllably between a first predetermine position 18E to a second predetermined position 18D to hold in place or to release attachment shoe 35. The attachment shoe locks onto the connection foot in a tightly locked condition by the locking mechanism to resist separation from the skidsteer, providing a means of attaching the lift arm assembly of the motive source to the support structure.

The support structure is designed so as to resist bending and twisting and to function as a rigid extension of the lift arm assembly. It is designed to be in the level position with the lift arms raised a few inches from the full downward position with the skidsteer and implement resting on a level surface. The main body functions to hold housing 40 near distal end 49 of the support structure. This allows tool carrier assembly 92, which may include the adjustable frame and the pivotable connections between the adjustable frame and the tool carrier assembly to rotate in unison with the shaft. The shaft is journalled inside the housing, around the somewhat vertical axis. The shaft journalled in the housing is a first means of pivotable connection of the support structure to the adjustable frame. The combination of pivotable connections between the skidsteer lift arm assembly, the tilt mechanism, support structure and housing, the shaft and tee bar, the adjustable frame, and the tool carrier assembly, also collectively constitute a means of pivotable connection of the motive source to the tool carrier assembly. This collective means of pivotable connection allows the tool carrier assembly to rotate controllably about a somewhat vertical axis. As the tool carrier rotates it is held at a distance so that its rotation is not impeded by the proximal end of support structure 38.

This somewhat vertical axis 13 can be tilted on the variable vertical plane that bisects the lift arm assembly. The fore and aft tilting of axis 13 can be caused by activation of the tilt mechanism 26 of the lift arm assembly 22, also providing a first means of depth control of the earthworking tool or cutting edge 94 while the implement is engaged on the surface being worked. The controllable actions that result in the variation of the orientation of the somewhat vertical axis make axis 13 controllably variable.

This same controllably variable vertical axis 13 will vary concomitant the variable vertical plane as the skidsteer rocks from side to side when in motion, or when the skidsteer is tilted to one side or the other. The tilt of the variable vertical plane to a first position of orientation of the variable vertical plane that is tilted toward a direction varied from the vertical position, would also tilt the controllably variable vertical axis of the multiple axis rotation assembly as it is held rigidly in relation to the lift arm assembly by the support structure. The tilt of the variable vertical plane to a second position of orientation that is tilted toward an opposite direction of variation from said vertical position on the right side of the chassis or lift arm assembly would also tilt the controllably variable vertical axis 13 of the multiple axis rotation assembly along with the support structure and the chassis.

Shaft 76 is retained in housing 40 by an opposed set of tapered roller bearings. The housing is machined so that upper bearing assembly 60 and lower bearing assembly 62 are rigidly held in place. Bearing assembly 60 is held in place by shim 58 as it is locked into place on the shaft by rotary hydraulic coupling 51. The coupling is larger in diameter than the top of shaft 76 and is held onto the shaft by two bolts 46. The shaft and the coupling are held in alignment with one another by matching mating surfaces 59. Passage O-rings 52 seal the fluid passages of the rotary coupling to the fluid passages in the shaft. Grease seal 64 keeps dust and foreign material out of the housing.

Hydraulic swivel sleeve 50 creates two separated annular channels 57 when it is in place around the rotary hydraulic coupling. O-rings 52A separate the channels from one another and seal the upper and lower edges of the channels. O-rings 52A are slightly compressed into their seats by the snug fit of the swivel sleeve around the coupling. Oil seals 53 keep dirt and dust out of the inner surfaces of the swivel sleeve by sealing the gaps at the top and bottom of the sleeve. The sleeve is retained on the rotary coupling by cap 56 which rotates along with the shaft, the coupling, and the bolts that hold the cap and coupling onto the top of the shaft. The sleeve and the housing do not rotate. Hydraulic hoses 44P and 44R, which are attached to fluid ports 55P and 55R on the sleeve, remain in a stationary position.

Any hydraulic fluid that enters fluid port 55P under pressure is conducted through the port and into annular channel 57P. The fluid is then free to flow around the channel in either direction around the perimeter of rotary hydraulic coupling 51 and into hydraulic fluid passage 54P with which it is connected. The pressurized fluid is then forced downward through the section of hydraulic fluid passage 54P that interfaces with hydraulic fluid passage 54P which continues downward through shaft 76. The flow of pressurized fluid continues to be conducted through the same hydraulic fluid passage whether the shaft is rotating or not. The shaft may also rotate in either direction and the flow of pressurized fluid will continue through the same fluid passage. The flow of hydraulic fluid may be reversed selectively by auxiliary hydraulic control 21 located on the motive source. When the flow is reversed the pressure side of the hydraulic system becomes the return side. The flow of pressurized hydraulic fluid through the shaft is a means of conducting pressurized hydraulic through the pivotable connection between the support structure and the adjustable frame.

The shaft 76 is integrally connected to tee bar 77. The tee bar journals rocking pin 82. The rocking pin is also journalled by midpoint sleeves 85F and 85R so that adjustable frame 86 is pivotally connected to the tee bar by the rocking pin. Retainer bolt 84 keeps the rocking pin in position. The interconnection of the shaft and tee bar to the adjustable frame is a second means of pivotably connecting the support structure to the adjustable frame of the tool carrier assembly 92, allowing the assembly 92 to rotate about the somewhat horizontal, first horizontal axis, shown in FIG. 1 as the controllably variable horizontal axis 14. The adjustable frame pivots on axis 14 that is perpendicular to the shaft 76. Axis 14 always remains perpendicular to the shaft 76. Every component of the invention that is interrelated or connected between the rocking pin 82 and the skidsteer, rotates concomitantly, in relation to axis 14, independently of the tool carrier assembly 92. The concomitant rotation is caused by a rocking motion of the motive source as it is propelled in a controllably variable forward direction or a controllably variable reverse direction across variations of high and low areas on the surface being worked. FIG. 1 shows the orientation of axis 14 while the skidsteer is in position for moving the implement in a reverse direction. The axis 14 of rotation of rocking pin 82 changes orientation as the shaft 76 rotates within housing 40 when the skidsteer changes direction on the surface being worked. As the shaft rotates within the housing 40, the first opposed load bearing surface 69 and the first load bearing surface 61 rotate in opposition to one another about the vertical axis 13 that is defined by the center of the radius of the outer circumferential surface of the shaft 76. The shaft 76 rotates about the controllably variable vertical axis 13, and the somewhat horizontal, first horizontal axis, the controllably variable horizontal axis 14, is held in a fixed perpendicular relation to the controllably variable vertical axis 13. A range of motion plane that axis 14 rotates on is shown in FIG. 1 as axis 14. The axis 14 that is defined by the center of the radii of the circumferential surfaces of the rocking pin 84 and the cylindrical hollow core of the tee bar 82, is the controllably variable horizontal axis 14. The second load bearing surface 63 and the second opposed load bearing surface 71 rotate in opposition to one another about axis 14. The tool carrier assembly rotates about both of the axes of the multiple axis rotation assembly that pivotally connect the tool carrier assembly to the support structure. The lift arm assembly holds the support structure in a controllably variable tilt position which is translated to the multiple axis rotation assembly as the tilt mechanism is rotated about the tilting axis of the motive source, or is held in a position. The controllably variable vertical axis may also vary from the vertical along the controllably variable vertical rocking plane as set forth above, as a result of the rocking motion of the motive source caused by the controllable movement of the motive source to move in a direction on an uneven or sloping surface in situ.

Adjustable frame 86 keeps the axis of the rocking pin, the controllably variable horizontal axis, perpendicular to the axis of rollers 100. The controllably variable horizontal axis is also perpendicular to scraper blade 96 as the adjustable frame connects tool carrier assembly 92 to the rocking pin. The adjustable frame is pivotally connected to wing tip carrier bushings 91 which are integrally attached to the tool carrier assembly and to cross member 121. These two connection points are located forward of the scraper blade adjacent to the end plates. Wing tip pins 88, are journalled by wing tip sleeves 90, and also by the wing tip carrier bushings. Struts 87 integrally connect the mid point sleeves to the wing tip sleeves. The adjustable frame is indirectly connected to the tool carrier assembly by pivotable connections to ram 115. Ram base 114 is pivotally connected to tab 113 by clevis pin 112. The tab is an integral part of mid-plate 106. Ram rod 116 is pivotally connected to the adjustable frame by ram pivot pin 117. The ram pivot pin is held in position by retaining clip 118. The hydraulically controlled ram allows the tool carrier assembly to be adjustably held in relation to the adjustable frame, as the adjustable frame pivots about the somewhat horizontal, third horizontal axis. The wing tip pins, sleeves, and bushings, along with the ram and the connection between the ram, the adjustable frame and the tool carrier assembly, are a means of pivotable connection that allows the adjustable frame to rotate controllably about a somewhat horizontal, third horizontal axis.

The hydraulic fluid to control the ram flows through the channels in shaft 76. Hydraulic fluid passage 54P is the pressurized channel in the shaft and hydraulic fluid passage 54R is the return channel in the shaft. Tool carrier hose 65P connects to service port 66P on shaft 76. Tool carrier hose 65R connects to service port 66R on shaft 76. Tool carrier hose 65P is connected to the fluid port at the base of the ram. Hydraulic fluid that enters this port under pressure forces the ram rod to extend. Tool carrier hose 65R is connected to the fluid port nearest the ram rod end of the ram. Fluid exits the port near the ram rod end of the ram, as the ram rod extends, through tool carrier hose 66R. The return flow of hydraulic fluid continues into shaft 76 through service port 66R.

Auxiliary hydraulic control 21 is activated on demand to allow the flow of pressurized hydraulic fluid out of the hydraulic fluid pressure connection 28 and the return of an equal amount of hydraulic fluid into hydraulic fluid return connection 29 on the skidsteer. The pressurized fluid travels through the sealed hydraulic system and into ram 115. As ram rod 116 extends to its full length the flow of the pressurized hydraulic fluid stops. Auxiliary hydraulic control 21 may then be switched to the reverse flow position to allow hydraulic fluid to surge through the sealed hydraulic system in a reverse flow direction and in so doing forces the ram rod to be retracted into the ram. In this way the ram may be lengthened or shortened on demand by the use of auxiliary hydraulic control 21.

The change of length of the ram causes a significant change in the depth of cutting edge 94. The cutting edge is integrally attached to and works in conjunction with scraper blade 96, when the invention is engaged in work. As the ram is lengthened the cutting edge rises up off of the surface being worked. As the ram is shortened the cutting edge digs more deeply into the surface being worked. This change in length of the ram causes the cutting edge to rotate around an arc that is formed by the cutting edge as it rotates around the axis about which a pair of rollers 100 rotate. The cutting edge is the leading edge of the tool carrier assembly. The depth of the cutting edge and scraper blade can be controlled by the activation of auxiliary hydraulic control 21 to shorten or lengthen the ram. This second controllable means of depth control causes the cutting edge and scraper blade or earthworking tool to rise above the surface being worked, while the material contact surface of the depth guide or roller remains engaged in contact with the surface in situ. The controllable means of depth control also allows the operator of the novel invention to controllably vary the position or height of the earthworking tool in relation to the surface being worked. This controllable ability would also allow the operator of the implement to cause the earthworking tool to dig more deeply into the material below the surface being worked in order to shave off a high area on the surface in situ. The depth of the cutting edge and scraper blade can also be controlled by tilt mechanism 26, a previously mentioned first means of depth control, while the motive source is moving in a forward or a backward direction. FIG. 1 shows the implement as it would be oriented with the motive source moving in the backward or reverse direction. The orientation of the controllably variable horizontal axis is in approximate alignment with the vertical centerline plane of the lift arm assembly while the implement is propelled in such a first direction.

The pair of rollers 100 are the trailing component of the tool carrier assembly. They are removably attached to the end plates and the mid-plate. They are held in place by an eyebrow stop 99 that is integrally attached to each of the plates on the inboard side of the end plates and both sides of the mid-plate. The rollers comprise; the ground contact surface, discs 119, and axle 104. The rollers may be exchanged for an alternate set of rollers as the working conditions require. The ground contact surfaces can have a variety of features that perform various functions. Rubber would function well on concrete or other delicate surfaces. Studs would break up the surface being worked. A roller with bars would break up lumps in the surface being worked. The disks create a rigid support structure that is integrally attached to the axle.

The roller bearing carrier assembly comprising; hub 103, sliding collar 105, set screw 107, two axle roller bearing assemblies 108, two snap rings 123, locking tang 109, hub nut 110, dust cover 111, and set screw 107A, is mounted on the axle. The roller bearing carrier assembly is a means to attach the rollers to the plates and allow the roller to rotate about a somewhat horizontal, second horizontal axis. It accomplishes this by nesting the hub into the bottom side of the eyebrow stop, and sliding the collar over the outer circumference of the eyebrow stop and a bottom portion of the hub. The collar slides into position over the eyebrow stop from its position on the hub to hold the roller in place in the tool carrier assembly.

The set screw secures the sliding collar and prevents it from sliding off of the eyebrow stop The snap rings hold the bearings in place within the hub. The locking tang prevents the nut from coming off the threaded end of the axle. The nut keeps the hub on the axle. The dust cover keeps the bearings clean. Set screws 107A secure the dust cover to the hub. The bearings allow the axle to rotate within the hub as the hub is held in place by the sliding collar.

Material contact surface 101 of the rollers flattens the surface being worked and supports the weight of the grader while it is engaged in work. Additional downward force may also be applied to the rollers by lifting the front wheels of the skidsteer off the ground, so that the rollers or depth guide bear a portion of the weight of the motive source or skidsteer. The front wheels are lifted by retracting the lift arm rams completely so that the lift arms are in the full downward position. An upward lifting of a part of the chassis is the result With the front wheels or surface contact propulsion assembly of the skidsteer lifted off the surface being worked, the skidsteer can turn in a very short turning radius in a cyclonic or anticyclonic motion. While turning the skidsteer in this manner, the tool carrier assembly casters and changes its orientation. The cutting edge becomes parallel with the support structure. Even though the orientation of the tool carrier assembly, and the controllably variable horizontal axis about which it pivots changes, the relative position of the cutting edge, scraper blade, and the axis about which the rollers rotate does not change in relation to one another.

The tool carrier assembly rolls over the surface being worked in response to the movement of the motive source. Cross members 120 reinforce the tool carrier assembly. The tool carrier assembly casters in response to a turning motion or change of direction of the motive source. As the tool carrier assembly pivots around a somewhat vertical axis the scraper blade remains at the leading edge of the tool carrier assembly. The cutting edge prevents the scraper blade from bending and screeds off the material being worked. With the cutting edge near the level of the surface being worked any high spots in the surface being worked are sliced off by the cutting edge and the excess material tends to build up on the leading side of the scraper blade. The rollers function not only as a means of ground support but also as a means of providing a depth guide as they contact the surface being worked. As the tool carrier assembly continues forward, urged on by the motive source as it moves in any direction, the trailing rollers ride on the screeded surface and maintain the cutting edge and scraper blade at a consistent height even though they may be passing over a depression or hole in the surface of the material being worked. A portion of the excess material being worked that is being pushed along the leading edge of the scraper blade, is deposited into the depressions or holes in the surface being worked.

Figure 10:
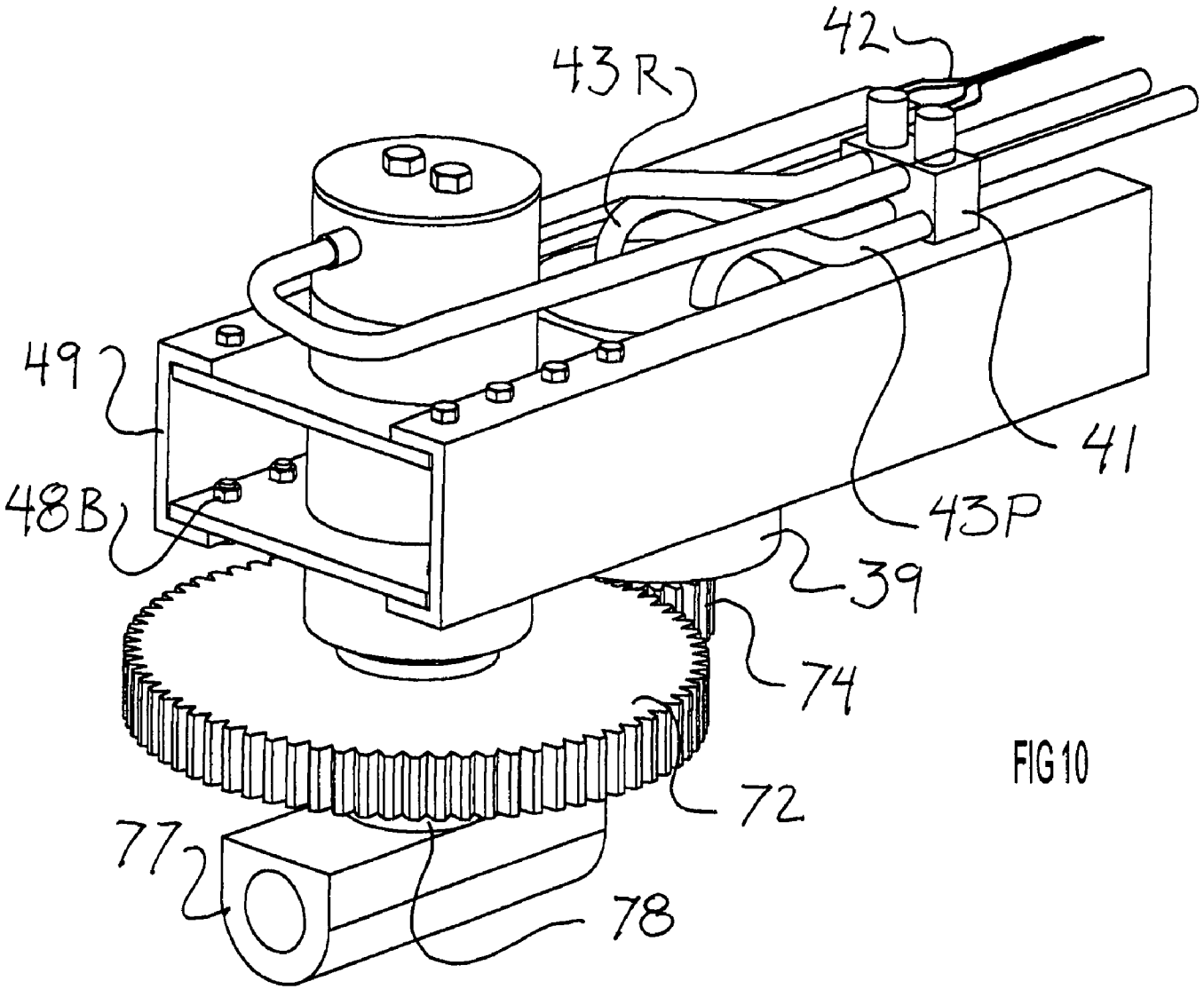
FIG. 10 is a perspective view of an alternative embodiment of FIGS. 1 and 2.

FIG. 10—Description of Hydraulic Motor and Gear Drive

The alternative embodiment comprising; the motive source, the support frame, the housing, a power shaft 78, the rotary hydraulic coupling, the adjustable frame, the tool carrier assembly, and all of the connections between these components as set forth in the preferred embodiment, a hydraulic motor 39, a solenoid activated hydraulic valve 41, a motor hose 43P, a motor hose 43R, a retaining clamp 68, a key 70, a primary gear 72, and a drive gear 74.

Power shaft 78 of the alternative embodiment is identical to shaft 76 at all the connection points with other components of the preferred embodiment. It is identical at all surfaces of interrelation with other components. Shaft 78 is longer than shaft 76. Hydraulic fluid passages 54P and 54R are longer by the same distance. Shaft 78 has a key-way 79 cut into the shaft in a vertical orientation a predetermined distance below housing 40. The key-way is cut into the shaft on the opposite side of the shaft in the same vertical orientation. A clamp seat 67 is cut into shaft 78 at the upper edge of the key-ways. Two seats are cut around the entire circumference of the shaft in an annular orientation. The distance between the clamp seats is identical to the thickness of primary gear 72.

Primary gear 72 has a center hole with a diameter that is slightly larger than the diameter of the uncut surface of power shaft 78. Retaining clamp 68 is removably attached to the shaft at the clamp seat. A key has a rectangular shape and has dimensions that corresponds with the key-way. The gear has two key-ways cut into the center hole that are opposite one another. The primary gear has evenly spaced teeth on its outer perimeter. The teeth on the primary gear interface with teeth on drive gear 74. The drive gear is attached to hydraulic motor 39.

Hydraulic motors are well known in the art. The hydraulic motor has motor hose 43P connecting it to solenoid activated hydraulic valve assembly 41. Motor hose 43R connects the motor to the valve also. The valve is connected in line to pressure hydraulic hose 44P and pressure hydraulic hose 44R. A control wire harness 42 connects the solenoid to the electrical system of the motive source.

FIG. 10—Operation of Hydraulic Motor and Gear Drive

The components of the preferred embodiment are present in this alternate embodiment and function in the same way in this embodiment.

Power shaft 78 is longer to allow for the thickness of gear 72. The power shaft may be given rotational energy that is translated through primary gear 72. The gear is held horizontally in place on the vertical shaft by the retaining clamps. The keys prevent the gear from rotating, in relation to the shaft, when installed on the shaft. The teeth on the outer perimeter of the primary gear engage teeth on drive gear 74. The drive gear is given rotational energy by hydraulic motor 39 which is secured to main body 37.

The hydraulic motor is well known in the art. The hydraulic motor is reversible and is controlled by the flow of hydraulic fluid through solenoid activated hydraulic valve assembly 41 connected to the hydraulic pressure and return hoses set forth in the preferred embodiment. The valves direct the flow of the hydraulic fluid and are opened or closed by solenoid valve 41 which is activated electronically, a means of power activation. A control wire harness connects the solenoid to a the electrical system of the skidsteer. Motor hose 43P connects the control valve assembly to the motor. When the hydraulic fluid is directed through hose 43P, it passes through the motor and imparts rotational energy to the drive gear. The fluid then is directed into hose 43R and returns to the control valve assembly. The direction of flow of the hydraulic fluid may be reversed by the auxiliary hydraulic control on the skidsteer. In this mode of operation the shaft and tool carrier assembly are given rotational energy independent of that given by the movement of the motive source. The tool carrier assembly can be positioned in this way in any desired degree of rotation around the vertical axis of the shaft. The auxiliary hydraulic pump, the controls that activate the flow of pressurized hydraulic fluid, the fluid passages and hoses, the hydraulic motor, the gears given rotational energy by the hydraulic motor, the shaft, and all the associated connections between these components are a means of conveying rotational energy to the tool carrier assembly, thereby allowing it to rotate about the somewhat vertical axis.

The valves may also direct the flow of fluid through the motor in a bypass route that is isolated from the rest of the pressurized system. This bypass position of the valves would result in the relatively free rotation of the shaft as set forth in the preferred embodiment. In the bypass mode of operation no rotational energy would be generated by the motor.

By selectively opening or closing the appropriate valves within the valve assembly, fluid can be prevented from flowing through the motor and cause a braking effect, a means of resisting the rotation of the shaft and tool carrier assembly. In this mode of operation the tool carrier assembly would not be free to rotate around the vertical axis of the shaft.

Figure 11:
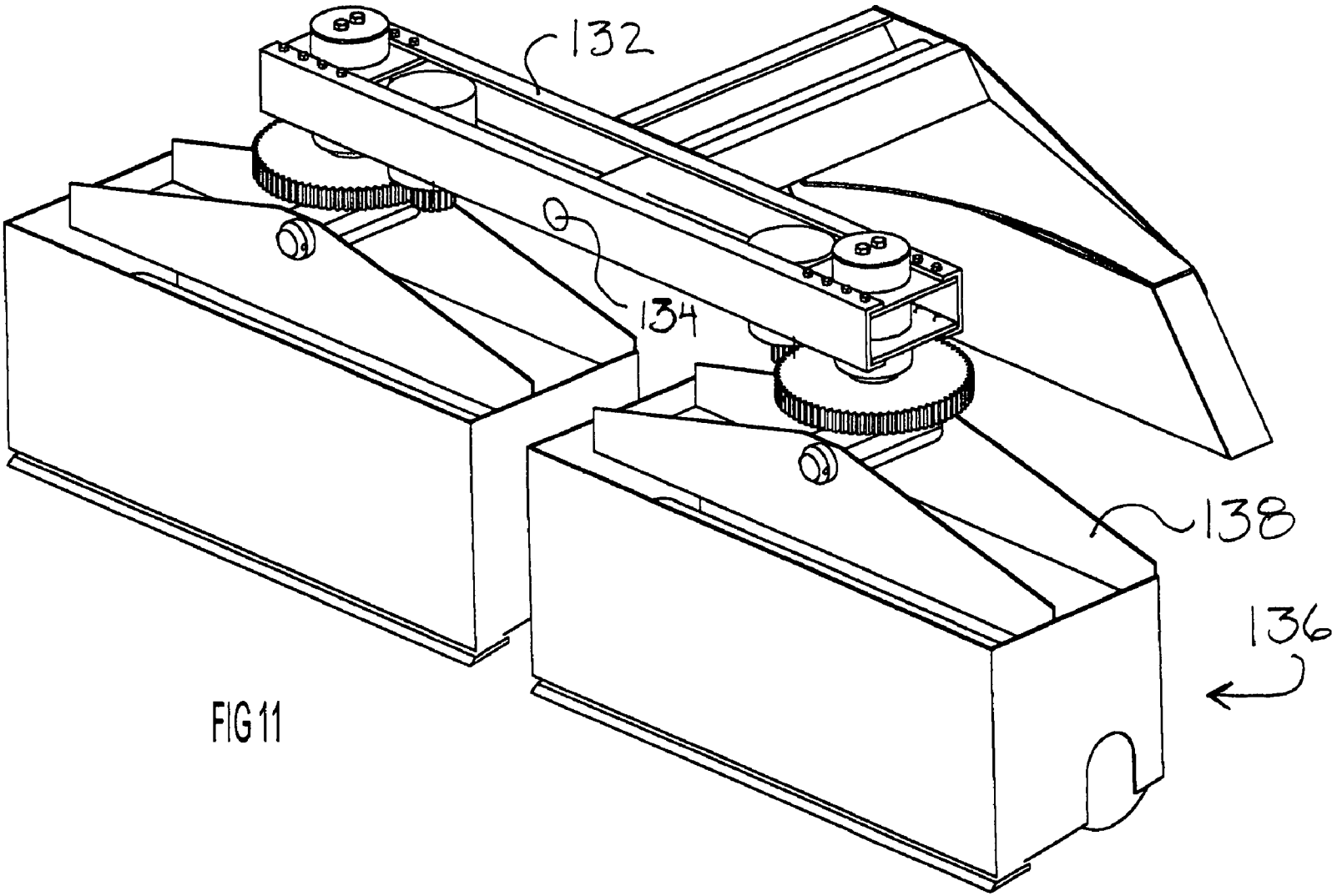
FIG. 11 is a perspective view of an alternative embodiment of FIGS. 1 and 2.

FIG. 11—Description of Multiple Tool Carrier Assemblies

The alternative embodiment comprising; the support structure of the preferred embodiment, an equalizer frame 132, an equalizer pin 134, a frame adapter, a single roller tool carrier assembly 136, rollers 100, eyebrow stops 99 and roller bearing carrier assemblies 102.

The equalizer frame is an elongated beam of identical cross section as the main body of the support frame. This allows housing 40 to be attached to it according to the invention. At the midpoint of the equalizer frame there are bushings that journal an equalizer pin. The equalizer pin is journalled transverse to the length of the equalizer frame. The equalizer pin is connected to a frame adapter which is connected to the distal end of the main body. The equalizer frame is connected to the flange of housing 40 by bolts.

The housing, shaft, motor, gears, rocking pins, eyebrow stops, roller bearing carrier assemblies and all of the connections between these components are the same as set forth in the preferred embodiment. The hydraulic hoses from the skidsteer are both connected to a tee fitting to supply the fluid power for the motors.

Figure 12:
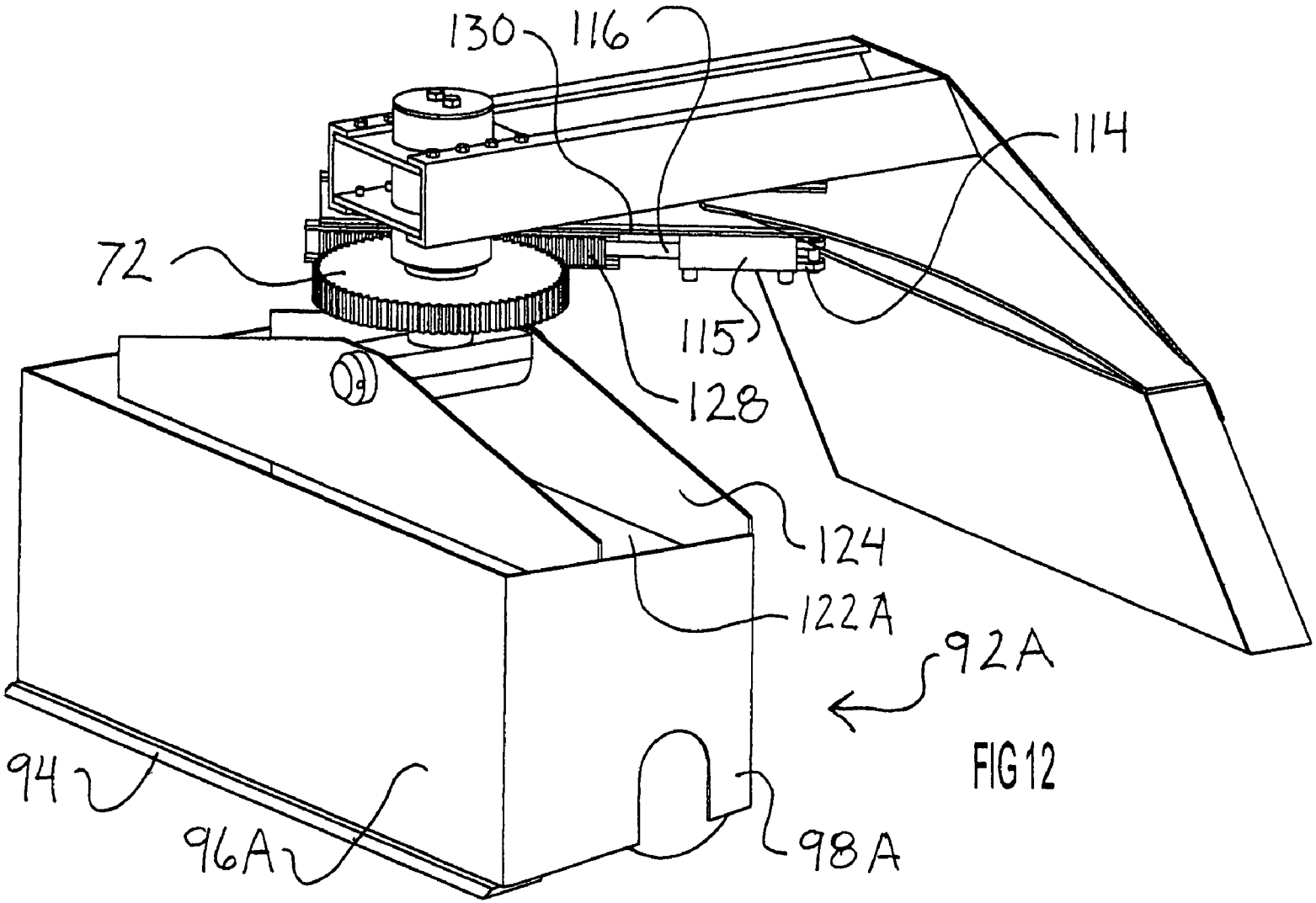
FIG. 12 is a perspective view of an alternative embodiment of FIGS. 1 and 2.

The single roller tool carrier assembly is like the tool carrier of FIG. 12 with one exception. The single roller carrier is half the width of the basic tool carrier assembly. There is no mid-plate on the single roller carrier, only two end plates. A half size mounting plate 138 of the single roller tool carrier is half the length of the basic tool carrier assembly. The connections between the half size mounting plate and the single roller carrier are the same as are the connections to the rocking pin, according to the invention.

FIG. 11—Operation of Multiple Tool Carrier Assemblies

The support frame functions as in the preferred embodiment. Equalizer frame 132 pivots on a horizontal axis that is parallel to, and centered between, the beams that extend outward to the distal end of the support structure. The equalizer pin is journalled at the midpoint, of the equalizer frame. The frame adapter pivotally attaches equalizer pin 134 to the support structure. The flanges attached to the housing connect to the ends of the equalizer frame. The housing journals the shaft. The half size mounting plates function the same as the mounting plates.

The equalizer frame pivots in response uneven terrain or the rocking motion of the motive source as it traverses bumpy surfaces.

The single roller tool carrier assemblies function the same as the basic tool carrier assembly in FIG. 12. The single roller carriers may be pivoted around a vertical axis by the selective engagement of the auxiliary hydraulic control. The fluid travels through the hoses from the skidsteer.

The housing, motors, gears, rocking pins, eyebrow stops, roller bearing carrier assemblies and all the connections between them function the same way as set forth in the preferred embodiment.

FIG. 12—Description of Rack and Gear

An alternative means of conveying rotational energy to dry shaft 80 is set forth in this embodiment of the invention. A rack gear 128 is a linear bar with gear teeth on one side. The opposite side of the rack gear is wider than the width of the teeth on the opposite side. The rack is of sufficient length to allow the teeth to interface with primary gear 72. One end of the rack is integrally connected to the end of ram rod 116. The rack is a linear extension of the ram rod. The rack and the ram are retained in a slide channel 130. The slide channel has a "C" shaped cross section. The slide channel is pivotally attached to the main body of the support frame at the midpoint of the slide channel. Ram base 114 is attached to the proximal end of the slide channel. The distal end of the slide channel is pivotally connected to a cam lock mechanism. The cam lock mechanism is attached to the distal end of the support frame. The cam lock mechanism is pivotally connected to a rod that extends to the proximal end of the support frame. Pressure hose 44R is connected to one of the fluid ports on ram 115. Pressure hose 44P is connected to the other fluid port on the ram.

FIG. 12—Operation of Rack and Gear

This alternative embodiment of the invention provides for a means of imparting rotational energy to the tool carrier assembly through dry shaft 80 through primary gear 72. The primary gear is given the rotational energy by engagement and movement of rack gear 128. The rack gear is moved by the action of ram rod 116 as it is extended or retracted by ram 115. The rack gear and the ram are retained by slide channel 130. The ram rod is powered by the flow of hydraulic fluid from the skidsteer through pressure hose 44P and pressure hose 44R. The flow is controlled by the auxiliary hydraulic control of the skidsteer. The flow may be reversed by the selective control or the flow may be stopped as a means to effectively stop the rotation of the dry shaft and the interconnected parts, including the tool carrier assembly. The tool carrier assembly according to the invention will rotate around the vertical axis of the dry shaft in response to the auxiliary hydraulic control of the skidsteer. A separate set of valves in the control valve assembly may be positioned so that the ram is locked into position by preventing the flow of hydraulic fluid to the ram.

The slide channel can be pulled away from the primary gear so that the rack gear disengages from the primary gear. This disengagement allows the dry shaft to rotate freely about the vertical axis of the dry shaft in response to the motion of the skidsteer. The disengagement is caused by the action of a cam as it rotates around an axis at its point of attachment to the distal end of the support frame. The sliding channel is pivotally attached to the cam lock mechanism and as the cam is rotated the sliding channel pulls away from the primary gear. The cam is rotated by a rod that is pivotally connected to it and is manually pushed in or pulled out by the operator of the skidsteer as a means to engage or disengage the transmission of rotational energy translated to the tool carrier assembly. The slide channel is pivotally connected to the support structure near its midpoint allowing the movement of the cam at its distal end to pull it away from the primary gear.

FIG. 12—Description of Basic Tool Carrier Assembly

Figure 14:
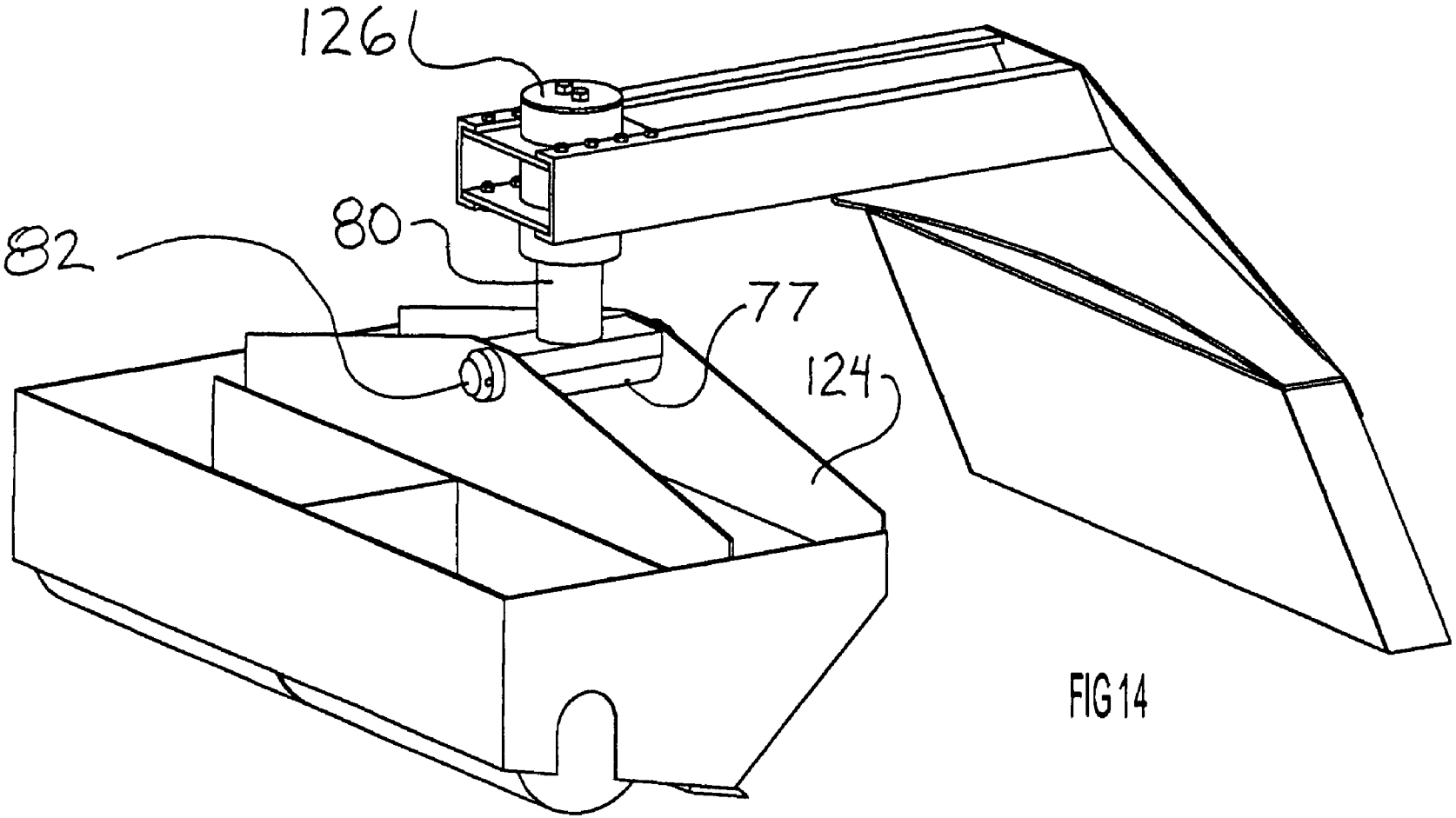
FIG. 14 is a perspective view of an alternative embodiment of FIGS. 1 and 2.

In this alternative embodiment a tee bar 77 is connected to a tool carrier assembly 92A in the same manner as set forth in FIG. 14—description of simple adjustment tool carrier.

In FIG. 12 the tool carrier assembly is comprised of cutting edge 94, eyebrow stop 99, roller bearing carrier assembly 102, rollers 100, and cross members of the preferred embodiment.

The elements of the alternative embodiment of basic tool carrier assembly 92A that are different than that of the preferred embodiment comprising; a vertically oriented scraper blade 96A, an end plate 98A, a second end plate 98A, an alternate mid-plate, a back plate 122A, and alternate cross members.

The scraper blade is an elongated vertically disposed surface whose bottom margin is attached to cutting edge 94. The cutting edge and scraper blade are integrally attached to one another and also to the leading edge of end plates 98A.

The point of attachment of the end plates and the cutting edge is at the bottom edge of the end plate at a height level with a point between the bottom of the rollers and the center of the axles. The end plates lie within a vertical plane that is perpendicular to the vertical plane of the scraper blade. The end plates are integrally attached to mounting plate 124. The end plates are integrally attached to back plate 122A along the trailing vertical edge of the end plate.

The alternate mid-plate lies on a vertical plane that is parallel with the end plates and is integrally attached to the scraper blade at its leading vertical edge. The intersection of the vertical plane of the scraper blade and the vertical plane of the mid-plate is the point of attachment of these two components of basic tool carrier assembly 92A. The mid-plate is integrally attached to the back plate at the intersection of the two components at the intersection of their respective planes.

FIG. 12—Operation of Basic Tool Carrier Assembly

This alternative embodiment is connected to the tee bar. The tee bar pivots on mounting plate 124. The cutting edge, the eyebrow stop, the roller bearing carrier assembly, rollers and cross members function according to the preferred embodiment.

The rigid box-like structure of basic tool carrier assembly 92A is created by the end plates, mid-plate, back plate and cross members functioning together to hold the cutting edge and scraper blade in a fixed relationship with the axis of the rollers. The height of the cutting edge from the surface being worked is determined by the tilt of the tilt mechanism of the skidsteer and the height of the lift arm assembly.

In FIG. 12 the basic tool carrier assembly is oriented so as to push soil ahead of the scraper blade as the skidsteer moves in a forward direction. In this mode of operation the cutting edge would be lowered as the tilt mechanism is rotated in a top forward motion. The forward tilting of the tilt mechanism is translated through the support frame and causes the shaft to tilt forward. This tilt forward in the push mode causes the cutting edge to rotate forward around the axis of the rollers and to cut deeper into the surface being worked. A the grader rides on the rollers the depth of the cut of the cutting edge is controlled. This tilting action also causes the front wheels of the skidsteer to rise. If the lift arms of the skidsteer are raised, the front wheels of the skidsteer will be lowered to any desired height off the surface being worked. If the lift arms are raised past the point of front wheel contact with the surface being worked, the grader will be disengaged from the surface being worked.

The tool carrier can be rotated to operate in a pull mode with the skidsteer moving in a reverse direction. In this mode of operation a forward tilt of the tilt mechanism causes the opposite effect on the cutting edge. The tilting of the mechanism in either direction has a direct effect on the height of the cutting edge off the surface being worked.

The height of the cutting edge during cyclonic motion of the skidsteer will return to level as the orientation of the axis of the rocking pin nears the horizontal position.

FIG. 13—Description of Pulley Mounted Axle

In this embodiment a depth guide axis retainer assembly 123 is shown as a pivotable means of connecting the roller to the tool carrier assembly. The depth guide axis is defined by the interior structure or disk that forms the inner portion of the roller and is held in a fixed concentric relation to the roller and the ground contact surface of the roller. The axle is aligned on the depth guide axis of this embodiment and may be a part of or fit rotateably into the interior structure of the depth guide. The rotateable wheel attachment of the caster wheel would be an alternative type of depth guide axis retainer assembly that holds an alternative depth guide axis in a fixed relation to a tool carrier assembly. The end plates and mid-plate as set forth in the preferred embodiment are integrally attached to an inner mount 146 of this alternative embodiment. The plates are integrally connected to the appropriate components of the tool carrier assembly of the preferred embodiment. An axle 104A of this alternative embodiment extends past the end of the ground contact surface. A pulley bearing 142 is a tapered roller bearing that has an inner race that is shaped to fit the machined surface of the end of the axle. The outer circumference of the pulley bearing fits snugly into a pulley. The bearing is retained on the axle by a washer 144. The washer is held on the axle by axle bolt 145. The axle is integrally attached to the disks of the rollers. The remaining components as described in the preferred embodiment are the same as in this alternative embodiment.

The inner mount has a surface that is parallel to the end plates and the mid-plate and a thickness that matches the bottom of the groove of a pulley 140. The inner mount is essentially rectangular in shape with an A shaped cutout along the bottom edge with the open end of the A facing downward. The apex of the cutout is rounded and aligned on all of the plates The inner mount is integrally connected to the plates at the forward and aft edges of the inner mount by rectangular strips that are integrally connected to both the inner mount and the plates. The rigid rectangular strips space the inner mount a distance from the plates that allows the rollers to fit between the inner mounts of the tool carrier assembly. The inner mount is also integrally attached to the end plate by a horizontal rod that supports a locking arm 148.

Locking arm 148 has a surface that matches the bottom of the groove of the pulley. At the opposite end of the locking arm from the rod that integrally connects the inner mounting plate to the end plate or mid-plate, there is an upward facing pivot able connection point. A hook 150 is attached at this second pivot able point.

The hook has an eye on the lower end and an elongated dowel that extends upward and terminates at an end that is threaded.

A block 158 has a hole in it that is threaded to match the threads on the upper end of the dowel. The block has a second hole that is perpendicular to the first hole in the block. The first hole is somewhat vertical and the second somewhat horizontal, and the diameter of both holes are the same. A lever pin 154 is a circular rod that has a diameter that equals the diameter of the holes in the lever.

The lever pin has a length that equals the distance between the inner mount and the end plate, plus the thickness of the inner mount and the thickness of the end plate. A snap ring 156 is locked into grooves on the lever pins. The outer edge of the grooves are a distance from the ends of the pins that matches the thickness of the end plate and inner mount.

A lever 152 is a plate in the shape of an L. There are two holes in the bottom of the L. Lever pin 154 has a diameter that matches that of the holes in the lever. The holes are aligned on a line that angles upward from a point near the lower left hand outside angle of the L shape. The left side hole is closer to the bottom of the L than the hole on the right side.

Block 158 has a width that is less than the distance between the inner mount and the end plate minus the thickness of, two levers and two snap rings. A block pin 160 is shorter than the lever pin by a distance that equals the thickness of the end plate and the inner mount. The block is pivotally held in place between two levers by the block pin which fits into the holes in the levers that are closest to the bottom margin of the base of the L. The snap rings fit into grooves between the block and the inner surfaces of the levers. The block pins are flush with the outside of the levers.

FIG. 13—Operation of Pulley Mounted Axle

The pulley fits into the cutout in the inner mount. As the tool carrier is lowered onto the roller the edges of the inner mounts seat into the center groove of the pulleys. The pulley is locked into place by the locking arm. After the pulleys are seated into the mounts the locking arm is hung on to the horizontal rod that is integrally attached to both the mount and the plate. A surface on the locking arm seats into the groove in the pulley. The locking arm is forced upward into the groove of the pulley with such force as necessary to hold the roller into place. The end of the locking arm that is opposite the one cradled by the horizontal rod has a surface to cradle the hook on it. The hook is oriented so that the eye on the bottom of the hook pulls upward on the locking arm as it is pulled upward by the levers. The threaded end of the hook is threaded into the block and adjusted to the proper length so that the lever can be rotated and the lever is locked into place.

The block keeps the levers separated so that the hook can contact the lever pin as it is locked into position. The block pin is secured to the block by the two snap rings that are installed between the levers and the block. The snap rings prevent the pin from sliding from side to side. The lever pin allows the levers to rotate to lock or unlock the locking arm into the groove of the pulley.

The pulley bearing allows the pulley to rotate on the axle in either direction. A shoulder on the axle keeps the bearing in place and prevents side shifting of the axle. The washer and bolt keep the pulley on the axle. The pulley mounting system is a means of removably attaching the rollers to the tool carrier assembly.

The roller functions the same in this alternative as it does in the preferred embodiment.

FIG. 14—Description of Simple Adjustment Tool Carrier

An alternative embodiment comprising; the motive source, support frame, housing, and all the connections between them as set forth in the preferred embodiment of the invention and is further comprised of the following.

The tool carrier assembly of this embodiment of the invention has a mounting plate 124 on a vertical plane, which is integrally attached to the end plates of the tool carrier assembly. The plane is parallel with the cutting edge. There is a second mounting plate integrally attached to the end plates in a second vertical plane which is parallel to the plane of the other mounting plate. The two mounting plates are separated by a distance that is equal to the length of the tee bar which is integrally connected to a dry shaft 80.

Figure 8:
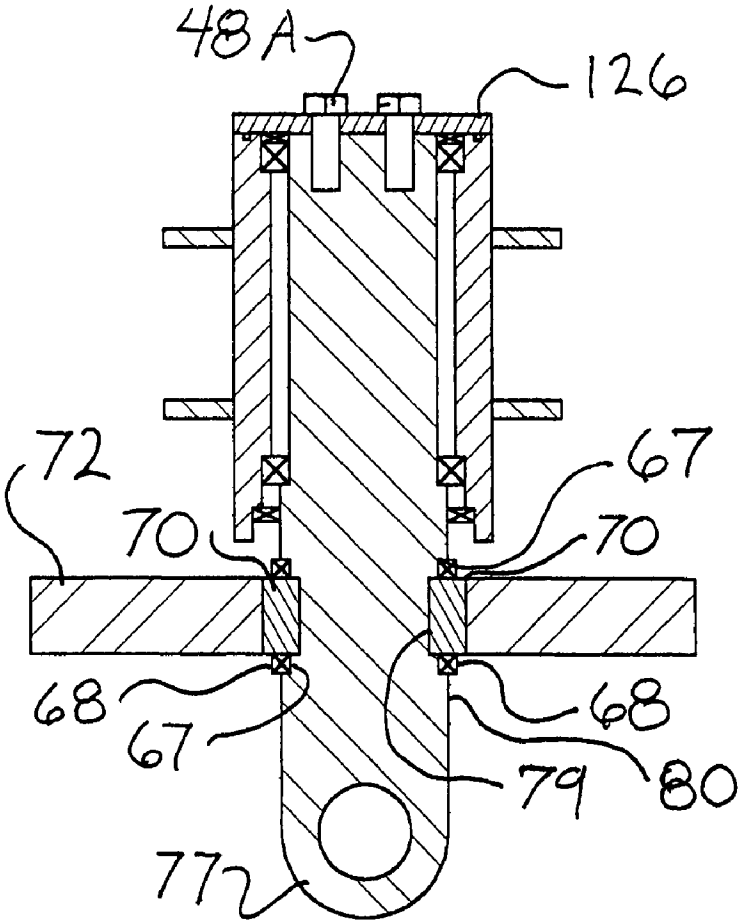
FIG. 8 is a view in detail of the portion indicated by section line 8-8 in FIG. 7.
Figure 7:
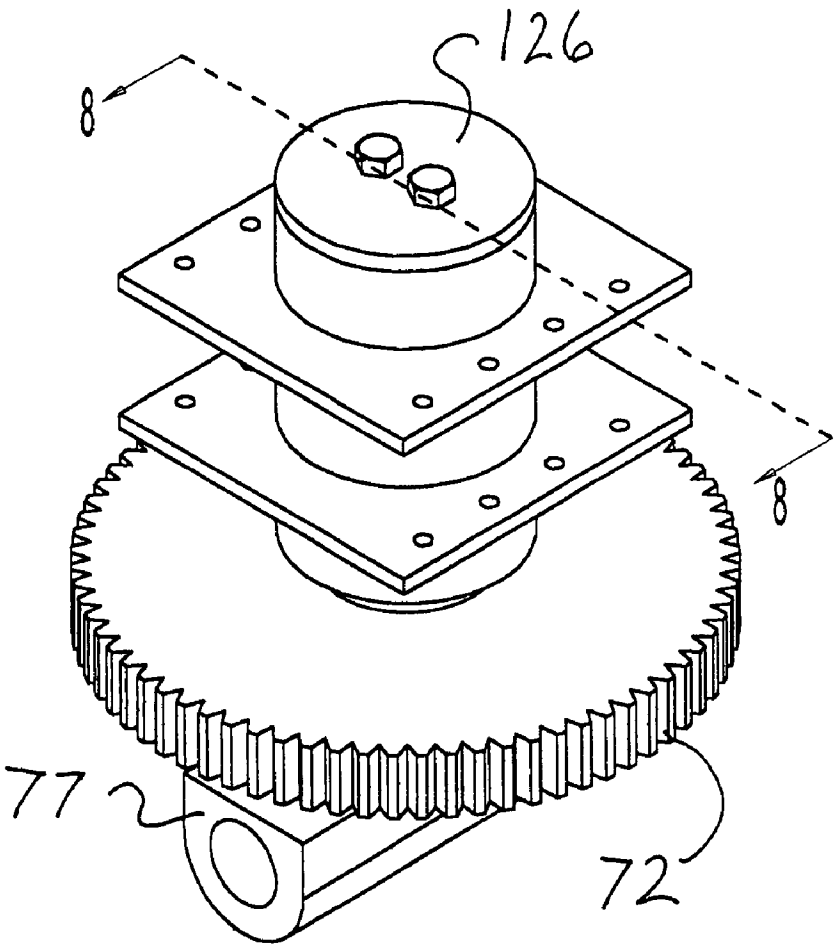
FIG. 7 is a perspective view of an alternative embodiment of FIG. 4.

The dry shaft is identical to power shaft 78 in its exterior dimensions. A dry shaft cap 126 is cylindrical shaped with a top surface that is perpendicular to the sides of the cylinder. The diameter of the dry shaft cap is the same as the diameter of the housing. Oil seal 53 is seated between the top of housing 40 and the bottom of the dry shaft cap. A female mating surface is formed on the bottom of the dry shaft cap. The two holes that are vertical through the dry shaft cap are aligned on a vertical axis that bisects the center of the dry shaft cap. Dry shaft cap 126 is secured to the dry shaft by bolts 46. The bolts extend downward into threaded holes in the dry shaft. FIGS. 7 and 8 show the dry shaft in detail with the primary gear on the shaft. In this alternative embodiment the gear may be on the shaft or it may be absent.

Rocking pin 82 connects the tee bar to the mounting plates. The rocking pin is journalled by bushings that are integrally attached to the mounting plates at the center of the mounting plates. The rocking pin is retained in place by retainer bolt 84.

FIG. 14—Operation of Simple Adjustment Tool Carrier

The motive source, support frame, housing, and all the connections between them as set forth in the preferred embodiment function the same in this alternative embodiment as they do in the preferred embodiment. The bearing assemblies, oil seals, and shim function the same in the alternative embodiment set forth here as the do in the preferred embodiment. Dry shaft 80 is rotatable on a vertical axis as set forth in the preferred embodiment for the function of shaft 76.

Dry shaft cap 126 functions to retain the dry shaft in the housing. Bolts 46 secure the dry shaft cap to the dry shaft. The dry shaft is integrally connected to the tee bar as set forth in the preferred embodiment of the invention. Tee bar 77 and rocking pin 82 are connected to mounting plate 124, allowing the tee bar to pivot around an axis that is centered on the rocking pin. The pair of mounting plates have bushings integrally attached to them to journal the rocking pin. The tool carrier assembly of this embodiment casters in response to the movement of the motive source as set forth in the preferred embodiment. The tool carrier assembly of this alternative embodiment has all of the components set forth in the preferred embodiment. The tool carrier assembly is connected to the rocking pin in such a way that the mounting plates do not move in relation to the tool carrier assembly. The height of the cutting edge of this alternative embodiment is controlled by tilt mechanism 26 of the motive source and by raising or lowering lift arm assembly 22.

The motive source is able to lift the front wheels of the skidsteer off the surface being worked to enable turning without a disengagement of the tool carrier assembly from the surface being worked. Cyclonic and anti-cyclonic motion of the motive source is caused by the selective control of the left side wheels of the skidsteer in one direction and the right side wheels in the opposite direction. The opposing directional forces of the wheels of the skidsteer are a means to allow a short turning radius to be used in the performance of the work upon demand.

FIGS. 15, 16, 17, 20, 21

Description of the Hydraulic Excavator Embodiment

Figure 15:
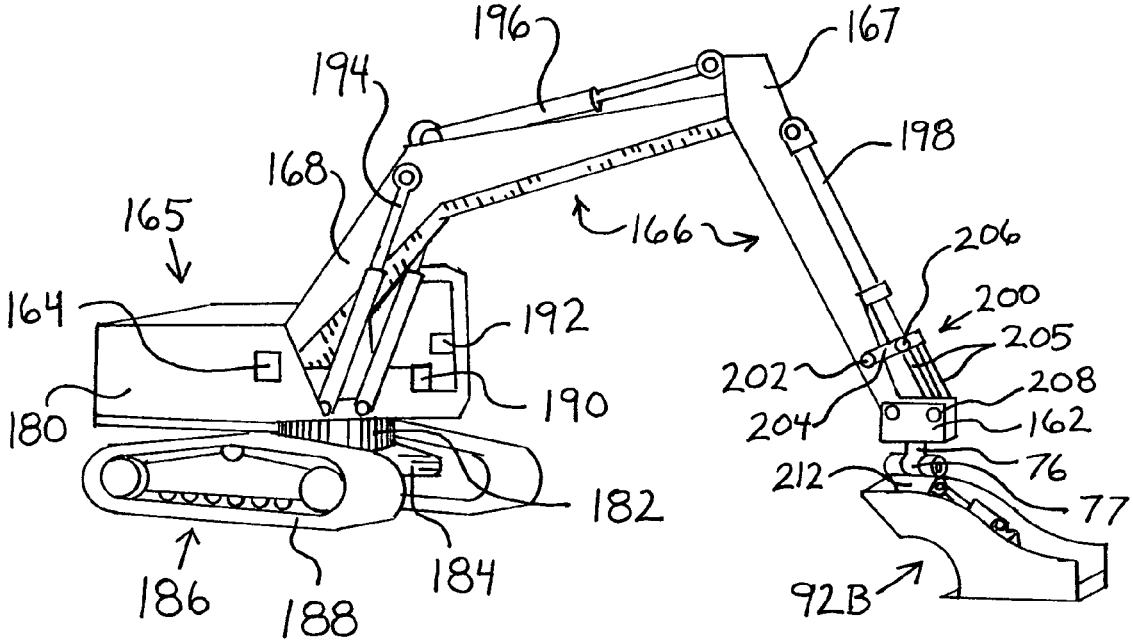
FIG. 15 is a perspective view of the hydraulic excavator embodiment attached to a hydraulic excavator as a motive source.
Figure 16:
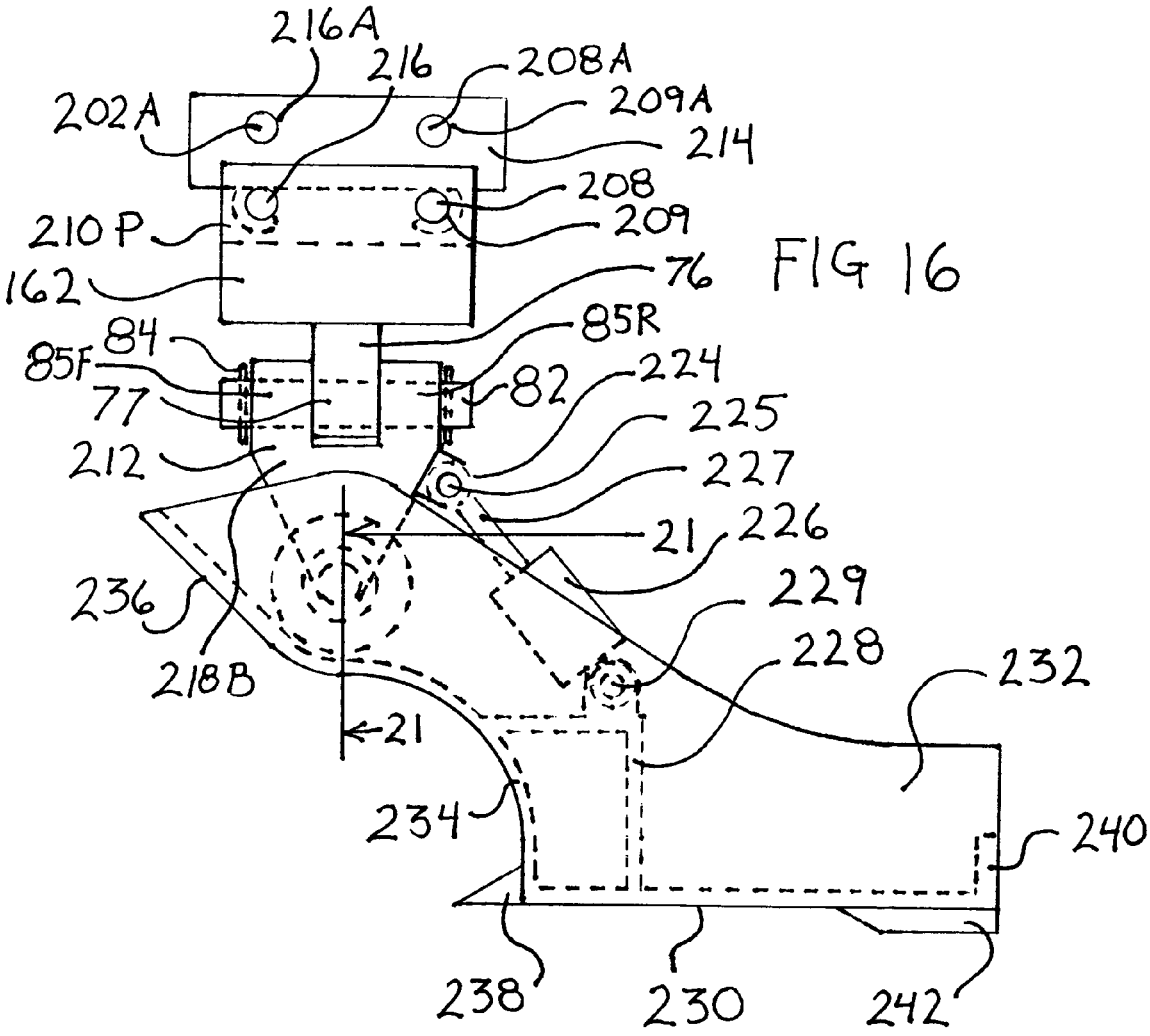
FIG. 16 is a side elevation view of the hydraulic excavator embodiment.

A tool carrier assembly 92 B of this embodiment in FIG. 15 has a somewhat navicular shape that has inboard surfaces and outboard surfaces. A different means of connection to a hydraulic excavator 165 motive source is employed for this embodiment than the skidsteer attached embodiment. In this embodiment there is no support frame between the means of connection to the motive source and the means of journalling the shaft. A journal structure 162 is pivotably connected to the motive source, and is the means of journalling shaft 76. The hydraulic excavator itself is not the subject of this application. The hydraulic excavator, sometimes referred to as a trackhoe, is well known in the art and has a two part lift arm assembly 166, that allows the motive source to be connected directly to the means of journalling the shaft of this embodiment without the need for the support frame of the skidsteer embodiment. In FIG. 16 of this embodiment the use of a universal quick-change adapter 214, which is well known in the art and not the subject of this application, could be employed as an interface between the means of journalling the shaft and the distal end of the lift arm assembly of the excavator.

In FIG. 16 the universal quick change adapter has a hooking mechanism for attaching to a jib pin 202 and an attitude control pin 208. For connecting the adapter plate to the jib and a tool ram connector assembly 200, or a tilting mechanism, a second jib pin 202 A and a second attitude control pin 206 A are used in a jib pin hole 216 A and an attitude control pin hole 218 A.

Figure 17:
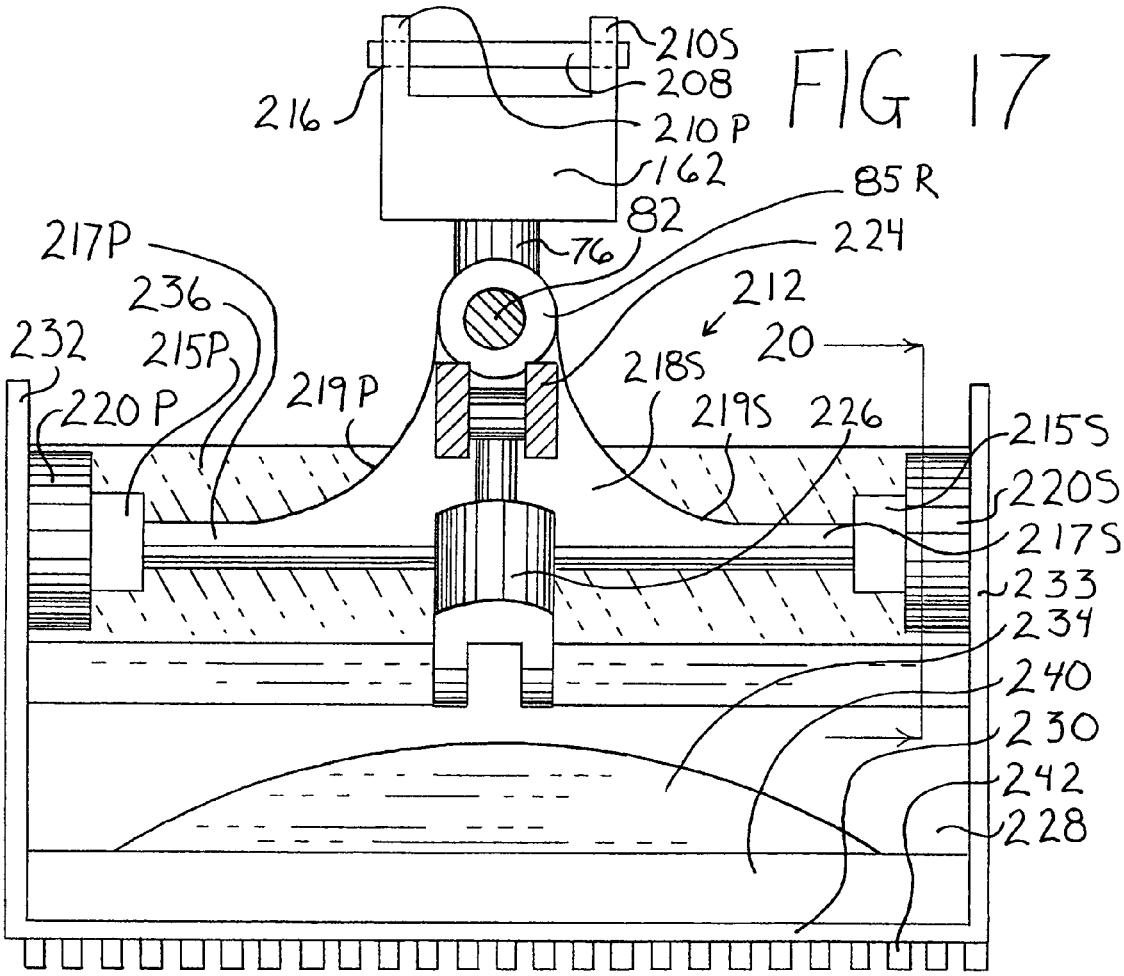
FIG. 17 is a rear elevation view of the hydraulic excavator embodiment.
Figure 18:
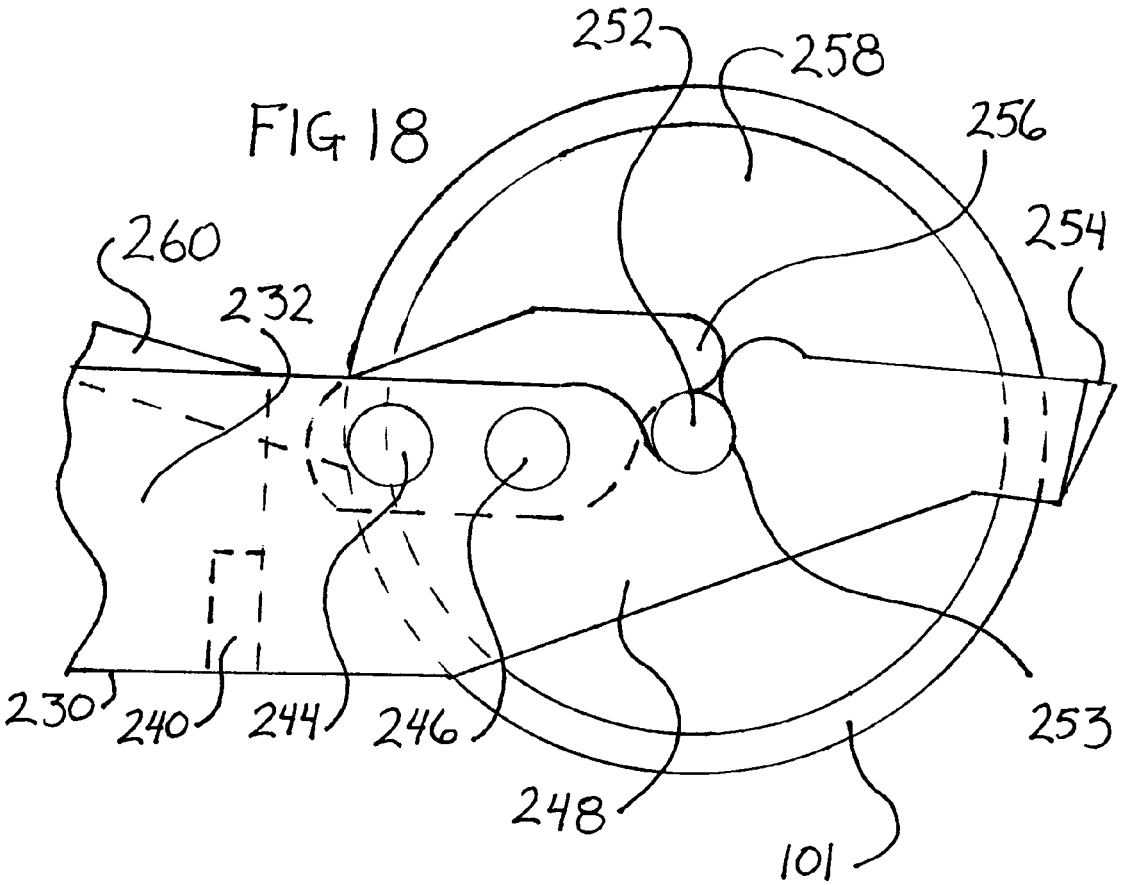
FIG. 18 is a side elevation view of an alternative embodiment.

The journal structure depicted in the elevation view from the stern in FIG. 17 shows a journal structure mounting plate 210 S on the starboard side and a journal structure mounting plate 210 P on the port side of the upper portion of the journal structure extending upwardly and lying parallel to one another.

The two part lift arm assembly of the hydraulic excavator motive source in FIG. 15 includes a jib 166, and a boom 168. The two part lift arm assembly extends outwardly from the excavator. The jib and the boom are pivotably connected at the distal end of the boom and the proximal end of the jib. The proximal end of the boom 168 is pivotably attached to a turret 180 or chassis. A boom ram 194 is pivotably connected to the boom at its upper end, and pivotably connected to the chassis or turret 180 at it's lower end. The excavator depicted in FIG. 15 has a pair of the boom rams. Boom 168 is rigidly retained in a controllably pivotable relation to the chassis. The boom rams allow the boom or lift arm assembly to pivot controllably and move on a plane around a variable horizontal lifting axis. The boom rams 104 may be shortened or lengthened to urge the distal end of the boom to move up or down on the variable vertical plane that is somewhat perpendicular to the variable horizontal lifting plane, by pivoting the proximal end of the boom about a pivotable connection point on the chassis or turret 180. The lift arm assembly of the excavator is also pivotable about a vertical axis. The turret is pivotably attached to an undercarriage 184, by a slewing mechanism 182. The undercarriage has a ground engaging means, the surface contact propulsion assembly 21 that includes a track assembly 188.

The turret of the excavator in FIG. 15 houses the operator, who from there has access to a means of selectively directing the flow of pressurized hydraulic fluid 190, and a means of selectively relieving hydraulic fluid pressure in desired fluid channels 164. The hydraulic components of the shaft would be housed within the journal box and the hydraulic supply lines for both the pressure side and the return flow side of the hydraulic system would be removably attached to the journal box as would be readily apparent to one skilled in the art. The operator also has access to a means of selectively directing the flow of electrical energy 192.

A jib ram 196 is pivotably attached to the upper midpoint of the boom at it's proximal end. The distal end of the jib ram is pivotably attached to the jib at the proximal end of the jib. A tool ram 198 is pivotably connected to the jib at it's proximal end, and pivotably connected to the tool ram connector assembly 200. The tool ram connector assembly consists of three pivotable axes, held in a sequential arrangement in relation to one another. The first sequential axis is held in a fixed relation with the distal end of the jib by a jib pin 202. The second sequential axis is held at a fixed distance from the first sequential axis by a first brace of members 204. The second sequential axis is held at a fixed distance from the first sequential axis by a tool ram connector assembly pin 206, which is journalled by the ends of the first brace of members. The tool ram connector assembly pin is also journalled by and fixes a second brace of members 205, and holds the second sequential axis at a fixed distance from a third sequential axis of the tool ram connector assembly. The third sequential axis of the tool ram connector assembly is pivotably connected to journal structure 162 by attitude control pin 208. The attitude control pin is journalled by a set of holes in the upper stern portion of an upward extension of the journal structure. which are centered on the third sequential axis of the tool ram connector assembly when this embodiment of the journal structure is pivotably connected to the excavator depicted in FIG. 15. The jib pin is centered on the first sequential axis of the tool ram connector assembly and the center of the holes on the upper fore section of the upward extension of the journal structure.

The journal structure of this embodiment in FIG. 15 includes the seals, bearings, bearing surfaces and hydraulic components of the skidsteer embodiment that interface with the shaft and align it within the journal structure on the somewhat vertical controllably variable vertical axis 13. Axis 13 lies at the center of the radius of the shaft and is adjustable with regard to it's angle relative to the plane of the ground engaging portion of the tracks of the excavator. The axis of the shaft is non coplanar in relation to the axis that passes through the center of the radius of the jib pin. These two axes never intersect and their position relative to one another never changes. As the shaft axis is rotated about the jib pin axis the distance between the two nearest points on both axes remains the same. The shaft 76 rotates about axis 76 that lies on the variable vertical plane that bisects the lift arm assembly shared by the two part lift arm assembly of the hydraulic excavator.

The tee bar is rigidly connected to the shaft as in the previous embodiments. The tee bar has an inner surface that forms an inner cylindrical opening and an outer surface that is attached to the shaft on it's upwardly disposed rectangular surface. The downwardly disposed outer surface is somewhat "U" shaped in it's cross section. The center of the radius of the circumference of the inner surface of the tee bar is aligned on a somewhat horizontal first axis of this embodiment. The inner surface of the tee bar is a means of bearing a radial load. The tee bar has a predetermined length some distance along the first axis and terminates at two opposite ends whose surfaces lie on two distinct parallel planes that are both perpendicular to the first axis. The tee bar ends are capable of bearing an axial load along the first axis. The tee bar is sandwiched by and separates two sleeves that abut both ends of the tee bar.

The first sleeve is attached at a predetermined distance from the second sleeve. The sleeves are formed of a rigid material, cylindrical in shape, of a predetermined thickness and a predetermined length, and have an inner cylindrical surface and an outer surface. The center of the radius of the circumference of the inner surface of the sleeves forms an axis that is congruent with the somewhat horizontal first axis of this embodiment. The ends of the opposed sleeves that are nearest the other sleeve and abut the tee bar have surfaces that are parallel to each other and to the adjacent surfaces of the tee bar. The two distinct planes on which the opposed sleeve end surfaces lie are parallel. Both of the parallel sleeve ends are perpendicular to the somewhat horizontal first axis of this embodiment.

The rocking pin in FIGS. 16 and 17 is journalled by the tee bar and the sleeves. Midpoint sleeves 85 F and 85 R are attached to the upper edge of a mast 212. The mast is pivotably connected at the mid point of it's upper edge to the tee-bar by the rocking pin. The rocking pin is an elongated cylinder and has an outer circumference. The rocking pin has a predetermined length that extends beyond the distal ends of the sleeves. The ends of the rocking pin have holes of a predetermined diameter extending through a diameter of the rocking pin. The rocking pin holes are in the portion of the rocking pin that extends beyond the sleeves. A bolt, clip or pin extends through the rocking pin holes. The line at the center of the radius of the circumference of the outer diameter of the rocking pin is aligned on the first axis of this embodiment. The first axis is perpendicular to the somewhat vertical axis that the center of the circumference of the outer diameter of the shaft is aligned on.

A central structure of the mast has the general shape of a regular tetrahedron with four faces that are approximately equal triangular shapes whose edges are integrally attached. This somewhat tetrahedron-like structure, composed of a rigid material, resembles a three sided pyramid that is tilted and is hypothetically balanced and is resting on one of it's edges. The line between the two vertices on which it is balanced form a base edge. The base edge is integrally attached to a rigid cylindrically shaped elongate spar structure that extends the line of the base edge laterally beyond the polyhedron vertices. These extensions of the base edge margins of the tetrahedron are extended in opposite directions to be pivotably attached to the tool carrier assembly at right angles. These extensions of the base edge are individually referred to as a gudgeon 216.

First gudgeon 216 P extends a predetermined distance from the central structure, and terminates at a point at a predetermined distance from a port side plate 232. The second gudgeon 216 S extends a predetermined distance from the central structure, and terminates at a point a predetermined distance from a starboard side plate 233. The gudgeons are an elongated cylindrical shape and have an outer surface. The circumference of the surface of the gudgeons has a radius, and the center of that radius forms a somewhat horizontal second axis of this embodiment. Both gudgeons are centered on the somewhat horizontal second axis that is non coplanar in relation to the somewhat horizontal first axis.

The mast central structure includes a mast stern plate 218 S, and a mast bow plate 218 B, which share a common edge that is integrally joined to the spar at the base edge. The central structure also includes a mast port plate 219 P and a mast starboard plate 219 S, whose common edge is integrally attached to the midpoint sleeves and forms the top edge of the mast. The first axis is parallel to and somewhat near the upper edge of the regular tetrahedron, while the somewhat tetrahedron like central structure is balanced on it's base edge. The central structure of the mast holds the two non coplanar axes at it's upper and lower edges, a predetermined distance from one another, in a fixed position relative to one another. The four plates of the central structure form a rigid structure. The middle of the base edge of the tetrahedron is somewhat centered between the port and starboard plates.

The mast in FIG. 17 is removably attached in a pivotable way at multiple points to the tool carrier assembly. The mast relates to the tool carrier assembly in the same way, with regard to the number of pivotable attachment points, as does the adjustable frame in the skidsteer embodiments. The gudgeons that form the extensions of the spar are the pivotable interconnections of the axis that lies somewhat congruent with the lower edge of the mast. The gudgeons have an outer surface that can bear a radial load.

A mast gland 214 P on the port side gudgeon and a mast gland 214 S on the starboard side gudgeon removably attach the gudgeons to the inboard surface of the tool carrier assembly. The glands are essentially cylindrical on their outer margin and also on their inner margin. The inner cylindrical surface of the glands has a radius, the center of which lies on the somewhat horizontal axis that it has in common with the gudgeons. The outer diameter of the gudgeons is sized to fit within the inner cylindrical opening of the mast glands. The glands are slidably attached to the gudgeons. A grease fitting and grease passage in the gland form a channel for grease to pass through the gland to the mating surfaces of the glands and gudgeons. The outer diameter of the mast gland is sized to mate with the female mating surface that is attached to the tool carrier assembly. A mast gland half round annular groove 213 circumnavigates the outer diameter of the mast gland. The center of the radius of the groove is a circle that lies on the cylinder of the majority of the outer surface of the gland, and on a plane that is parallel to the side plate. The groove is a predetermined distance from the outboard end of the gland.

A gib 220 S and a gib 220 P are two of the removable attachment points held in a fixed position on the tool carrier assembly on which the mast is attached. A gib outboard surface 302 is attached to the inboard side of the tool carrier assembly by a gib bolt 304 that passes through a gib bolt hole 306. The gib bolt is threaded into a threaded gib bolt hole 308 in the gib. A plurality of gib bolts, gib bolt holes, and threaded gib bolt holes are aligned in a complementary fashion and a concentric pattern.

The gib has an inwardly disposed concentric surface and outwardly disposed concentric surfaces. The inwardly and outwardly disposed cylindrical surfaces of the gib have circumferences that are concentric with the gland and the gudgeon. The gib also has an outboard surface, an inboard surface and first, second and third interior inboard surfaces, which lie in parallel planes that are parallel to the port and starboard plates of the tool carrier assembly and the end of the gudgeon.

The inboard edge of an inwardly disposed concentric gib surface 288 terminates in the plane that defines an inboard gib surface 290, forming a round opening in the inboard side of the gib. The outboard edge of the cylinder of the inwardly disposed surface terminates at a predetermined distance from the side plate of the tool carrier assembly. That termination point of the inwardly disposed surface lies on a plane that forms a first interior inboard gib surface 292. A first outwardly disposed concentric gib surface 294 of the protrusion extends a predetermined distance from the first interior inboard surface at the same diameter as that of the gudgeon. At the point where the first outwardly disposed surface terminates on the inboard edge of the cylinder that forms the first outwardly disposed surface, lies a parallel plane that defines a second interior inboard gib surface 296. A second outwardly disposed gib surface 298 of the protrusion is formed when the diameter of the protrusion is then reduced to a predetermined circumference and the protrusion further extends in an inboard direction to a termination point a predetermined distance from the plane that defines the inboard surface of the gib. A third interior inboard gib surface 300 is the inboard termination point of the second outwardly disposed concentric surface of the protrusion. The third interior inboard surface lies on a plane that is parallel with the port side plate and is a predetermined distance from the inboard side of the gib. A third outwardly disposed concentric gib surface 310 is the outermost surface of the gib. The reduction of the diameter of the protrusion of the gland forms a male portion of the protrusion that mates with a thrust cap 276 having a corresponding female surface that is contiguous to the male part of the protrusion.

The thrust cap has inner and outer surfaces that are concentric with the concentric surfaces of the gib. It has a thrust cap concentric exterior surface 278 on an outer cylindrical surface that is the same diameter as the first outwardly disposed concentric surface of the protrusion of the gib. It has a thrust cap concentric interior surface 280 that is complementary and contiguous to the second outwardly disposed concentric surface of the protrusion. It has a thrust cap interior outboard surface 282 that is contiguous to and abuts the third interior inboard surface of the protrusion. It has a thrust cap exterior outboard surface 284 that abuts the second interior surface of the protrusion of the gib. A thrust cap inboard surface 286 lies on the same plane as the inboard surface of the gib. The distance between the thrust cap inboard surface and the thrust cap interior outboard surface is predetermined so that it interfaces between the end of the gudgeon and the third interior inboard surface of the protrusion.

A locking pin hole 231 extends through the gib parallel to the outboard side of the gib. The center of the radius of the circumference of the locking pin hole lies on an axis that is tangent to the inwardly disposed concentric surface of the gib. The axis of the locking pin hole intersects a point on the circumference of the inwardly disposed surface of the gib. Since the outer diameter of the gland is contiguous with the inwardly disposed surface that the axis of the locking pin hole is tangent with, the locking pin hole axis is also tangent to a point on the circumferential surface of the gland. The center of the radius of annular groove 213 that circumnavigates the outer surface of the gland has one point on the circle that it forms in common with the center of the radius of the locking pin hole. The radius of the locking pin hole and the radius of the half round annular groove are the same length.

A locking pin 222 of a diameter that is slightly less than that of the locking pin hole extends through the locking pin hole. A pin head 225 is at one end of the locking pin. The pin head is a larger diameter than a locking pin shaft 229 which makes up the portion of the locking pin that is inserted into the locking pin hole. A prolate end 221 of the opposite end of the locking pin from the pin head has a locking pin clip hole 227 through a diameter of the portion of the pin that extends through the gib. A locking pin clip 223 extends through the diameter of the locking pin.

A mast clevis 224 in FIGS. 16 and 17 pivotably connects a mast ram 226 to the mast just below midpoint sleeve 85 R. A mast ram rod 227 is pivotably held on the mast clevis by a mast clevis pin 225. At the opposite end of the mast ram at an arch support 228, The base of the mast ram is pivotably connected to the arch support by a mast ram base pin 229. The appropriate hydraulic hose connections from the shaft to the mast ram would be readily apparent to one skilled in the art. The arch support is a rigid structure of the tool carrier assembly that spans the beam of a keel 230, and is integrally attached to the side plates on the port and starboard. The arch support also extends forward to be integrally attached to the stern facing surface of a bow scraper blade 234, which has a bow facing outer concave surface and a stern facing inner surface having a convex shape. The bow scraper blade is integrally attached to the port and starboard plates and also to a bow plate 236, which is an upward extension of the bow scraper blade. The bow plate is also integrally attached to the port and starboard plates at its outer edges. A cutting edge 238 in FIG. 16 is shown attached to the lower margin of the bow scraper blade near the point of the attachment to the keel and the bow scraper blade.

The keel is the depth control device of this navicular embodiment. It is a flat plate that lies on a plane that is and remains parallel to the axis about which the gudgeons rotate as they are journalled by the glands as the glands are in turn mated with the gland plates. The plane on which the keel lies remains perpendicular to the planes of the port and starboard plates, and the keel is integrally attached to the plates at the intersection of the perpendicular planes.

A cultivator tool 242, is shown in FIG. 16 attached to the keel near a stern plate 240. The stern plate is a rigid structural member that is integrally attached to the stern edges of the port and starboard plates, and is also integrally attached near the stern edge of the keel and extends upward. In FIG. 17 an evenly spaced arrangement of a plurality of cultivator tools are attached to the bottom of the keel.

FIGS. 15, 16, 17, 20, 21

Operation of the Hydraulic Excavator Embodiment

The operator of the hydraulic excavator of this embodiment in FIG. 15, a construction machine well known in the art and not by itself the subject of this application, is able to move the tool carrier assembly about the surface being worked at a much more variable distance from the ground engaging part of the motive source than would be possible with the previously set forth skidsteer embodiments. This ability allows the operator of the excavator to position the tracks on a safe slope while manipulating the two part lift arm assembly to engage the tool carrier assembly to work on a more dangerous to navigate and steeply sloped area of the work site.

The operator of the excavator of FIG. 15 may employ a means of selectively directing the flow of pressurized hydraulic fluid to urge the boom 168 to rotate about two different axes, one horizontal and the other vertical. The boom rams 104 may be shortened or lengthened to urge the distal end of the boom to move up or down, by pivoting the proximal end of the boom about a pivotable connection point on the chassis or turret 180. The boom is also selectively pivotable about the axis about which the turret is rotateable, as it is urged to move about the vertical axis concomitant the turret. The operator of the excavator may also selectively urge the distal end of the jib to rotate about an arc whose center is at the pivotable connection point of the distal end of the boom and the proximal end of the jib by selectively lengthening or shortening the jib ram. In this embodiment the operator could also selectively relieve the hydraulic pressure in desired fluid channels and allow the boom or jib to float as the turret is controllably moved in a slewing motion without moving the undercarriage of the excavator.

The slewing mechanism in FIG. 15 allows the turret to controllably pivot about a variable vertical slewing axis that is perpendicular to the undercarriage and the associated ground engaged portion of the tracks. The tracks are well known in the art and are used on numerous types of motive sources. Skidsteer loaders previously set forth in the application could and do utilize tracks as a means of urging them to move about a surface in situ also.

The tool ram in FIG. 15 may be selectively lengthened or shortened to force the tool ram connector assembly to move the journal box in a pivotal motion about an axis whose center is the axis of the centerline of the jib pin which joins the jib to the journal structure. The first brace of members of the tool ram connector assembly are pivotably connected to the jib at one of their ends and they rotate about the axis that lies at the center of the radius of the jib pin. The tool ram connector pin joins the other ends of the first brace of members and a second brace of members to the distal end of the tool ram. The other ends of the second brace of members are pivotably joined to the journal structure by the attitude control pin. As the ram is lengthened or shortened, the braces of members change position relative to one another like the movement of the hands on a clock, as if the hands on the clock were centered on the tool ram connector pin. The axis that lies at the center of the radius of the attitude control pin remains parallel with the axis of the jib pin as the axis of the attitude control pin is rotated about the arc whose center of radius is the axis of the jib pin. The axes about which the boom, jib and journal structure rotate as the operator of the excavator selectively urges them to move in any combination of movements either singly or in concert, are all parallel with the exception of the axis about which the slewing mechanism rotates. The controllably variable vertical axis 13 of the shaft 76 is adjustable and the angle of the axis 13 in relation to the surface being worked is variable. The movement of axis 13 remains on the same or a somewhat parallel plane as the selective movement of the components of the boom and jib of the lift arm assembly, as they act in concert.

The slewing mechanism in FIG. 15 can be controllably activated to urge the turret, boom, jib and journal structure to move in unison in a cyclonic or anticyclonic motion about an axis that is perpendicular to the ground engaging portion of the undercarriage of the excavator. As the excavator moves the turret in this slewing motion the attached tool carrier assembly is pivotable either freely or with selectively engaged rotational energy as set forth in the previous embodiments, to rotate to change the orientation of the tool carrier assembly. The change in orientation of the tool carrier assembly allows the operator of the excavator to move the tool carrier assembly with a slewing motion around the axis of the slewing mechanism. The ability to allow the boom or jib to float by a means of selectively relieving hydraulic fluid pressure in desired fluid channels would let the operator of the pivotable earthworking implement for a hydraulic excavator, slew the tool carrier assembly and let the weight of the boom and jib provide the desired downward pressure on the tool carrier assembly. The operator would then be free to concentrate his attention on the attitude control of the tool carrier assembly.

The tool carrier assembly of this embodiment floats along the surface in situ on the keel. The cutting edge is the leading ground contact component of the tool carrier and functions to carve the volume of surface material off that protrudes above the desired grade level of the surface in situ on which the tool carrier assembly is being propelled by the motive source. The volume of material that is carved off by the cutting edge builds up in front of the bow scraper blade and is deposited in any areas of lower elevation than the desired level of the surface in situ.

The keel functions as the depth control device. With the scraper blade parallel to the axis of the jib pin, as the operator of the hydraulic excavator draws the tool carrier assembly toward the axis at the center of the radius of the turret, the operator may lengthen or shorten the tool ram, causing the journal structure to rotate around the axis of the jib pin which causes the axis of the shaft to tilt. The tilting of the shaft causes the tool carrier assembly to tilt and causes the cutting edge to either rise up off the surface being worked or to carve more deeply into the surface being worked.

As the operator moves the turret in a slewing motion the shaft rotates and the scraper blade becomes perpendicular to the axis of the jib pin. In the slewing position the tilting of the journal structure causes the tee bar to rotate about the axis that lies at the center of the radius of the rocking pin. The parallel ends of the sleeves that face towards the tee bar are capable of bearing an axial or thrust load that may be applied by a force applied to the tee bar urging the tee bar to move in an axial direction. The inner surface has a load bearing capability that can bear a radial load. The rocking pin functions as in the previously set forth skidsteer embodiments. In the slewing position the tilting of the journal structure does not cause the cutting edge or the bow scraper blade to rise up or to cut more deeply. In the slewing position the change in the attitude of the cutting edge is controlled by the change of length of the mast ram.

The mast ram is lengthened or shortened by the means of selectively directing the flow of pressurized hydraulic fluid through the shaft as previously set forth in the skidsteer embodiment.

As the mast ram is lengthened or shortened the mast clevis that holds the mast clevis pin and the end of the ram rod translates movement through the mast and rotates the gudgeons at their pivotable connection to the tool carrier assembly. The concentric connections of the gudgeons to the starboard and port side plates are the glands and the gibs. The concentric connections of the gudgeons at the tool carrier assembly are a means to hold the gudgeons on an axis as they rotate by rotating the gudgeons within the inner diameter of the inner cylindrical mating surface of the glands. By applying a lubricant to these surfaces, they move easily about the axis. The glands are locked into place on the gibs. The gibs are attached to the starboard plate and the port plate by bolts that pass through the plates and are threaded into the gibs.

Radial load bearing surfaces of the gudgeons are the surface of the circumference of the gudgeon. The inner and outer cylindrical surfaces of the glands are concentric load bearing surfaces able to resist radial forces. The inwardly disposed concentric gib surface is a load bearing surface means capable of bearing a radial load of forces that are applied and that urge the gudgeon to move in a radial direction in relation to the somewhat horizontal second axis of this embodiment, as the radial force is translated through the gland to the gib.

Axial load bearing surfaces lie on the ends of the gudgeons. These ends are on a plane that lies perpendicular to the circumference of the gudgeons. The gib also has axial load bearing surfaces. The female thrust cap that nests onto the end of the gib protrusion has inboard and outboard parallel surfaces. The parallel surfaces on the thrust cap are contiguous to the ends of the gudgeons on the inboard side and the third interior inboard surface of end of the gib protrusion on the outboard side. The concentric position of the gib resists the axial movement of the gudgeon is a means to resist an axial load that may be applied to the gudgeon.

The gland, gudgeon and gib function as a means to removably attach the mast to the tool carrier assembly.

A locking pin inserted through a hole that extends through the gibs contacts the annular groove on the gland, resists the withdrawal of the glands from the gibs, is a means to lock the glands to the gibs in a removable way. By removing the locking pin the gland can be slid on the gudgeon toward the mid point of the mast base and out of it's mated position with the inner diameter of the gib. By sliding the mast glands out of the nested position and removing the mast ram base pin, the mast and mast ram may be disconnected from the tool carrier assembly. The adjustable frame of the previously set forth embodiments could be made to be interchangeable with a variety of different tool carrier assemblies by the same means as the mast.

As the gudgeons pivot about the somewhat horizontal second axis of this embodiment, a point on the somewhat horizontal first axis of this embodiment rotates in an arc around the second axis.

The first axis of this embodiment about which the midpoint sleeves and tee bar and the associated somewhat vertical shaft rotate is parallel to the port and starboard side plates and lies inboard of the two side plates.

The port side plate and the starboard side plate hold the axis about which the gudgeons rotate in place by supporting the gibs and in turn the mast glands.

The stern plate makes the stern on the tool carrier assembly more rigid by joining the keel and side plates together. The arch support reinforces the keel and keeps the port side plate and the starboard side plates held rigidly parallel to one another so that the tool carrier assembly is able to resist thrust and radial loads that may be applied to the gibs that are attached to it. The bow scraper blade and the bow plate also function to rigidly hold the side plates. The arch support also functions as a rigid support structure for the attachment of the base of the mast ram. The bow plate prevents excess buildup of surface material being pushed by the tool carrier assembly from filling the interior portion of the tool carrier assembly. The cultivator tools attached to the keel loosen and texture the surface being worked in situ as the tool carrier assembly is moved about the surface in situ.

FIG. 18

Description of an Alternative Embodiment

A dog tail 248 is an extension of the stern of the tool carrier assembly of the preferred embodiment. The dog tail is integrally attached to both the port side plate and to the starboard side plate and is extended on the same plane as the respective plates they are attached to. The bottom margins of the dog tail plates curve upward as they extend toward the stern termination point of the dog tail. At the stern most portion of the dog tail extensions are integrally attached a roller scraper 254 that is a rigid material somewhat vertically disposed and lying on a plane that is perpendicular to the plates at a predetermined distance from a ground contact surface 250 of a keel roller 258. The keel roller is a cylindrical roller and rollers are well known in the art. The keel roller has a ground contact surface 101 which extends a predetermined distance below the keel. The keel roller is a means of pivotably retaining the center of the radius of a rotateable axle 252 centered on the axis about which the keel roller rotates. The rotateable axle is removably attached to the dog tail as it is nested in a convoluted receptacle 253 of the margin of the upper portion of the dog tail at a predetermined distance between the stern plate and the roller scraper. The rotateable axle is held in a fixed position in the convoluted receptacle by a dog 256. The dog is a rigid clamping mechanism that is pivotably attached to the dog tail by a dog pivot means 246 and is rotated about the axis of the dog pivot means by a dog ram 260 which is pivotably connected to the dog by a dog ram pivot means 244.

FIG. 18

Operation of an Alternative Embodiment

The dog tail functions to hold the keel roller in place in a removably attached way so that the tool carrier assembly of this embodiment could be used either with or without the roller. The roller is positioned in the convoluted receptacle of the dog tail and the dog ram rotates the dog so that it contacts the rotateable axle and holds it firmly to the dog tail. The dog ram is activated by hydraulic fluid and is attached to the tool carrier assembly. The dog is a clamping or retaining mechanism that prevents the rotateable axle from rotating in the convoluted receptacle and allows the roller to rotate about the axis of the center of the radius of the axle. There is a dog, dog ram, and all of the associated components set forth here that are required to allow the clamping mechanism to function on both the port side of the tool carrier assembly and on the starboard side of the tool carrier assembly of this embodiment. The roller scraper functions to keep soil or other material from clinging to the ground contact surface of the roller as it rotates.

The roller allows the tool carrier assembly of this embodiment to function like the tool carrier assemblies of the skidsteer embodiments for texturing the soil or to make rolling the tool carrier assembly along the surface in situ an option.

FIG. 19

Description of an Interchangeable Tool Carrier Assembly Embodiment

Figure 19:
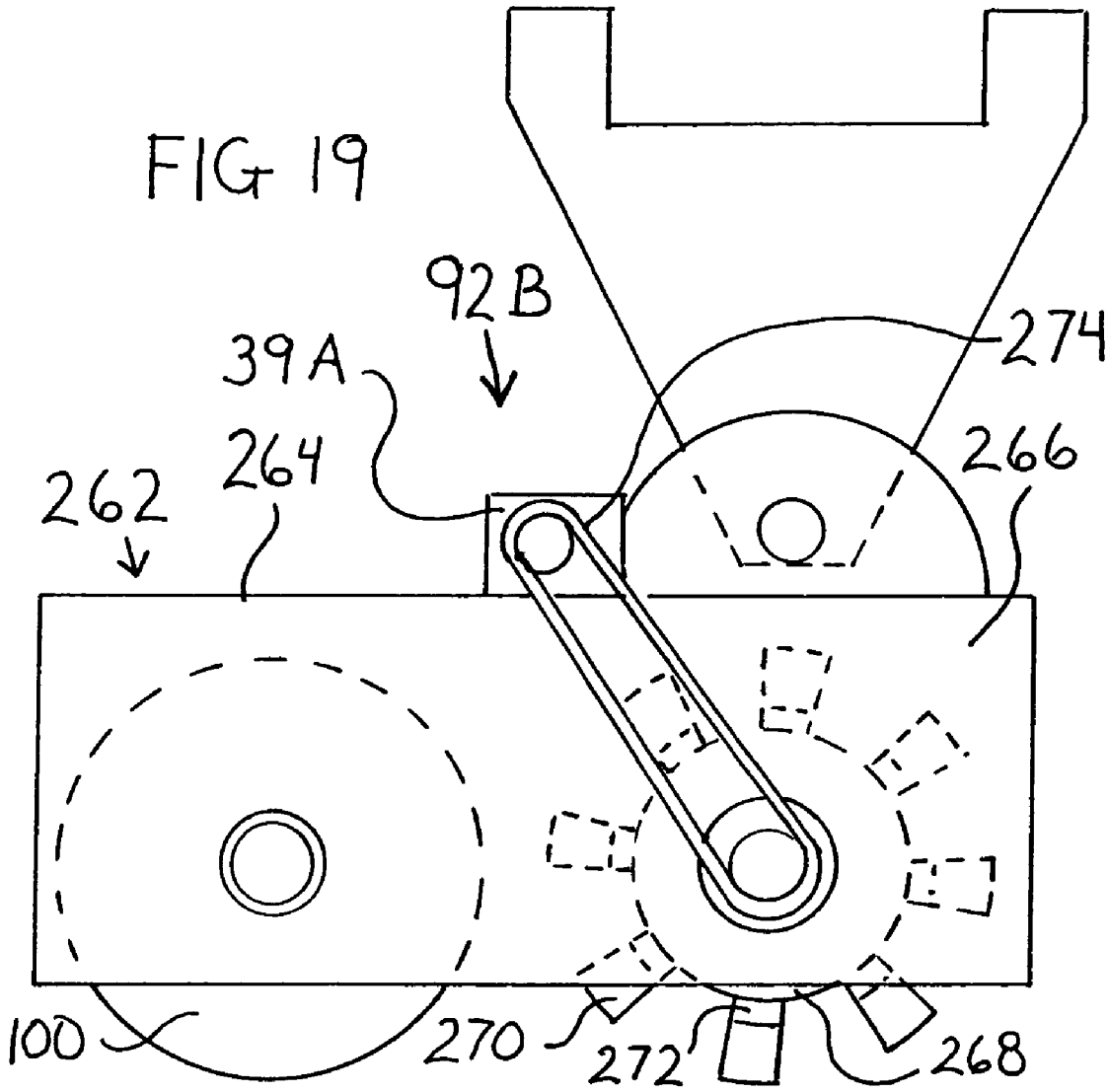
FIG. 19 is a side elevation view of an interchangeable tool carrier assembly.
Figure 20:
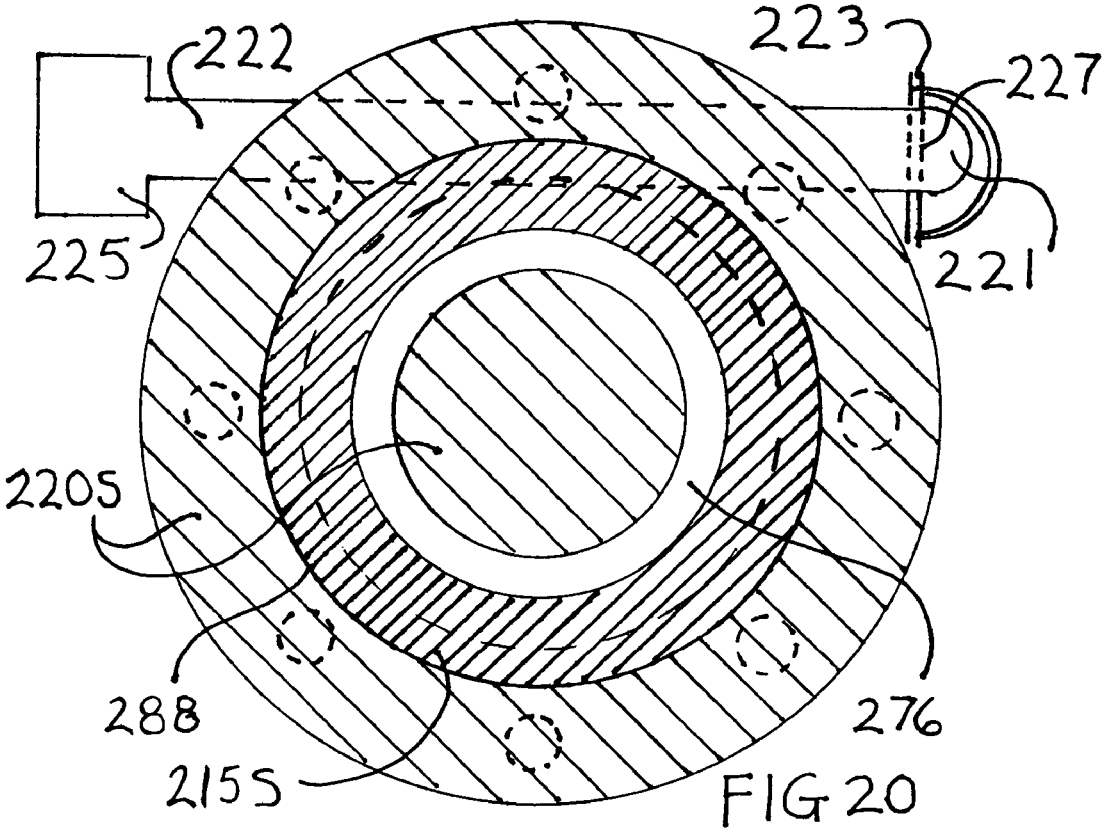
FIG. 20 is a section view of a gib, gland and gudgeon in a concentric relation.
Figure 21:
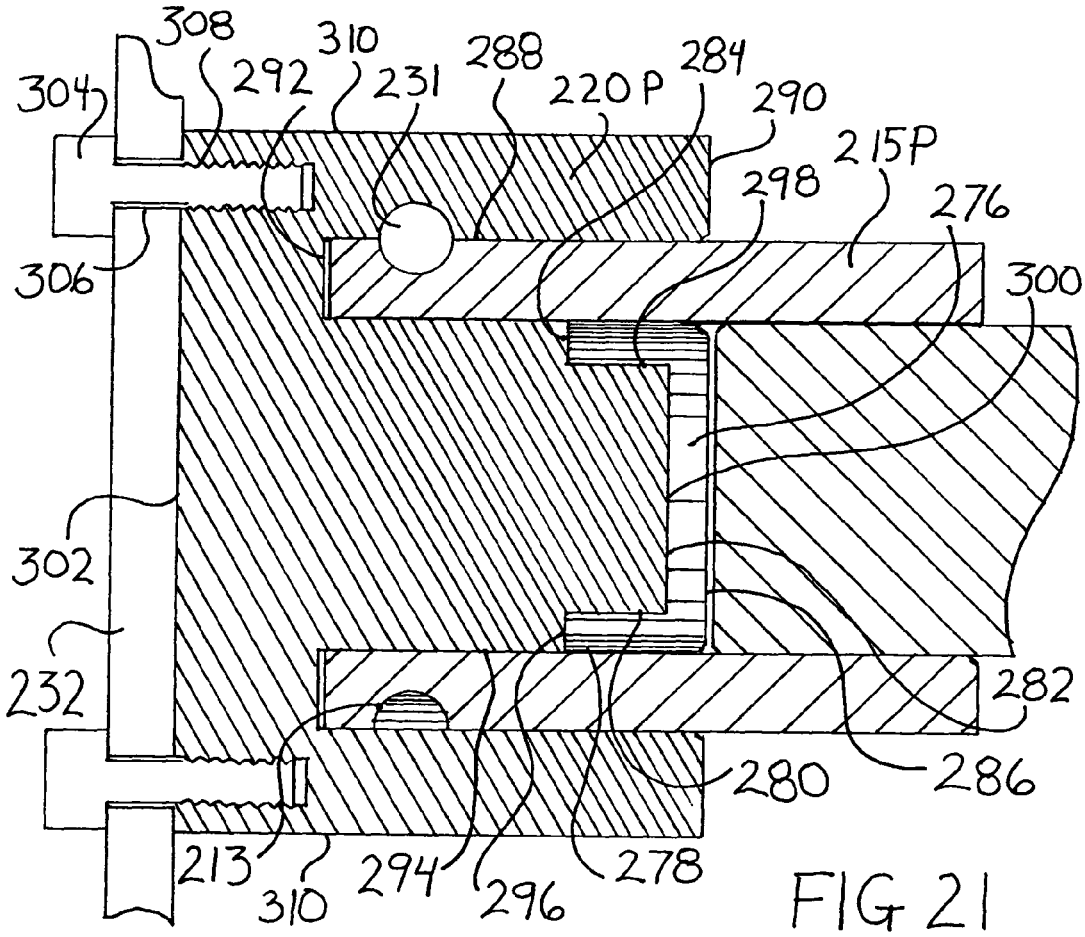
FIG. 21 is a section view of a gib attached to a side plate.

A tool carrier assembly 92 B of this embodiment has multiple means for removably attaching the mast and gudgeon of the excavator embodiment to a body 262 of the tool carrier assembly. The body has an inner surface and an outer surface. The mast can be attached to the motive source of the excavator embodiment or the skidsteer embodiment and all of their associated components and attachments of those components between the mast or the adjustable frame and the motive source as set forth in the previous embodiments. The mast and it's associated connections to the body of the tool carrier assembly may be attached to the skidsteer with all of its associated components and attachments of those components between the mast and the motive source as set forth in the previous embodiments. The body is a rigid structure having a top 264 that lies on a somewhat horizontal plane, and a side shield 266 on both sides that lie in parallel planes. The side shield planes are perpendicular to the top. The side shields are integrally attached to the top at the intersection of the two planes and are downwardly depending. The top and side shields are appropriately braced so as to form a rigid structure capable of journalling an axle about which the roller 100 rotates. The body also journals a means for allowing a rotating tool holder 268 to rotate about a fixed axis that is parallel to the axis about which the roller rotates. The tool holder has a boss 272 protruding outwardly that is integrally attached to the rotating tool holder as a means for attaching a cultivation tool 270 that can be bolted on to the boss to extend outwardly from the center of the radius of rotation of the rotating tool holder. There are a plurality of cultivation tools affixed to a plurality of boss' attached to the rotating tool holder. A means of imparting rotational energy 274 to the rotating tool holder, including hydraulic motor 39 A, which is well known in the art is shown in FIG. 19. A belt or chain drive mechanism would also function as a means of adding rotational energy to the rotating tool holder. A gearbox with an arrangement of gears would add rotational energy to the tool holder as well.

FIG. 19

Operation of the Interchangeable Tool Carrier Assembly Embodiment

The interchangeable nature of this embodiment allows the user of the motive source to change tool carrier assemblies to accomplish a variety of tasks in situ. Not only can the surface in situ be shaped by moving the soil and it's organic component, but the vegetative cover of the surface in situ can be shaped as well. The organic cover of the surface in situ could be cut with the appropriate tool carrier assembly and it's attached tool. Different tools could be used for stumps and heavy woody material or for grasses and lighter vegetation. A cultivation tool could be used on a tool carrier assembly to mix the organic material on the surface in situ to prepare the surface for growing new plants.

The mast ram base pin can be removed to disconnect the mast ram from the tool carrier assembly. The locking pins can be removed from the gibs. The gland would then be free to slide on the gudgeon out of the nested position with the gib to release the mast from the attachment points to the interchangeable tool carrier assembly.

The top and side shields of the body hold the means for journalling the roller and the rotating tool holder in a fixed position relative to one another. The motive source may apply downward force on the roller to insure engagement of the cultivation tools of the rotating tool holder with the surface in situ being cultivated as the tool carrier assembly is moved about the surface in situ. The body supports the attachment of a means for imparting rotational energy to the rotating tool holder including the hydraulic motor which is well known in the art.

Figure 22:
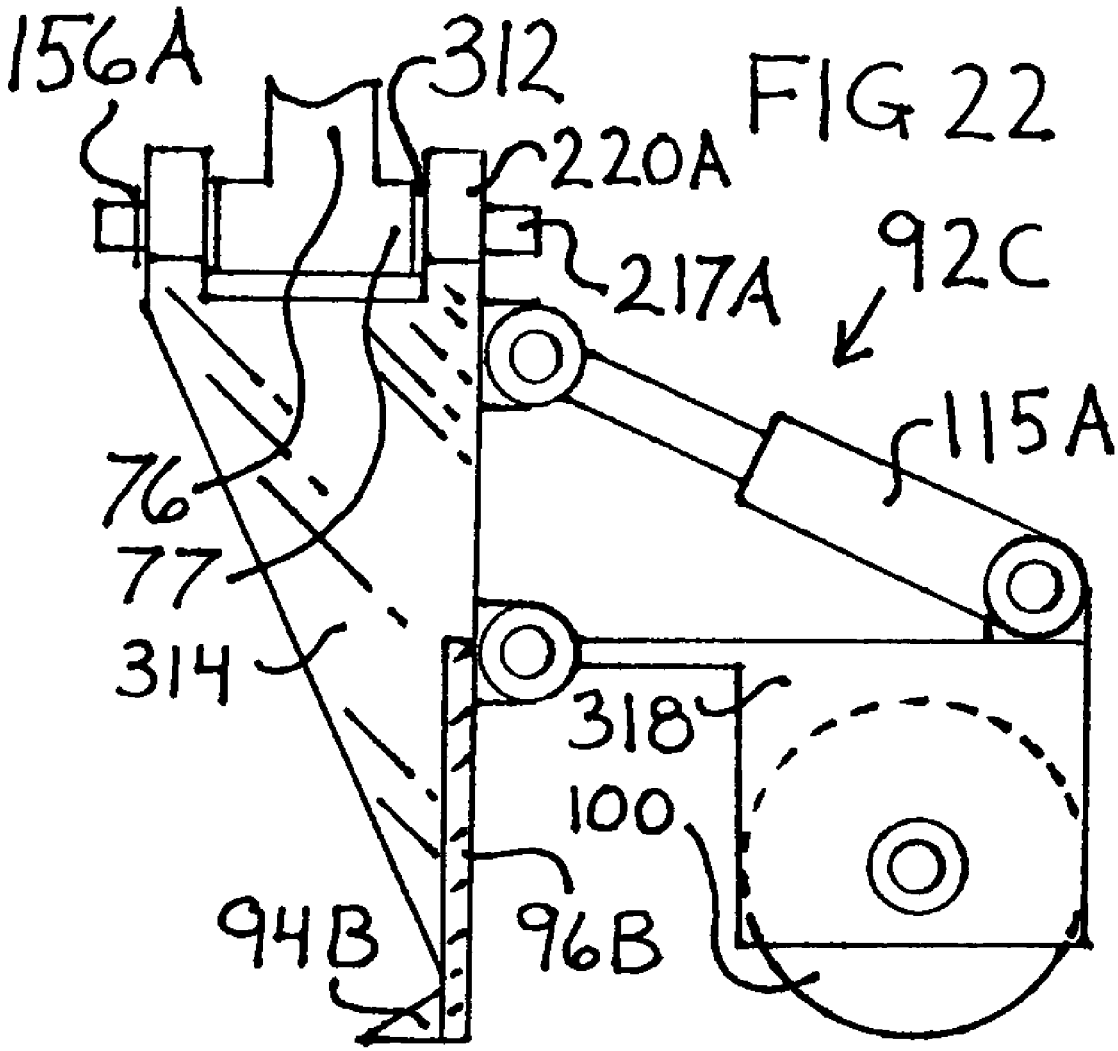
FIG. 22 is a side elevation view of an adjustable tool carrier assembly.
Figure 23:
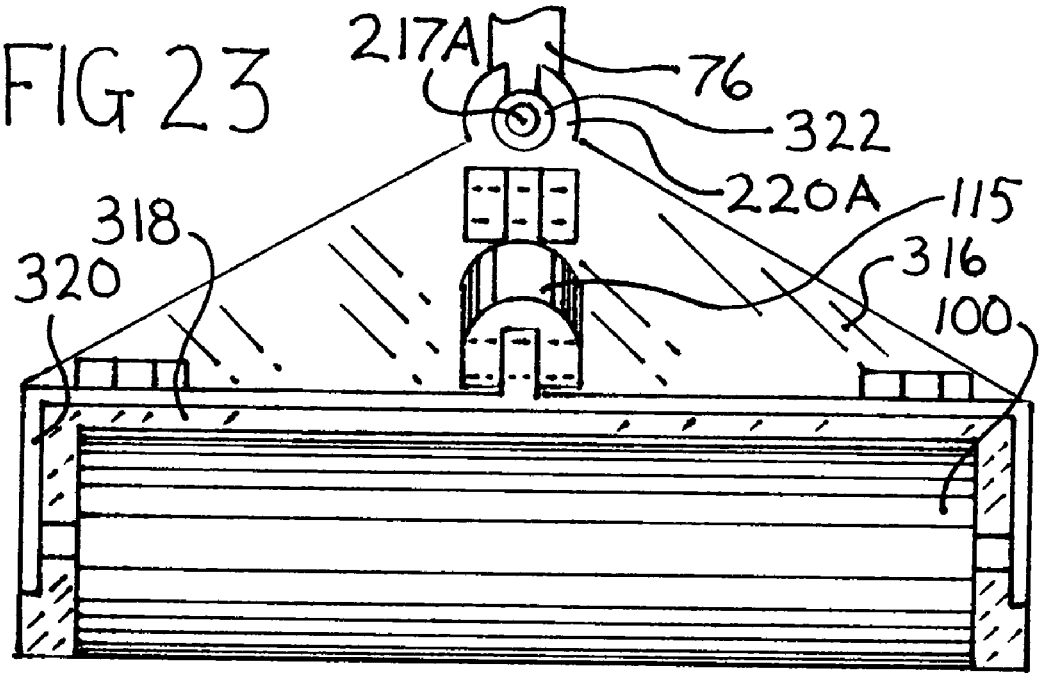
FIG. 23 is a rear elevation view of an adjustable tool carrier assembly.

FIGS. 22, 23—Description of an Adjustable Tool Carrier Assembly

An adjustable tool carrier assembly 92C is pivotably attached in a removable way to the tee bar of previously set forth embodiments by inserting a tee bar gudgeon 217A into the interior cylindrical opening of the tee bar. The gudgeon of this embodiment is a cylindrical-rod or pin that is journalled by a gib 220A. A tee bar gland 322 is slidably mounted on the tee bar gudgeon in a circumferential relation with the gudgeon and the gib. The gib of this embodiment has an opening at it's upward portion that is of a predetermined size. The gib has an inner load bearing surface that is contiguous to the outer circumference of the gland. The gib and the gland have a complementary relation with one another. The opening at the upward portion of the gib is somewhat larger by a predetermined distance that a diameter of the gudgeon. A snap ring 156 A is retained on the gudgeon by an annular groove on the gudgeon that lies a predetermined distance from the ends of the gudgeon of this embodiment. A thrust washer 312 is sandwiched by the gib and the tee bar in a circumferential position on the gudgeon.

The gibs are integrally attached to a head board 316, and a canard 314. The head board is an upwardly depending and rigidly attached extension of a scraper blade 96B. One of the gibs is attached at the upper margin of the head board. A second gib is attached to the upward apex of the canard.

The canard is integrally attached to the forward surface of the head board. The canard resembles a pair of wings on the downward beat. They are attached to the head board along the trailing edge of the wings. The bottom edge of the scraper blade and the edges of a the head board and the canard form the approximate edges of an irregular tetrahedron. An earthworking tool 94B, or cutting edge is attached to the bottom of the scraper blade.

A ram 115A is pivotably connected to a first pivotable connection point on the rear facing surface of the head board near the apex of the head board. A second pivotable attachment point of connection of the ram to the tool carrier assembly of this embodiment is a pivotable connection point on the upward surface of a fluke 318.

The fluke is pivotably connected to the rearward surface of the head board by the ram and the pivotable connections at opposite ends of the ram. The fluke is also pivotably connected directly to the rearward surface of the headboard at two pivotable connection points that are positioned a predetermined distance from the pivotable connection point of the ram to the head board and the lower margin of the scraper blade. The pivotable connections of the fluke to the head board are pivotable about an axis that lies parallel to the vertical plane of the scraper blade and head board, the axis about which the roller or depth guide rotates, and the line formed by the cutting edge of the earthworking tool.

A fluke wing 320 is integrally attached to both of the lateral edges of the fluke. The fluke wings are downwardly depending from the fluke and are perpendicular to the plane of the upper surface of the fluke. The lateral surfaces of the fluke wings are parallel to one another and journal the bearing surfaces that allow the roller to rotate about the axis that lies at the center of the radius of the circumferential outer surface of the roller.

FIGS. 22, 23—Operation of an Adjustable Tool Carrier Assembly

This embodiment has a tool carrier assembly with a means of controllably changing the somewhat fixed relation of the scraper blade and the depth guide. Retaining the scraper blade, and the depth control device in a somewhat fixed relation to one another and yet somewhat adjustable in their relation to one another, may be accomplished by pivotably attaching the depth guide to the scraper blade by an arrangement of structural elements and their pivotable connections that can be controllably changed by the lengthening or shortening of a ram or screw or other adjustable linking mechanism that would change the relative position of the depth guide and the scraper blade or cutting edge to one another. As the combination of elements are viewed in a particular cross section elevation view of the side of the contemplated embodiment, perpendicular to the draft, lines that lie between the pivotable connection points of the head board, ram and the fluke form a somewhat triangular shape. As the length of the ram is controllably changed the axis of the roller is rotated about the axis of the direct pivotable connections of the fluke to the head board. As the roller axis is controllably rotated it remains in a parallel relation to the axis which is at the center of the radius of the arc about which it rotates. This change in position of the roller in relation to the scraper blade causes the tool to rise up off of the surface in situ or to cut more deeply into the surface being worked.

The tool carrier assembly of this embodiment is pivotably attached in a controllably releasable way, to the shaft and the tee bar that function as previously set forth in this application. The gibs of this embodiment allow the tee bar gudgeons to be removed from an opening in the upward part of the gibs. The gibs hold the gland in place. The glands journal the gudgeons. The concentric surfaces of the gudgeons, glands and gibs allows the glands to be slidably moved off of the opposed ends of the gudgeons. The removal of the gland eliminates the means of retaining the concentric relation of the gib, gland and gudgeon. The gudgeon can then be removed from the gib through the opening in the upward portion of the gib. The opening in the gib is large enough to allow the gudgeon to pass through the opening only after the gland has been removed from the concentric position on the gudgeon.

The glands are retained on the gudgeons by the snap rings. The thrust washers that are sandwiched between the tee bar and the gibs are bearing surfaces that resist axial forces that are applied to the tee bar. The system of interchangeable tool carrier assemblies that this embodiment of an adjustable and interchangeable tool carrier assembly sets forth would make a wider range of possible choices for the use of the means of pivoting about the somewhat vertical axis.

The tool carrier assembly of this embodiment functions in the same way as the preferred embodiment as it is propelled about a surface in situ.

CONCLUSION, RAMIFICATIONS, AND SCOPE OF INVENTION

Accordingly one would see that the skidsteer, hydraulic excavator, or articulated steering types of motive sources are made more valuable by the creation of the earthworking implement that allows the operator of the motive source to maneuver the earthworking implement in a slewing motion or a cyclonic or anticyclonic motion to more effectively grade a surface in situ. The ability to manipulate the two part lift arm assembly of the hydraulic excavator to reach distances away from the motive source that are not possible with existing graders that are attached to the motive source such as the skidsteer, gives the operator of the excavator embodiment the ability to perform an earthworking task on a steep slope that would be to hazardous to operate a skidsteer or other motive source on. The operator of the hydraulic excavator can position the excavator motive source on a safe slope and reach out to a more steeply sloped area to perform the task.

One will see that the skidsteer loader is made even more valuable by the creation of a grader that overcomes a negative aspect of the skidsteer, namely the disruptive effect of the turning process, and turns it into a positive feature by combining the two and essentially making a zero turning radius grader. With the front wheels of the skidsteer lifted off the ground, the grader casters on the rollers in response to the turning action of the skidsteer and can turn in a cyclone like way around the skidsteer.

The introduction of interchangeable tool carrier assemblies allows the user to have a broader range of choices of implements for earthworking. The removably attached mast could be connected to many other tool carrier assemblies. An adjustable frame embodiment functions the same as the embodiment with a mast and could also be used as the interface for the interchangeable tool carrier assemblies. The tee bar could also be removably attached to allow it to be the interchangeable connection component of the tool carrier quick change system. As one could imagine, there are many combinations of ways to combine the means of interchangeable interfaces. They could be used with the two part lift arm assembly of the hydraulic excavator and its associated means of attachment to the means of journalling the shaft, or with the skidsteer embodiment with the single acting lift arm assembly and it's associated means of connection to the means of rotating the tool carrier assembly about the somewhat vertical axis.

While my above description contains many specificities, these should not be construed as limitations on the scope of the invention, but rather as an exemplification of one preferred embodiment thereof. Many of the alternative embodiments previously presented could be used in many different combinations. Many other variations are possible. For example, with a few modifications such as an armored cover over the top of the tool carrier assembly and a hydraulically operated beater attachment the grader could be converted for use as a mine sweeping device that clears a battle zone of unexploded mines. The invention textures the soil so that the operator can tell where the device has already passed over an area being cleared. The invention could easily be used by an armored track type vehicle in the same way it is used with a skidsteer and with the added maneuverability it would make the process of mine clearing much faster. The adaptation of the hydraulic excavator embodiment for use on an armored version of the hydraulic excavator would offer a much faster means of clearing a mined area due to the slewing action of the hydraulic excavator embodiment.

Cultivation tools that are powered by a hydraulic motor could be added to the tool carrier to allow the grader to cultivate and loosen the soil. These could be lowered to the ground on a pivoting set of arms to engage the tool on demand or retracted to a resting position up and out of the way to permit simply leveling the soil. The cultivation tools could be on a rotating drum or a set of tines on a shaft. The cultivator tools could be engaged by an eggbeater type of action. A set of disks could be lowered to contact the earth. Many of the ramifications could be lowered into place manually with a screw type connection link or they could be positioned by inserting a pin in part of the structure to secure the tools into place.

The rollers could have many different types of ground contact surfaces on them. A surface made up of scrap rubber tire pieces could be attached to the outer contact surface in a variety of ways so that the grader could roll onto concrete walks and driveways without doing any damage. A flat roller with studded surfaces on it could be used to texture the ground as the rollers pass over the surface. A surface made up of disks or plates spaced apart could effectively break up the lumps in a soil surface thereby preparing for seed. A series of evenly spaced spiraling bars at the surface could function nicely as a crumble roller.

The support structure of the invention could be constructed in many different shapes. It could be a lower profile with a short shaft. A variety of gussets and braces could be added by one skilled in the art. Cutouts for better visibility could be strategically located at various points on the distal end of the support structure. The main body cold be shaped by a variety of different shapes structural members. Round pipes or rectangular materials could be used. Many different types of braces, reinforcement, or gussets could be added for structural integrity.

The flanges on the housing could be integrally cast in one piece with the housing. The internal components of the housing could be sized differently and many arrangements of bearings would successfully accomplish the task of journalling the shaft in the housing. The bearing surface could be a simple bushing of brass or other material that is greased with a king pin held in place. It may be a king pin with no bushing at all. One skilled in the art would be able to conjure uncountable variations for journalling the shaft in the housing. The housing could be replaced by a pair of flat plates that function as bearing surfaces with roller bearings in between. The adjustable frame could then be attached directly to attachment points on the bottom plate and the top plate could then be attached to the support structure. A bearing race of various different shapes could be used to sandwich the roller bearings. The race itself could be pivotably attached to the rocking pin or to the support structure.

Hydraulic hoses or metal lines in a hollow shaft could pass through the center to the tool carrier. The hydraulic swivel could be a separate component. The shaft could be larger, shorter, longer, or smaller or could have more than two channels running through it for hydraulic fluid. The method of connection to the tee bar could be a removable connection such as a flatted cast piece that fits over a flatted end of the shaft.

The tee bar could be a different shape altogether. The tee bar could be a component having circumferential surfaces that are on the outward surface of the tee bar and are journalled by a gudgeon to pivotably connect the tee bar to an adjustable frame, mast or tool carrier assembly. The tee bar could be an interchangeable component held in place at the adjustable frame or tool carrier assembly by a dog or a gland. The dog or gland could be engaged or disengaged by a hydraulic arrangement of components or by a mechanical lever that engages or disengages a pin or pricket.

Instead of one long rocking pin, there could be two short ones in a "U" shaped component connecting the shaft to the adjustable frame. There could be many different variations of reinforcing the connection of the tee bar to the shaft.

The gear on the shaft could be replaced by a sprocket given rotational energy by a chain connected to a sprocket on the drive mechanism of the motor. The motor driving the gear or chain could be an electric motor. The motor could be mounted in a variety of locations on the support structure. The gear or sprocket could be located on top of the shaft. Belts could also be used to power the shaft. The gears could be sized in many different combinations to change the speed of rotation of the tool carrier assembly. There are a variety of ways to secure the gear onto the shaft. The shaft could be flatted to fit a corresponding flat on the gear. The shaft could have splines that fit on corresponding surfaces on the gear or sprocket.

The adjustable frame could be many different shapes. It could be a lower profile, or it could be attached to the tool carrier closer to the center of the tool carrier. It could have an arched shape or it could be rectangular in shape. Many different shapes of gussets and reinforcing plates could be used. It could be attached to the tool carrier in many ways. It could be farther forward of the scraper blade or it could be connected to the tool carrier aft of the scraper blade. The adjustable frame could be adjusted in different ways. A scissors frame could turn on opposed screws like a scissors jack to raise or lower one side or the other of the rocking pin bushing to give the shaft a different tilt with respect to the draft of the cutting edge. The adjustable link to an adjustable frame could be a turnbuckle, or some type of ratcheting mechanism.

An adjustable retainer frame could be the means of retaining the scraper blade and depth guide in a somewhat fixed but controllably changeable relation to one another. The adjustable retainer could be pivotably attached to a scraper blade. The scraper blade of this ramification or earthworking tool has a continuously rigid upwardly depending structure that is pivotably attached at it's upper margin to the rocking pin or it's equivalent pivotable connection. The rocking pin 82 of the preferred embodiment would function in the same way as in the retainer frame embodiment to allow the lateral rocking motion of the motive source to take place without causing the tool carrier assembly 92 to be urged to rock in the corresponding way to the rocking motion of the motive source and lift arm assembly.

relationship of the different elements of the rectangular shaped retainer frame. The adjustable linking mechanism could be attached in a number of ways that would accomplish the objective. It could be attached to the scraper blade at one end and the rectangular frame at it's other end. It could be attached to opposite corners of the rectangular frame, passing through the interior of the rectangular frame. The rectangular frame would hypothetically resemble a rectangle in it's cross sectional elevation view, as viewed perpendicular to the draft of the implement. The intersection of the sides would be pivotable points of connection. The side of the rectangle that is connected to the scraper blade would have two points on the corners of the side that is commonly held by the scraper blade which would remain in fixed relation to one another. As the adjustable linking mechanism is lengthened or shortened the side opposite the side that is held by the scraper blade moves up or down in relation to the surface being worked. All of the angles of the interior of the rectangle change as the linking mechanism urges the rectangular frame to change it's shape. The angles opposite each other concomitantly either increase or decrease in degree. Angles which share a common side of the interior of the rectangle have an inverse relation to each other as the angles are urged to change, one will increase while the other decreases in degree of angle. As the shape of the rectangular mechanism changes the depth guide moves up or down with relation to the surface in situ.

The two distinct axes of the means of pivotable connection of the tool carrier assembly to the rocking pin in the adjustable frame and mast embodiments may also be coplanar in relation to one another, as is the case in a universal joint. The universal joint is well known in the art. In the case of the universal joint the axes share a somewhat horizontal plane and lie perpendicular to each other. The rocking pin or other means of connection to the somewhat vertical shaft could be attached to sleeves that are attached to an upwardly depending portion of the universal joint assembly. The sleeves could then be pivotably attached to the somewhat vertical shaft. The means of pivotable connection that is set forth in the previous embodiments by the rocking pin could be accomplished instead by using a set of roller bearings journalled by bearing surfaces, an arrangement that is well known in the art. A snap ring or retaining clamp could be used to hold the bearing surfaces of the connections into their nested positions, a means of retaining components in place that is well known is the art.

The rocking pin connection could also be accomplished by means of an interchangeable connection that is releasably held by a dog mechanism that clamps a rotatable member into place in a convoluted receptacle on either the adjustable frame member, the tool carrier assembly, or on the downwardly depending portion of the somewhat vertical shaft. The dog mechanism could also hold a gland in place that is slidably mounted on either the tee bar or on a set of pins that extend horizontally inward toward the somewhat vertical shaft or outward and are cradled in a receptacle on the tee bar.

The glands could also be fitted into complementary shaped mating surfaces on the sleeves of the adjustable frame. The gland could be held in place by a cap that is bolted onto a corresponding plate adjacent to the gland mating surface. The tee bar could have extensions that are shaped to receive a gland. The extensions could be cradled by receptacles on the adjustable frame that have openings that are just large enough for the extensions of the tee bar to fit through the opening of the cradle. The interior portion of the convoluted cradle could then be filled with the gland. The gland being wider than the opening of the convoluted receptacle, would prevent the gland and it's associated tee bar extension from being retracted from the convoluted receptacle thereby resulting in a releasably attached pivotable connection. A pivotable attachment of two components could be accomplished by simply removing a pin that has a circumferential surface and is journalled by one or more sleeves.

In the hydraulic excavator embodiment the gland on the gudgeons could be cradled in a somewhat v shaped arrangement of roller bearings that align the gudgeons with the gib to allow the gland to slide into the concentric surfaces of the gib as the interchangeable tool carrier assembly is connected to the mast. The alignment of the gudgeons and gib could also be assisted by a stop that is a part of the gib. The gib stop would allow the gudgeon to be lowered into place on the circumferential opening on the gib so that the gudgeon is cradled on the gib. The gland would then be aligned with the concentric surfaces on the gib and slide into the locked position with ease. The gland would prevent the gudgeon from moving out of the locked position and moving through the circumferential opening of the gib. The same concept of cradles and stops could be used to facilitate the releasable connections of the pivotable connections at the rocking pin or it's equivalent or at the connection of the adjustable frame to the tool carrier assembly of the preferred embodiment.

The tool carrier assembly could be a different shape. The rollers a different diameter, the cutting edge at a different angle, the braces in a different place, more mid-plates, no mid-plate, one roller, a set of wheels and tires instead of rollers, more than one ram, or more than one manual connecting link to the adjustable frame.

The tool carrier could have a depth gage indicator between the adjustable frame and the tool carrier assembly. This could be a rod with markings on it, sliding within a hollow tube, that is pivotally connected at one end to the tool carrier. The tube could be pivotally connected to the adjustable frame and the action of adjusting the attitude of the frame to the tool carrier would cause the rod to slide within the tube thereby indicating the depth of the cutting edge. The depth indicator could also be a circular disk with a square hole in the middle of it and a square rod that fits in the hole in the middle of the disk. The square rod is twisted to create a somewhat spiral effect of the points of the angles on the surface of the rod. These spiraled edges would cause the disk to spin at a predictable rate as the rod is pushed through the hole in the disk. The disk could be pivotally connected to the adjustable frame and the square rod to the tool carrier.

The rollers could be attached to the carrier by simple flange mounted bearing. A flange mounting could be used to interface a flanged gudgeon with a corresponding mating surface on a gib. The flange on the end of the gudgeon could be removed out of the gib through an opening in the upper portion of the gib. The two could be held in place by a holding spike or a dog or other clamping means that would hold the gudgeon in place in a mated position with the gib.

A motive source of the type commonly known as articulating loaders could be used as a motive source for the embodiments set forth in this application. The articulated machines are pivotably attached at a mid-mount bearing that is located on the chassis of the articulated loader. The controllable steering mechanism urges the articulated loader to pivot about the vertical axis of the chassis resulting in a turning motion as the loader is propelled forward or backward. The articulating action results in a slewing motion of the distal end of the lift arm assembly of the articulated loader. The embodiments set forth in this application would work equally well with a lift arm assembly of an articulated loader.

Accordingly, the scope of the invention should be determined not by the embodiments illustrated, but by the appended claims and their legal equivalents.

I claim:

1. An earthworking implement for moving a material on a surface in situ, for attachment to a motive source, A. wherein said motive source comprises;

i. a chassis comprising;

(a) a left side of said chassis, (b) a right side of said chassis, (c) a forward end of said chassis, ii. a lift arm assembly pivotally attached to said chassis comprising;

(a) an outwardly disposed end on said lift arm assembly projecting outwardly from said forward end of said chassis and (b) a means of conveying downward force to said outwardly disposed end, causing an upward lifting of a part of said chassis, (c) a tilt mechanism that is pivotably attached at a predetermined position near said outwardly disposed end, and a means of controllably varying the position of said tilt mechanism, B. said earthworking implement comprising;

i. a support structure comprising, (a) an attachment structure rigidly attached to said support structure, and removably attached to said tilt mechanism of said lift arm assembly, (b) a first opposed load bearing surface, ii. a tool carrier assembly, comprising;

(a) an earthworking tool attached to said tool carrier assembly, (b) a depth guide attached to said tool carrier assembly, capable of retaining said earthworking tool at a controllably variable height above or below said surface by said means of controllably varying the position of said tilt mechanism, while said depth guide remains in contact with said surface, comprising;

1. a material contact surface that is circumferential, 2. an interior structure, attached in a concentric relation to said material contact surface, which defines a depth guide axis about which said material contact surface rotates, and 3. a depth guide axis retainer assembly that pivotally attaches said depth guide to said tool carrier assembly, (c) a second opposed load bearing surface, iii. a multiple axis rotation assembly pivotally connecting said tool carrier assembly to said support structure comprising;

(a) a first load bearing surface, (b) a controllably variable vertical axis about which said first load bearing surface and said first opposed load bearing surface rotate in opposition, (c) a second load bearing surface, (d) a controllably variable horizontal axis about which said second load bearing surface and said second opposed load bearing surface rotate in opposition, whereby said earthworking implement is propelled about said surface in situ by said motive source, moving said material on said surface in situ with said earthworking tool retained at a controllably variable height above or depth below said surface, while said tool carrier assembly is controllably pivoted about said controllably variable vertical axis and said controllably variable horizontal axis, and said depth guide axis is held in a fixed position in relation to said tool carrier assembly as said tool carrier assembly is rolled over said surface in situ.

2. The earthworking implement of claim 1 further comprising a plurality of said depth guide.

3. The earthworking implement of claim 1, attached to said motive source wherein said motive source comprises;

A. a surface contact propulsion assembly on said left side of said chassis, and a second said surface contact propulsion assembly on said right side of said chassis, B. a left side propulsion control on said motive source that may be selectively activated to control a left side speed and direction of said surface contact propulsion assembly on said left side, C. a right side propulsion control on said motive source that may be selectively activated to control a right side speed and direction of said surface contact propulsion assembly on said right side.

4. The earthworking implement of claim 3 wherein said earthworking tool is a scraper blade.

5. The earthworking implement of claim 3, attached to said motive source wherein said motive source further comprises;

A. a connection foot of a predetermined shape, attached to said tilt mechanism of said lift arm assembly and B. a means of pivoting said connection foot controllably about a tilting axis that is disposed somewhat perpendicular to said variable vertical plane, and C. a locking mechanism movably attached to said connection foot to allow said locking mechanism to move controllably from a first predetermined position of engagement to a second predetermined position of disengagement, and to allow said locking mechanism to move from said second predetermined position of disengagement to said first predetermined position of engagement, and wherein said earthworking implement further comprises;

A. an attachment shoe of a predetermined shape, attached to said support structure and nested together with said connection foot, whereby said connection foot is nested with said connection shoe and said locking mechanism is controllably moved from said second predetermined position of disengagement to said first predetermined position of engagement to lock said support structure to said lift arm assembly, allowing said tilt mechanism to vary said controllably variable vertical axis.

6. The earthworking implement of claim 3, attached to said motive source wherein said surface contact propulsion assembly comprises a track assembly.

7. The earthworking implement of claim 1, wherein said earthworking tool is a cultivator tool.

8. The earthworking implement of claim 7 wherein said cultivator tool is a rotary cultivation tool and a means for imparting rotational energy to said rotary cultivation tool.

9. The earthworking implement of claim 7 further including a plurality of said cultivator tool.

10. An earthworking implement for moving a material on a surface in situ, said surface in situ having an area of variation from a level condition, said earthworking implement for attachment to a motive source;

A. said motive source comprising;

i. a chassis comprising;

(a) a surface contact propulsion assembly for propulsion of said chassis in a controllably variable direction on said surface in situ, ii. a lift arm assembly rigidly retained in a controllably pivotable relation to said chassis, said lift arm assembly being rotateable about a variable horizontal lifting axis that is disposed in a perpendicular relation to a variable vertical plane, said lift arm assembly projecting outwardly from said chassis in a somewhat parallel relation to said variable vertical plane, comprising;

(a) a means of conveying force to said lift arm assembly to move said lift arm assembly on a somewhat parallel range of motion with said variable vertical plane, (b) a means of controllably pivoting said earthworking implement about a tilting axis, said tilting axis being disposed in a somewhat perpendicular relation to said variable vertical plane, B. said earthworking implement comprising;

i. a support structure rigidly retained in a controllably variable relation to said lift arm assembly, said support structure moving concomitant said variable vertical plane, comprising;

(a) an attachment structure rigidly attached to said support structure, and removably attached to said lift arm assembly, (b) a first opposed load bearing surface retained in a rigid relation to said support structure, ii. a tool carrier assembly, comprising;

(a) an earthworking tool attached to said tool carrier assembly for the movement of said material, (b) a material contact surface for engagement on said surface in situ, (c) a second opposed load bearing surface, iii. a multiple axis rotation assembly pivotally connecting said tool carrier assembly to said support structure comprising;

(a) a first load bearing surface, (b) a controllably variable vertical axis disposed somewhat parallel to said variable vertical plane, said first load bearing surface and said first opposed load bearing surface rotating in opposition about said controllably variable vertical axis, allowing said tool carrier assembly to rotate concomitant said first load bearing surface, and change the orientation of said tool carrier assembly while said material contact surface is engaged on said surface in situ, (c) a second load bearing surface rotating in opposition to said second opposed load bearing surface, in response to a motion of said variable vertical plane concomitant said controllably variable vertical axis, said motion being from a first position of orientation of said variable vertical plane tilted toward a direction varied from a vertical position, said motion proceeding through said vertical position to a second position of orientation of said variable vertical plane tilted toward an opposite direction of variation from said vertical position, said motion caused by the propulsion of said surface contact propulsion assembly over said area of variation from a level condition and, (d) a controllably variable horizontal axis, about which said second load bearing surface and said second opposed load bearing surface rotate in opposition, said controllably variable horizontal axis disposed in a predetermined angular relation to said controllably variable vertical axis, said controllably variable horizontal axis being controllably rotateable in a predetermined range of motion in relation to said controllably variable vertical axis, said predetermined range of motion including a position of somewhat parallel alignment of said controllably variable horizontal axis with said variable vertical plane, said motion of said variable vertical plane causing said second load bearing surface to always rotate in relation to said second opposed load bearing surface while said controllably variable horizontal axis is in said position of somewhat parallel alignment with said variable vertical axis, whereby said earthworking implement levels variations on said surface in situ and every time said motive source moves over variations from level on said surface that cause said chassis to tilt one direction and then tilt in the opposite direction, when said controllably variable horizontal axis is oriented in a somewhat parallel relation to said variable vertical plane of said lift arm assembly, then said second load bearing surface will rotate in opposition to said second opposed load bearing surface, and the tilting motion will not tilt the tool carrier assembly and cause said earthworking tool to tilt and cause a variation from a level condition on said surface in situ.

11. The earthworking implement of claim 10 for attachment to said motive source, A. wherein said chassis further includes;

i. an undercarriage comprising;

(a) said surface contact propulsion assembly, ii. a turret comprising, (a) a means of selectively directing the flow of pressurized hydraulic fluid through various channels, iii. a slewing mechanism pivotally attaching said turret to said undercarriage, allowing said turret to controllably pivot about a variable vertical slewing axis that is disposed in a parallel relation to said variable vertical plane, B. wherein said lift arm assembly is rigidly retained in said controllably pivotable relation to said turret of said chassis, whereby said motive source may move said material with said tool carrier assembly in a direction and have the capability to move excess material to one side or the other by activating the slewing mechanism.

12. The earthworking implement of claim 11 wherein said material contact surface is circumferential.

13. The earthworking implement of claim 11 wherein said earthworking tool is a cultivator tool.

14. The earthworking implement of claim 11; wherein said earthworking tool is a scraper blade.

15. The earthworking implement of claim 11 further including, a universal quick change adapter for attachment of said motive source to said earthworking implement.

16. The earthworking implement of claim 11, attached to said motive source wherein;

A. said first load bearing surface and said second load bearing surface are disposed on a multiple axis rigid structural component, wherein said multiple axis rigid structural component further includes;

i a hydraulic fluid passage P, for the conduction of pressurized hydraulic fluid from said motive source to said tool carrier assembly, passing through the interior of said multiple axis rigid structural component, ii a hydraulic fluid passage R, for the return flow of hydraulic fluid from said tool carrier assembly to said motive source, passing through the interior of said multiple axis rigid structural component, B. said tool carrier assembly further includes;

i a ram ii a means of pivotably connecting said ram to said tool carrier assembly to allow said ram to retain said material contact surface in a controllably variable attitude in relation to said surface in situ, C. said earthworking implement further including;

i a means to conduct pressurized hydraulic fluid from said motive source, through said hydraulic fluid passage P, to said ram, ii a means to conduct hydraulic fluid from said ram, through said hydraulic fluid passage R, to said motive source, D. said motive source further includes a means of selectively directing the flow of pressurized hydraulic fluid through various channels.

17. The earthworking implement of claim 10 for attachment to said motive source, wherein;

A. said material contact surface is disposed on a depth guide, said depth guide being attached to said tool carrier assembly, said depth guide is capable of retaining said earthworking tool in a controllably variable position in relation to said surface in situ, and B. said means of controllably pivoting said earthworking implement about said tilting axis, causes said tool carrier assembly to tilt in relation to said lift arm assembly and to vary the height or depth of said earthworking tool from said surface in situ, while said material contact surface is engaged on said surface in situ.

18. An earthworking implement for moving a material on a surface in situ, for attachment to a motive source, A. wherein said motive source comprises;

i. a chassis comprising;

(a) a left side of said chassis, (b) a right side of said chassis, (c) a forward end of said chassis, ii. a lift arm assembly pivotally attached to said chassis comprising;

(a) an outwardly disposed end on said lift arm assembly projecting outwardly from said forward end of said chassis and (b) a means of conveying downward force to said outwardly disposed end, causing an upward lifting of a part of said chassis, (c) a tilt mechanism that is pivotably attached at a predetermined position near said outwardly disposed end, and a means of controllably varying the position of said tilt mechanism, B. said earthworking implement comprising;

i. a support structure comprising, (a) an attachment structure rigidly attached to said support structure, and removably attached to said tilt mechanism of said lift arm assembly, (b) a first opposed load bearing surface, ii. a tool carrier assembly, comprising;

(a) an earthworking tool attached to said tool carrier assembly, (b) a depth guide attached to said tool carrier assembly, said depth guide disposed separated and apart from said earthworking tool at a predetermined distance from said earthworking tool, said depth guide disposed in a trailing position in relation to the draft of said earthworking tool, comprising;

1. a material contact surface, having a structure that causes said material contact surface of said depth guide to remain essentially on top of said surface in situ, as said means of conveying downward force is applied through said lift arm assembly and is translated through said support structure and said tool carrier assembly to said depth guide, (c) a second opposed load bearing surface, iii. a multiple axis rotation assembly pivotally connecting said tool carrier assembly to said support structure comprising;

(a) a first load bearing surface, (b) a controllably variable vertical axis about which said first load bearing surface and said first opposed load bearing surface rotate in opposition, (c) a second load bearing surface, (d) a controllably variable horizontal axis about which said second load bearing surface and said second opposed load bearing surface always rotate in opposition, in response to a relatively slight rocking motion of said motive source from said left side of said chassis to said right side of said chassis, or from said right side of said chassis to said left side of said chassis, when said relatively slight rocking motion is translated through said support structure to said multiple axis rotation assembly, as said motive source moves in a forward direction or in a reverse direction over variations from level on said surface in situ, and while said motive source is moving in said forward direction or said reverse direction, said means of controllably varying the position of said tilt mechanism causes a first tilting force to be translated through said support structure and associated said multiple axis rotation assembly, causing said earthworking tool to dig more deeply below said surface than said material contact surface of said depth guide is capable of, while said material contact surface remains essentially on top of said surface in situ, and said means of controllably varying the position of said tilt mechanism is also capable of causing a second tilting force to move in an opposite direction than said first tilting force, said second tilting force being capable of causing said earthworking tool to rise completely above said surface in situ when said motive source is moving in said forward direction or said reverse direction while said material contact surface remains in contact with said surface in situ with no part of said earthworking tool in contact with said material, whereby said earthworking implement is propelled about said surface in situ by said motive source, moving said material on said surface in situ with said earthworking tool retained at a controllably variable height above or depth below said surface, while said tool carrier assembly is controllably pivoted about said controllably variable vertical axis and said controllably variable horizontal axis.

19. The earthworking implement of claim 18 wherein said material contact surface is circumferential and said depth guide further comprises a means of pivotally attaching said material contact surface to said tool carrier assembly, whereby said material contact surface is rotateable about one or more axes.

20. The earthworking implement of claim 19 further comprising a plurality of said depth guide.

* * * * *